US009980531B2

(12) United States Patent
Suddaby

(10) Patent No.: US 9,980,531 B2
(45) Date of Patent: May 29, 2018

(54) PROTECTIVE HELMET WITH ENERGY STORAGE MECHANISM

(71) Applicant: Loubert S. Suddaby, Orchard Park, NY (US)

(72) Inventor: Loubert S. Suddaby, Orchard Park, NY (US)

( * ) Notice: Subject to any disclaimer, the term of this patent is extended or adjusted under 35 U.S.C. 154(b) by 0 days. days.

(21) Appl. No.: 15/401,257

(22) Filed: Jan. 9, 2017

(65) Prior Publication Data

US 2017/0112220 A1 Apr. 27, 2017

Related U.S. Application Data

(63) Continuation-in-part of application No. 14/615,011, filed on Feb. 5, 2015, which is a continuation-in-part of application No. 13/841,076, filed on Mar. 15, 2013, now Pat. No. 9,795,178, which is a continuation-in-part of application No. 13/412,782, filed on Mar. 6, 2012.

(51) Int. Cl.

| | |
|---|---|
| ***A42B 3/00*** | (2006.01) |
| ***A42B 3/06*** | (2006.01) |
| ***A42B 3/12*** | (2006.01) |
| ***A42B 3/28*** | (2006.01) |
| ***A42B 3/04*** | (2006.01) |

(52) U.S. Cl.

CPC ..... *A42B 3/064* (2013.01); *A42B 3/046* (2013.01); *A42B 3/0453* (2013.01); *A42B 3/121* (2013.01); *A42B 3/127* (2013.01); *A42B 3/283* (2013.01)

(58) Field of Classification Search

CPC ..... A42B 3/121; A42B 3/064; A42B 3/124; A42B 3/322; A42B 3/326; A42B 3/06; A42B 3/065; F41H 1/04

See application file for complete search history.

(56) References Cited

U.S. PATENT DOCUMENTS

| | | | | |
|---|---|---|---|---|
| 2,194,903 A | | 3/1940 | Holstein | |
| 2,197,174 A | * | 4/1940 | Crosby | A42B 3/06 2/6.8 |
| 2,306,362 A | * | 12/1942 | Wolff | A42B 3/065 2/5 |
| 2,861,272 A | | 11/1958 | Stuart et al. | |

(Continued)

FOREIGN PATENT DOCUMENTS

| | | |
|---|---|---|
| CN | 201094314 | 8/2008 |
| DE | 19544375 | 3/1997 |

(Continued)

*Primary Examiner* — Sally Haden

(74) *Attorney, Agent, or Firm* — Simpson & Simpson, PLLC

(57) ABSTRACT

A protective helmet having multiple protective zones, including an inner shell having a first inner surface and a first outer surface, a padded inner lining attached to the first inner surface, an outer shell having a second inner surface and a second outer surface, the outer shell functionally attached to the inner shell, an elastomeric zone between the first outer surface and the second inner surface, a plurality of energy dissipation devices arranged between the inner and outer shells, and a plurality of sinusoidal springs positioned in the elastomeric zone. Each of the plurality of sinusoidal springs includes a first end, and a second end connected to one of the plurality of energy dissipation devices.

10 Claims, 45 Drawing Sheets

(56) References Cited

U.S. PATENT DOCUMENTS

| | | | | |
|---|---|---|---|---|
| 3,089,144 | A | 5/1963 | Cherup | |
| 3,107,356 | A | 10/1963 | Pestronk et al. | |
| 3,167,069 | A | 1/1965 | Lobelle | |
| 3,430,458 | A * | 3/1969 | Titt | F16D 1/0835 29/896.91 |
| 3,600,714 | A | 8/1971 | Cade et al. | |
| 3,616,463 | A | 11/1971 | Theodore et al. | |
| 3,668,704 | A | 6/1972 | Conrov et al. | |
| 3,872,511 | A | 3/1975 | Nichols | |
| 3,875,275 | A | 4/1975 | Lemelson | |
| 3,946,441 | A | 3/1976 | Johnson | |
| 4,023,209 | A | 5/1977 | Frieder, Jr. et al. | |
| 4,075,717 | A | 2/1978 | Lemelson | |
| 4,124,904 | A | 11/1978 | Matthes | |
| 4,211,220 | A | 7/1980 | O/Neill | |
| 4,307,471 | A | 12/1981 | Lovell | |
| 4,345,338 | A | 8/1982 | Frieder, Jr. et al. | |
| 4,566,137 | A | 1/1986 | Gooding | |
| 4,586,200 | A | 5/1986 | Poon | |
| 4,708,757 | A * | 11/1987 | Guthrie | B32B 37/144 156/163 |
| 4,903,346 | A | 2/1990 | Reddemann et al. | |
| 5,003,973 | A | 4/1991 | Ford et al. | |
| 5,101,517 | A | 4/1992 | Douglas | |
| 5,181,279 | A | 1/1993 | Ross | |
| 5,204,998 | A | 4/1993 | Liu | |
| 5,263,202 | A | 11/1993 | Siberell | |
| 5,319,808 | A | 6/1994 | Bishop et al. | |
| 5,496,066 | A | 3/1996 | Hoffmann et al. | |
| 5,815,846 | A | 10/1998 | Calonge | |
| 5,950,244 | A | 9/1999 | Fournier et al. | |
| 5,956,777 | A | 9/1999 | Popovich | |
| 6,014,769 | A | 1/2000 | Baudou et al. | |
| 6,138,283 | A | 10/2000 | Kress | |
| 6,378,140 | B1 * | 4/2002 | Abraham | A42B 3/064 2/411 |
| 6,604,246 | B1 | 8/2003 | Obreja | |
| 6,658,671 | B1 | 12/2003 | Von Holst et al. | |
| 6,817,039 | B1 | 11/2004 | Grilliot et al. | |
| 7,603,725 | B2 * | 10/2009 | Harris | A42B 3/121 2/410 |
| 7,774,866 | B2 | 8/2010 | Ferrara | |
| 7,895,681 | B2 | 3/2011 | Ferrara | |
| 7,941,873 | B2 | 5/2011 | Nagely et al. | |
| 8,117,676 | B1 | 2/2012 | Cardoso | |
| 8,176,574 | B2 | 5/2012 | Bryant et al. | |
| 8,181,281 | B2 | 5/2012 | Nagely et al. | |
| 2001/0032351 | A1 | 10/2001 | Nakayama et al. | |
| 2002/0073994 | A1 | 6/2002 | Patel | |
| 2003/0217483 | A1 | 11/2003 | Abraham | |
| 2005/0268383 | A1 * | 12/2005 | Harris | A42B 3/121 2/413 |
| 2007/0190292 | A1 | 8/2007 | Ferrara | |
| 2008/0229488 | A1 | 9/2008 | Kim | |
| 2008/0256686 | A1 | 10/2008 | Ferrara | |
| 2010/0000009 | A1 | 1/2010 | Morgan | |
| 2010/0023135 | A1 | 1/2010 | Rubie et al. | |
| 2011/0072548 | A1 | 3/2011 | Hersick et al. | |
| 2011/0214225 | A1 * | 9/2011 | Norris | A42B 3/042 2/425 |
| 2012/0198604 | A1 | 8/2012 | Weber et al. | |
| 2012/0210490 | A1 | 8/2012 | Harty | |
| 2012/0233745 | A1 | 9/2012 | Veazie | |
| 2012/0297526 | A1 | 11/2012 | Leon | |
| 2013/0061371 | A1 | 3/2013 | Phipps et al. | |
| 2013/0167289 | A1 | 7/2013 | Rensink et al. | |
| 2014/0173810 | A1 | 6/2014 | Suddaby | |
| 2014/0215694 | A1 | 8/2014 | Grice | |
| 2015/0143617 | A1 | 5/2015 | Suddaby | |
| 2015/0208751 | A1 | 7/2015 | Day | |
| 2016/0029730 | A1 | 2/2016 | Day | |
| 2016/0128414 | A1 | 5/2016 | Gotti | |
| 2016/0157545 | A1 | 6/2016 | Bowman | |

FOREIGN PATENT DOCUMENTS

| | | |
|---|---|---|
| EP | 0048442 | 3/1982 |
| EP | 1142495 | 10/2001 |
| JP | 2001295129 | 10/2001 |
| WO | 8605369 | 9/1986 |
| WO | 2003015555 | 2/2003 |
| WO | 2010-151631 | 12/2010 |
| WO | 2011090381 | 7/2011 |

* cited by examiner

PROTECTIVE HELMET WITH ENERGY STORAGE MECHANISM

CROSS-REFERENCE TO RELATED APPLICATIONS

This application is filed under 35 U.S.C. § 120 as a continuation-in-part of U.S. patent application Ser. No. 14/615,011, filed Feb. 5, 2015, which application is a continuation-in-part of U.S. patent application Ser. No. 13/841,076, filed Mar. 15, 2013, which application is a continuation-in-part of U.S. patent application Ser. No. 13/412,782, filed Mar. 6, 2012, which applications are hereby incorporated by reference in their entireties.

FIELD

The invention relates generally to a protective helmet, and, more particularly, to a protective helmet having an energy storage mechanism which absorbs linear and rotational forces and slowly releases such forces.

BACKGROUND

The human brain is an exceedingly delicate structure protected by a series of envelopes to protect it from injury. The innermost layer, the pia mater, covers the surface of the brain. The arachnoid layer, adjacent to the pia mater, is a spidery web-like membrane that acts like a waterproof membrane. Finally, the dura mater, a tough leather-like layer, covers the arachnoid layer and adheres to the bones of the skull.

While this structure protects against penetrating trauma, the softer inner layers absorb only a small amount of energy before linear forces applied to the head are transmitted to the brain. When an object strikes a human head, both the object and the human head are moving independently and often in different angles thus, angular forces, as well as linear forces, are almost always involved in head injuries. Many surgeons in the field believe the angular or rotational forces applied to the brain are more hazardous than direct linear forces due to the twisting or shear forces they apply to the white matter tracts and the brain stem.

One type of brain injury that occurs frequently is the mild traumatic brain injury (MTBI), more commonly known as a concussion. Such injury occurs in many settings, such as, construction worksites, manufacturing sites, and athletic endeavors and is particularly problematic in contact sports. While at one time a concussion was viewed as a trivial and reversible brain injury, it has become apparent that repetitive concussions, even without loss of consciousness, are serious deleterious events that contribute to debilitating irreversible diseases, such as dementia and neuro-degenerative diseases including Parkinson's disease, chronic traumatic encephalopathy (CTE), and dementia pugilistica.

U.S. Pat. No. 5,815,846 (Calonge) describes a helmet with fluid filled chambers that dissipate force by squeezing fluid into adjacent equalization pockets when external force is applied. In such a scenario, energy is dissipated only through viscous friction as fluid is restrictively transferred from one pocket to another. Energy dissipation in this scenario is inversely proportional to the size of the hole between the full pocket and the empty pocket. That is to say, the smaller the hole, the greater the energy drop. The problem with this design is that, as the size of the hole is decreased and the energy dissipation increases, the time to dissipate the energy also increases. Because fluid filled chambers react hydraulically, energy transfer is in essence instantaneous. Hence, in the Calonge design, substantial energy is transferred to the brain before viscous fluid can be displaced negating a large portion of the protective function provided by the fluid filled chambers. Viscous friction is too slow an energy dissipating modification to adequately mitigate concussive force. If one were to displace water from a squeeze bottle one can get an idea as to the function of time and force required to displace any fluid when the size of the exit hole is varied. The smaller the transit hole, the greater the force required and the longer the time required for any given force to displace fluid.

U.S. Pat. No. 3,872,511 (Nichols) describes a helmet with hard inner and outer shells with an intermediate zone between the two shells. The zone contains a plurality of fluid-filled bladders that are held to the inner surface of the outer shell by means of a valve. When an impact occurs the outer shell is forced into the zone, squeezing the bladders. The valve closes upon impact causing the air to be retained in the bladders to cushion the impact from the user's head. However, because the movement of the bladders is restricted at impact, the force of the impact, although reduced is still directed into the head. In addition, the Nichols patent makes no provision for mitigation of rotational forces striking the helmet.

U.S. Pat. No. 6,658,671 (Hoist) describes a helmet with inner and outer shells and a sliding layer. The sliding layer allows for the displacement of the outer shell relative to the inner shell to help dissipate some of the angular force during a collision applied to the helmet. However, the force dissipation is confined to the outer shell of the helmet. In addition, the Holst helmet provides no mechanism for returning the two shells to the resting position relative to each other. A similar shortcoming is shown in the helmets described in U.S. Pat. No. 5,956,777 (Popovich) and European patent publication EP 0048442 (Kalman et al.).

German Patent DE 19544375 (Zhan) describes a construction helmet that includes apertures in the hard outer shell that allows the expansion of cushion material through the apertures to dispel some of the force of a collision. However, because the inner liner rests against a user's head, some force is directed toward rather than away from the head.

U.S. Patent Application Publication No. 2012/0198604 (Weber et al.) describes a safety helmet for protecting the human head against repetitive impacts as well as moderate and severe impacts to reduce the likelihood of brain injury caused by both translational and rotational forces. The helmet includes isolation dampers that act to separate an outer liner from an inner liner. Gaps are provided between the ends of the outer liner and the inner liner to provide space to enable the outer liner to move without contacting the inner liner upon impact.

Clearly, to prevent traumatic brain injury, not only must penetrating objects be stopped, but any force, angular or linear, imparted to the exterior of the helmet must also be prevented from simply being transmitted to the enclosed skull and brain. The helmet must not merely play a passive role in dampening such external forces, but must play an active role in dissipating both linear and angular momentum imparted such that they have little or no deleterious effect on the delicate brain.

To afford maximum protection from linear and angular forces, the outer shell of a helmet mitigating such force must be capable of movement independent from the inner shell of the helmet which covers and encloses the skull and brain, such that any force vector or vectors can be allayed prior to the force getting to the brain.

To attain these objectives in a helmet design, the inner component (shell) and the outer component (shell or shells) must be capable of appreciable degrees of movement independent of each other. Additionally, the momentum imparted to the outer shell should both be directed away from and/or around the underlying inner shell and brain and sufficiently dissipated or stored so as to negate deleterious effects.

Thus, there is a long-felt need for a protective helmet having an energy storage mechanism that absorbs linear and rotational forces and slowly releases such forces.

SUMMARY

According to aspects illustrated herein, there is provided a protective helmet having multiple protective zones, comprising an inner shell having a first inner surface and a first outer surface, a padded inner lining attached to the first inner surface, an outer shell having a second inner surface and a second outer surface, the outer shell functionally attached to the inner shell, an elastomeric zone between the first outer surface and the second inner surface, a plurality of energy dissipation devices arranged between the inner and outer shells, and a plurality of sinusoidal springs positioned in the elastomeric zone, each of the plurality of sinusoidal springs comprising a first end, and a second end connected to one of the plurality of energy dissipation devices.

According to aspects illustrated herein, there is provided a protective helmet having multiple protective zones, comprising an inner shell having a first inner surface and a first outer surface, a padded inner lining attached to the first inner surface, an outer shell having a second inner surface and a second outer surface, the outer shell functionally attached to the inner shell, an elastomeric zone between the first outer surface and the second inner surface, a plurality of sinusoidal springs positioned in the elastomeric zone, each of the plurality of sinusoidal springs comprising a first end and a second end, and a plurality of locking devices arranged between the inner and outer shells, wherein each of the plurality of locking devices comprises a first portion comprising a first plurality of teeth, the first portion connected to the second end, a second portion comprising a second plurality of teeth, the second portion arranged on the first outer surface, wherein the first plurality of teeth are arranged to engage the second plurality of teeth, and a release device connected to the first portion, the release device is operatively arranged to release the locking device.

According to aspects illustrated herein, there is provided a protective helmet having multiple protective zones, comprising an inner shell having a first inner surface and a first outer surface, a padded inner lining attached to the first inner surface, an outer shell having a second inner surface and a second outer surface, the outer shell functionally attached to the inner shell, an elastomeric zone between the first outer surface and the second inner surface, a plurality of sinusoidal springs positioned in the elastomeric zone, each of the plurality of sinusoidal springs comprising a first end and a second end, and a plurality of piston devices arranged between the inner and outer shells, wherein each of the plurality of piston devices comprises a first component connected to the second end and a second component.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF EMBODIMENTS

Figure 1:
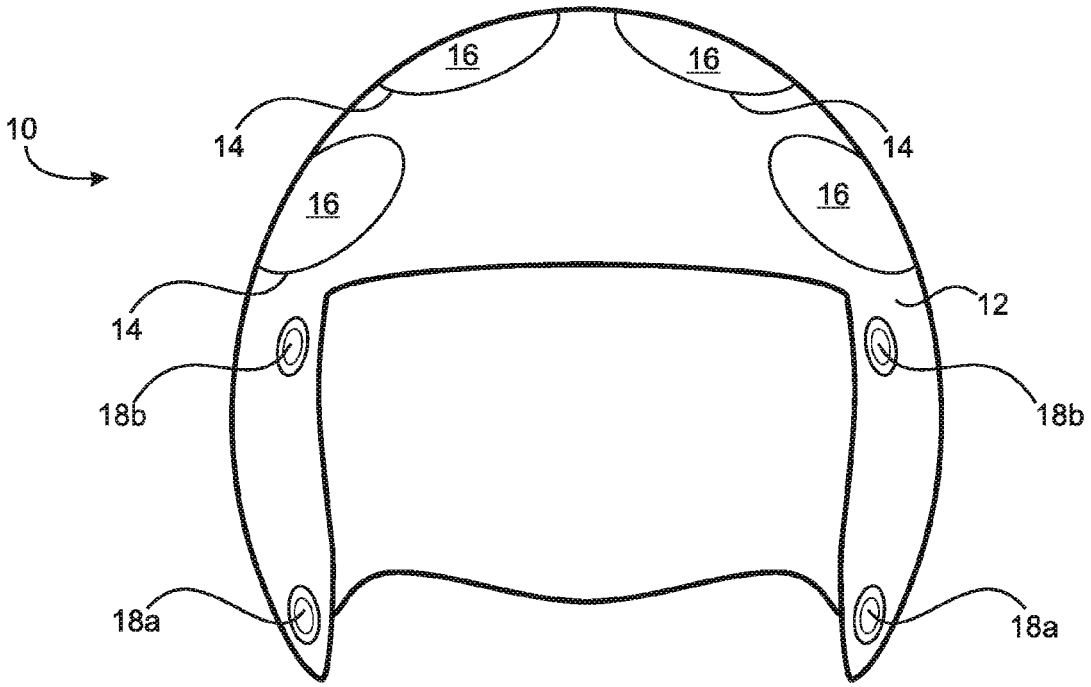
FIG. 1 is a front view of the double shell helmet ("helmet")

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

In one embodiment, the inner shell and outer shell are connected to each other by elastomeric cords that serve to limit the rotation of the outer shell on the inner shell and to dissipate energy by virtue of elastic deformation rather than passively transferring rotational force to the brain as with existing helmets. In effect, these elastomeric cords function like mini bungee cords that dissipate both angular and linear forces through a mechanism known as hysteretic damping, i.e., when elastomeric cords are deformed, internal friction causes high energy losses to occur. These elastomeric cords are of particular value in preventing so called contrecoup brain injury.

The outer shell, in turn, floats on the inner shell by virtue of one or more force absorbers or deflectors such as, for example, fluid-filled bladders, leaf springs, or sinusoidal springs, located between the inner shell and the outer shell. To maximize the instantaneous reduction or dissipation of a linear and/or angular force applied to the outer shell, the fluid-filled bladders interposed between the hard inner and outer shells may be intimately associated with, that is located under, one or more apertures in the outer shell with the apertures preferably being covered with elastomeric diaphragms and serving to dissipate energy by bulging outward against the elastomeric diaphragm whenever the outer shell is accelerated, by any force vector, toward the inner shell. Alternatively, the diaphragms could be located internally between inner and outer shells, or at the inferior border of the inner and outer shells, if it is imperative to preserve surface continuity in the outer shell. This iteration would necessitate separation between adjacent bladders to allow adequate movement of associated diaphragms.

In existing fluid-filled designs, when the outer shell of a helmet receives a linear force that accelerates it toward the inner shell, the interposed gas or fluid is compressed and displaced. Because gas and especially fluid is not readily compressible, it passes the force passively to the inner shell and hence to the skull and the brain. This is indeed the very mechanism by which existing fluid-filled helmets fail. The transfer of force is hydraulic and essentially instantaneous, negating the effectiveness of viscous fluid transfers as a means of dissipating concussive force.

Because of the elastomeric diaphragms in the present invention, any force imparted to the outer shell will transfer to the gas or liquid in the bladders, which, in turn, will instantaneously transfer the force to the external elastomeric diaphragms covering the apertures in the outer shell. The elastomeric diaphragms, in turn, will bulge out through the aperture in the outer shell, or at the inferior junction between inner and outer shells thereby dissipating the applied force through elastic deformation at the site of the diaphragm rather than passively transferring it to the padded lining of the inner shell. This process directs energy away from the brain and dissipates it via a combination of elastic deformation and tympanic resonance or oscillation. By oscillating, an elastic diaphragm employs the principle of hysteretic damping over and over, thereby maximizing the conversion of kinetic energy to low-level heat, which, in turn, is dissipated harmlessly to the surrounding air.

Furthermore, the elastomeric springs or cords that bridge the space holding the fluid-filled bladders (like the arachnoid membrane in the brain) serve to stabilize the spatial relationship of the inner and outer shells and provide additional dissipation of concussive force via the same principle of elastic deformation via the mechanism of stretching, torsion, and even compression of the elastic cords.

By combining the bridging effects of the elastic springs or cords as well as the elastomeric diaphragms strategically placed at external apertures, both linear and rotational forces can be effectively dissipated.

In an alternate embodiment, leaf springs may replace fluid-filled bladders as a force absorber/deflector. Leaf springs may be structured as a fully elliptical spring or, preferably, formed in a parabolic shape. In both forms, the leaf spring is anchored at a single point to either the outer shell or, preferably, the hard inner shell and extends into the zone between the outer shell and inner shell. The springs may have a single leaf (or arm) or comprise a plurality of arms arrayed radially around a common anchor point. Preferably, each arm tapers from a thicker center to thinner outer portions toward each end of the arm. Further, the ends of each arm may include a curve to allow the end to more easily slide on the shell opposite the anchoring shell. In contrast to the use of leaf springs in vehicles, the distal end of the spring arms are not attached to the nonanchoring or opposite shell. This allows the ends to slide on the shell to allow independent movement of each shell when the helmet is struck by rotational forces. This also enables the frictional dissipation of energy. Preferably, the distal ends contact the opposite shell in the neutral condition, that is, when the helmet is not in the process of being struck.

Figure 2:
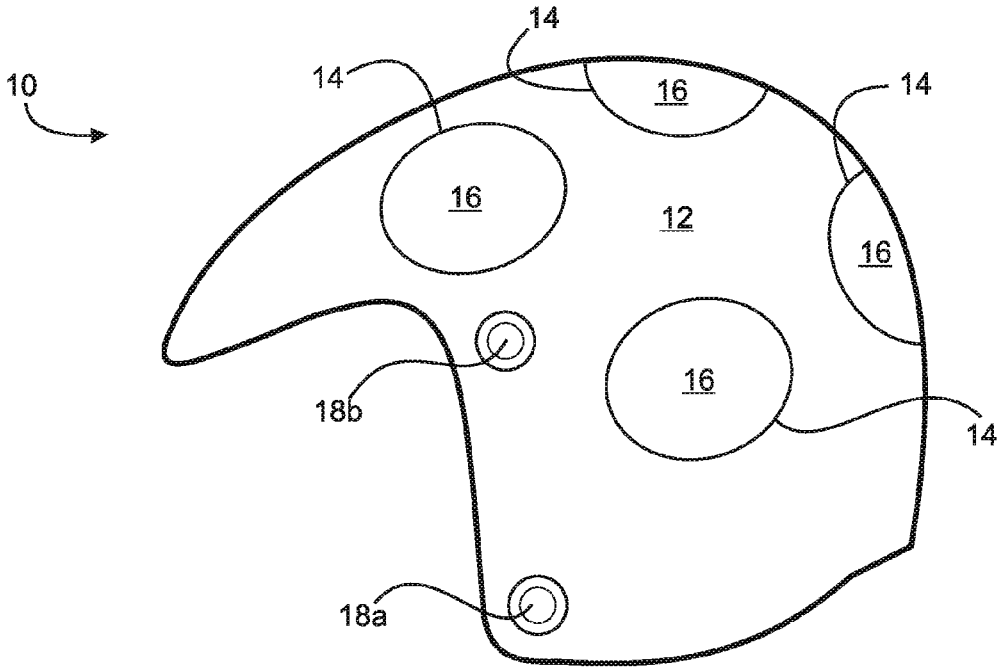
FIG. 2 is a side view of the helmet of FIG. 1 showing two face protection device attachments on one side of the helmet.

Adverting to the drawings, FIG. 1 is a front view of multiple protective zone helmet 10 ("helmet 10"). The outer protective zone is formed by outer shell 12 and is preferably manufactured from rigid, impact resistant materials such as metals, plastics, polycarbonates, ceramics, composites, and similar materials well known to those having skill in the art. Outer shell 12 defines at least one and preferably a plurality of apertures 14 (or aperture 14). Apertures 14 may be open but are preferably covered by a flexible elastomeric material in the form of diaphragms 16 (or diaphragm 16). In a preferred embodiment, helmet 10 also includes several face protection device attachments. FIG. 1 shows face protection device attachments 18*a* and 18*b*; however, helmet 10 can have any suitable number of face protection device attachments. In a more preferred embodiment, face protection device attachments are fabricated from a flexible elastomeric material to provide flexibility to the attachment. The elastomeric material reduces the rotational pull on helmet 10 if the attached face protection device (not shown in FIG. 1) is pulled. By "elastomeric" it is meant any of various substances resembling rubber in properties, such as resilience and flexibility. Such elastomeric materials are well known to those having skill in the art. FIG. 2 is a side view of helmet 10 showing two face protection device attachments 18*a* and 18*b* on one side of the helmet. Examples of face protection devices are visors and face masks. Such attachments can also be used for chin straps releasably attached to the helmet in a known manner.

Figure 3A:
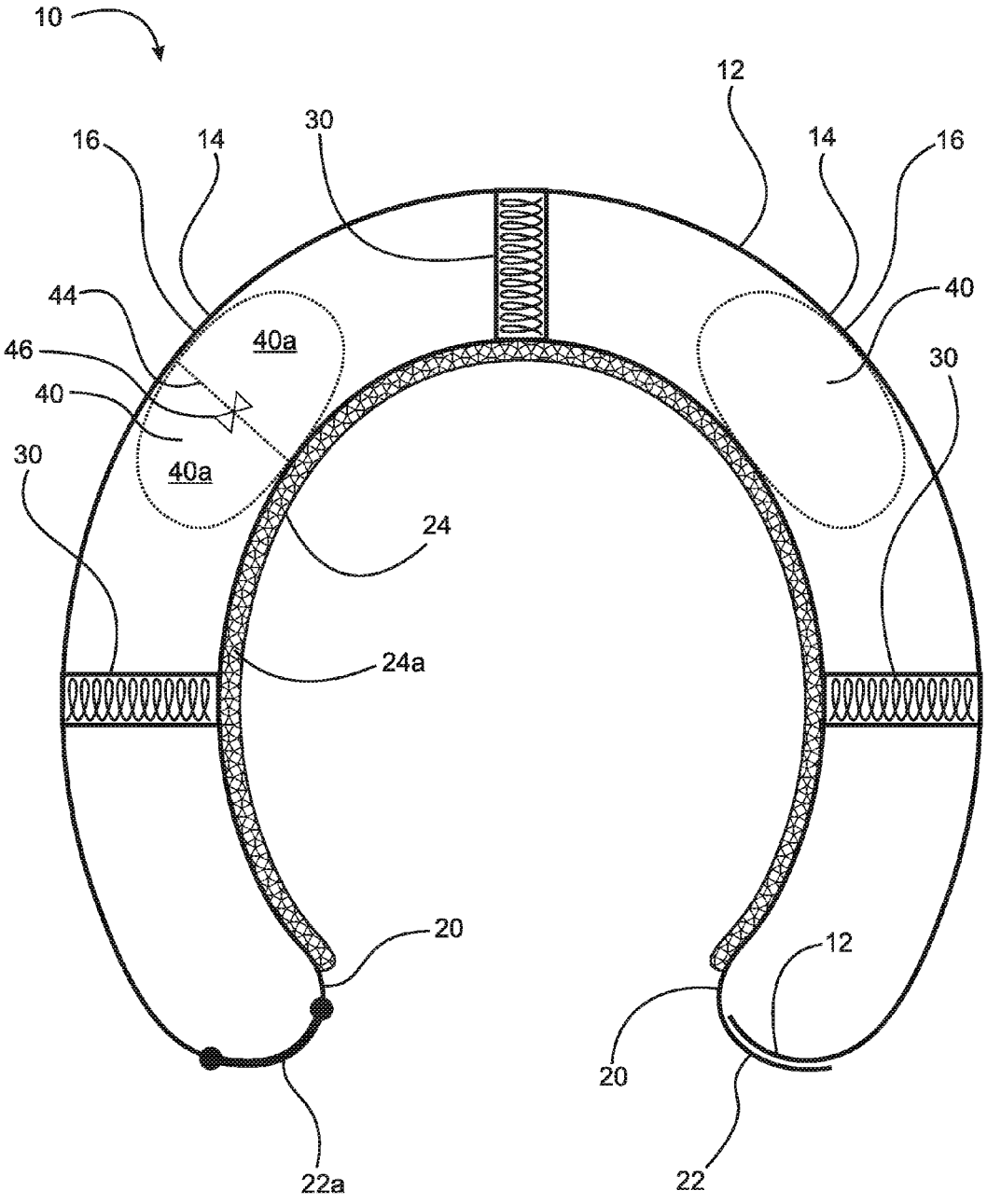
FIG. 3A is a cross-sectional view of the helmet of FIG. 1 showing an inner shell and elastomeric cords connecting the two shells.

FIG. 3A is a cross-sectional view of helmet 10 showing the hard inner shell 20 and the elastomeric springs or cords 30 (or cords 30) that extend through an elastomeric zone connecting the two shells. Inner shell 20 forms an anchor zone and is preferably manufactured from rigid, impact resistant materials such as metals, plastics such as polycarbonates, ceramics, composites, and similar materials well known to those having skill in the art. Inner shell 20 and outer shell 12 are slidingly connected at sliding connection 22. By "slidingly connected" it is meant that the edges of inner shell 20 and outer shell 12, respectively, slide against or over each other at connection 22. In an alternate embodiment, outer shell 12 and inner shell 20 are connected by an elastomeric element, for example, a u-shaped elastomeric connector 22*a* ("connector 22*a*"). Sliding connection 22 and connector 22*a* each serve to both dissipate energy and maintain the spatial relationship between outer shell 12 and inner shell 20.

Cords 30 are flexible cords, such as bungee cords or elastic "hold down" cords, or their equivalents, used, for example, to hold articles on car or bike carriers. This flexibility allows outer shell 12 to move or "float" relative to inner shell 20 while remaining connected to inner shell 20. This floating capability is also enabled by the sliding connection 22 between outer shell 12 and inner shell 20. In an alternate embodiment, sliding connection 22 may also include elastomeric connection 22*a* between outer shell 12 and inner shell 20. Padding 24 forms an inner zone and lines the inner surface of inner shell 20 to provide a comfortable material to support helmet 10 on the user's head. In one embodiment, padding 24 may enclose loose cushioning pieces 24*a* such as STYROFOAM® beads or "peanuts," or loose oatmeal.

Also shown in FIG. 3A is a cross-sectional view of bladders 40 (or bladder 40) situated in the elastomeric zone between outer shell 12 and inner shell 20. Helmet 10 includes at least one, but preferably a plurality of bladders 40. Bladders 40 are filled with fluid, either a liquid such as water, or a gas such as helium or air. In one preferred embodiment, the fluid is helium as it is light and its use would reduce the total weight of helmet 10. In an alternate embodiment, bladders 40 may also include compressible beads or pieces such as STYROFOAM® beads. Bladders 40 are preferably located under apertures 14 of outer shell 12 and are in contact with both inner shell 20 and outer shell 12. Thus, when outer shell 12 is pressed in toward inner shell 20 (and thus the user's skull) during a collision, bladder 40 is squeezed and the fluid therein is compressed, similar to squeezing a balloon. Bladder 40 will bulge toward aperture 14 and displace elastomeric diaphragm 16. This bulging-displacement action diverts the force of the blow from radially inward (i.e., toward the user's skull and brain) to radially outward (i.e., up toward the apertures) providing a new direction for the force vector. Bladders 40 may also be divided internally into compartments 40*a* by bladder wall 44 such that, if the integrity of one of compartments 40*a* is breached, another compartment will still function to dissipate linear and rotational forces. Bladders 40 may additionally comprise valve(s) 46 arranged between compartments 40*a* to control the fluid movement. In the example embodiment shown in FIG. 3A, bladders 40 include two compartments. It should be appreciated, however, that any number of compartments suitable to control the fluid movement can be used.

Figure 3B:
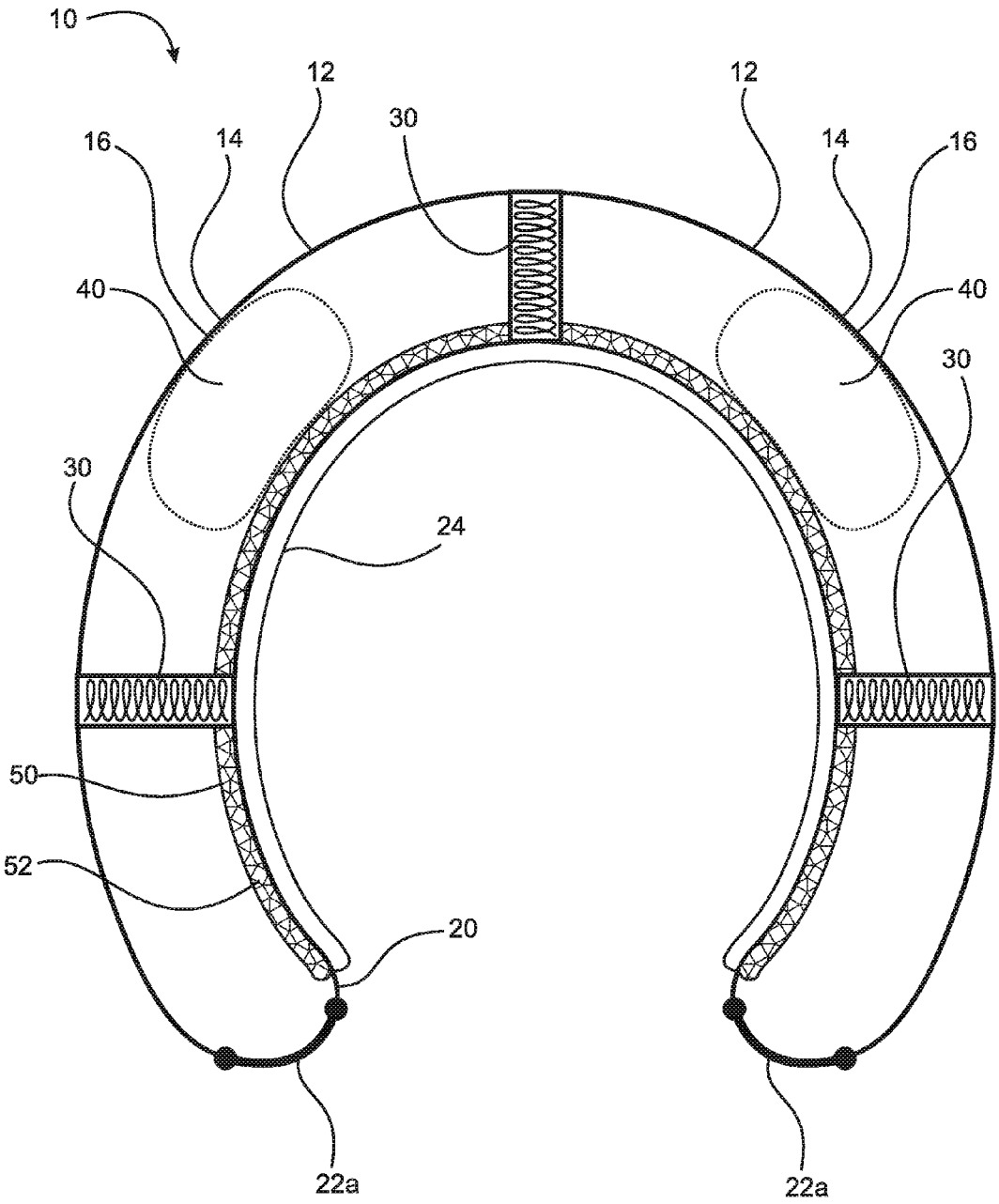
FIG. 3B is a cross-sectional view similar to FIG. 3 depicting an alternate embodiment of the helmet including an intermediate shell enclosing cushioning pieces.

FIG. 3B is a cross-sectional view, similar to FIG. 3A discussed above, depicting an alternate embodiment of helmet 10. Helmet 10 shown in FIG. 3B includes crumple zone or intermediate shell 50 located between outer shell 12 and inner shell 20. In the embodiment shown, intermediate shell 50 is close, or adjacent, to inner shell 20. Intermediate shell 50 encloses filler 52. Preferably, filler 52 is a compressible material that is packed to deflect the energy of a blow and protect the skull, similar to a "crumple zone" in an automobile. Filler 52 is designed to crumple or deform, thereby absorbing the force of the collision before it reaches inner pad 24 and the braincase. In this embodiment, cords 30 extend from inner shell 20 to outer shell 12 through intermediate shell 50. One suitable material for filler 52 is STYROFOAM® beads or "peanuts," or an equivalent material such as materials used for packing objects. Because of its "crumpling" function, intermediate shell 50 is preferably constructed with a softer or more deformable material than outer shell 12 and/or inner shell 20. Typical fabrication material for intermediate shell 50 is a stretchable material such as latex or spandex or other similar elastomeric fabric that preferably encloses filler 52.

Figure 3C:
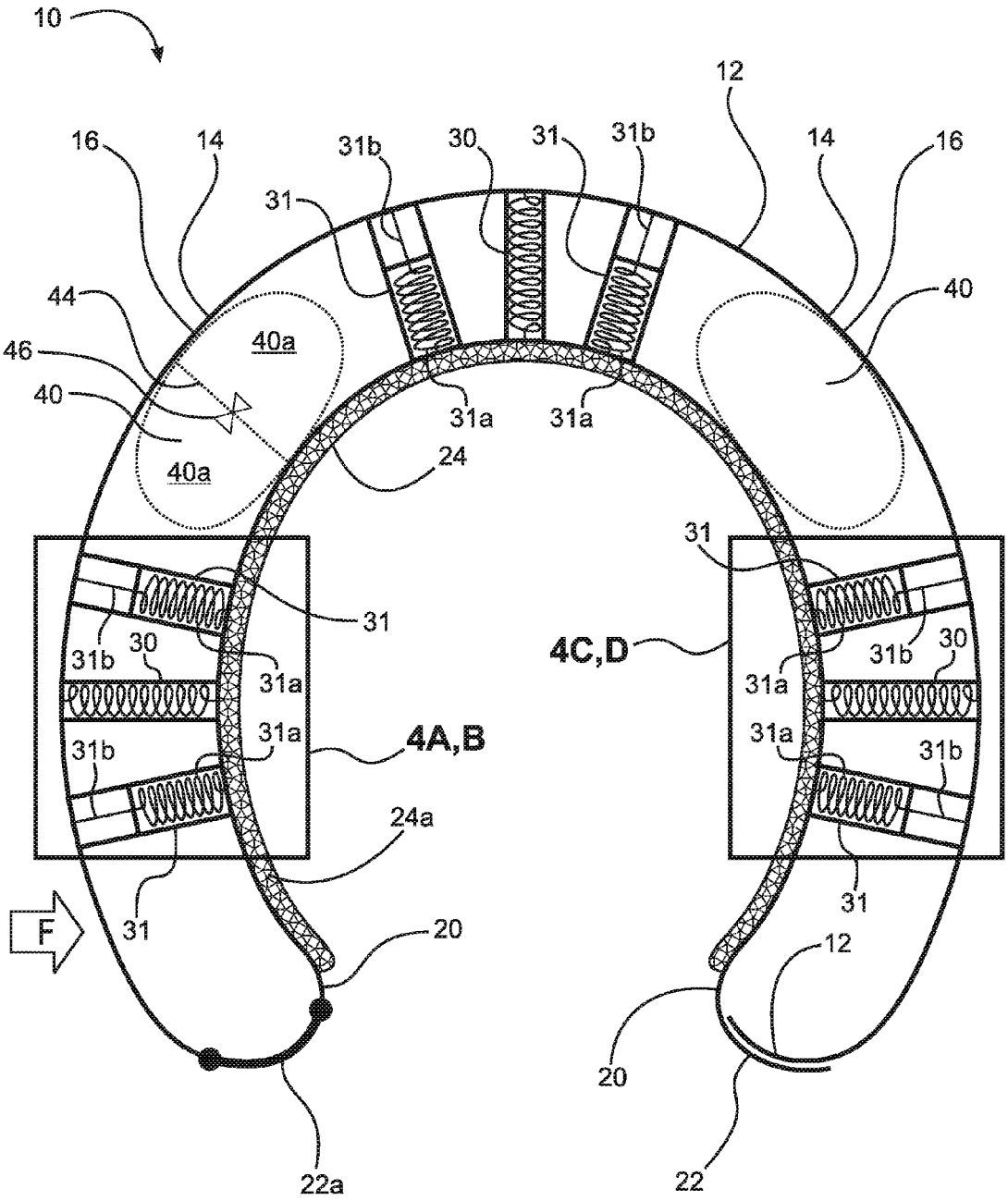
FIG. 3C is a cross-sectional view similar to FIG. 3A depicting an alternate embodiment of the elastomeric cords in which some of the elastomeric cords have thin and thick portions.

FIG. 3C is a cross-sectional view similar to FIG. 3A depicting an alternate embodiment of helmet 10 comprising elastomeric cords 30 and 31. Elastomeric cords 31 (or cord 31) include thick elastomeric portions 31*a* and thin nonelastomeric portions 31*b*. In the embodiment shown, thick elastomeric portions 31*a* are connected to the outer surface of inner shell 20, but alternatively may be connected to the inner surface of outer shell 12. Thin nonelastomeric portions 31*b* of cords 31 are connected to the inner surface of outer shell 12, but alternatively may be attached to the outer surface of inner shell 20. Thin nonelastomeric portions 31*b* may comprise a single cord or multiple cords. In this exemplary embodiment, thick elastomeric portions 31*a* of cords 31 are thicker than uniform elastomeric cords 30. For example, the diameter of elastomeric portions 31*a* is greater than the diameter of cords 30. It should be appreciated, however, that elastomeric portions 31*a* and cords 30 may have any suitable diameter that allows cords 31 to act as a backup to prevent cords 30 from being stretched beyond their elastic limit. Also shown in FIG. 3C is force F located to the left of helmet 10. Force F is directed radially inward relative to helmet 10 and represents a blow to outer shell 12 as will be discussed with respect to FIGS. 4A-D.

Figure 4A:
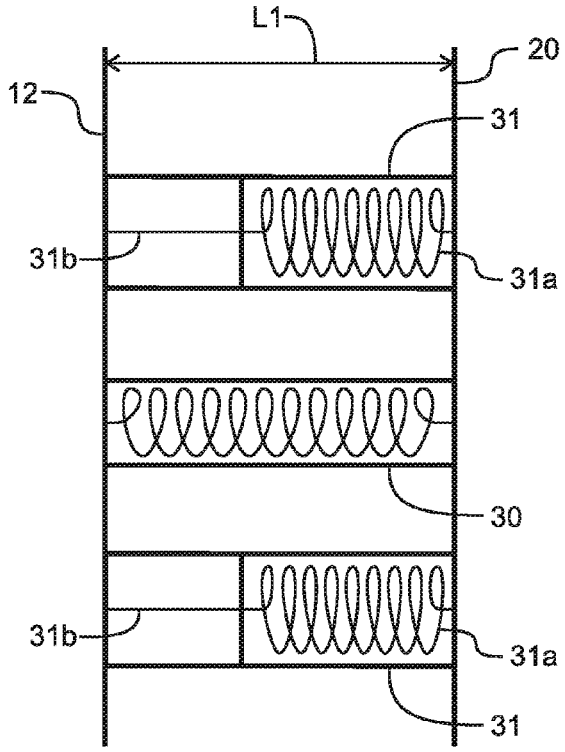
FIG. 4A is an enlarged schematic view of the cords shown in FIG. 3C in a neutral position.
Figure 4B:
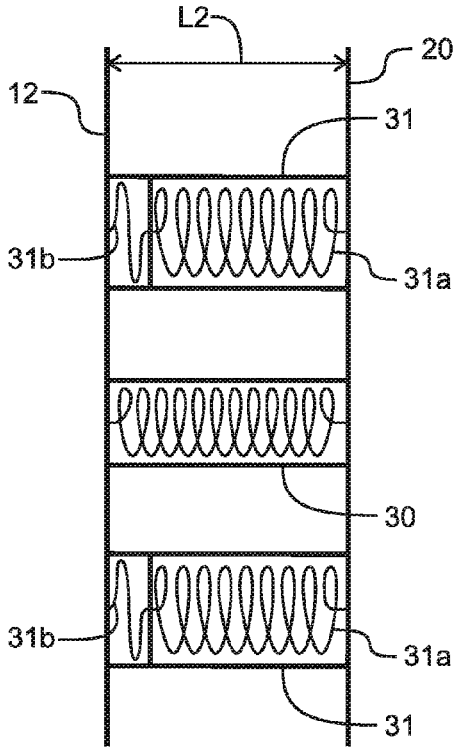
FIG. 4B is an enlarged schematic view of the cords shown in FIG. 3C in compression.
Figure 4C:
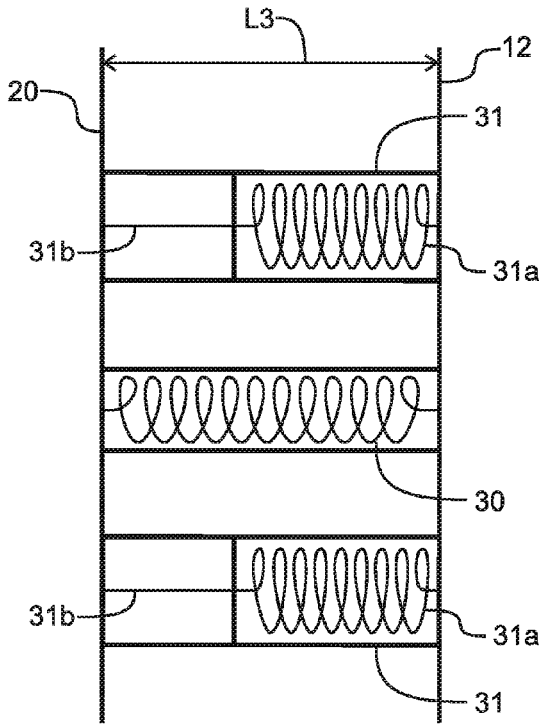
FIG. 4C is an enlarged schematic view of the cords shown in FIG. 3C in a neutral position.
Figure 4D:
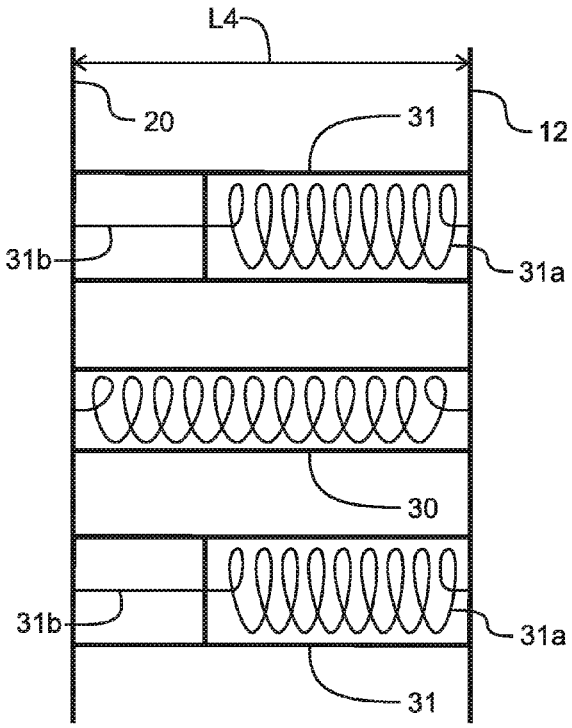
FIG. 4D is an enlarged schematic view of the cords shown in FIG. 3C in tension.

FIGS. 4A-D are enlarged schematic views of cords 30 and 31 as shown in FIG. 3C. FIGS. 4A and 4B are enlarged views of detail 4A,B in FIG. 3C. FIG. 4A shows cords 30, which have uniform thickness throughout their lengths, and cords 31 in the neutral position. In the neutral position, cords 30 are under slight tension while cords 31 are under no tension. In the neutral position, the distance between inner shell 20 and outer shell 12 and thus the length of cords 30 and 31 is length L1. FIG. 4B shows cords 30 and 31 as shown in FIG. 4A, but under maximum compression as a result of force F impacting helmet 10 (as directed in FIG. 3C). When force F, a greater than normal force, is applied, outer shell 12 displaces radially inward relative to inner shell 20 (i.e., the radially distance between inner shell 20 and outer shell 12 decreases). In this case, significant compression occurs in elastomeric cord 30; however, only nominal compression occurs in cord 31. As shown, nonelastomeric portions 31*b* loosens and elastomeric portions 31*a* exhibits only nominal or no compression. In the compressed state, the distance between inner shell 20 and outer shell 12 and thus the length of cords 30 and 31 is length L2, which is less than length L1. FIGS. 4C and 4D are enlarged views of detail 4C,D in FIG. 3C. FIG. 4C shows cords 30, which have uniform thickness throughout their lengths, and cords 31 in the neutral position. In the neutral position, cords 30 are under slight tension while cords 31 are under no tension. In the neutral position, the distance between inner shell 20 and outer shell 12 and thus the length of cords 30 and 31 is length L3, which is substantially equal to L1. FIG. 4D shows cords 30 and 31 as shown in FIG. 4C, but under maximum tension as a result of force F impacting helmet 10 (as directed in FIG. 3C). When force F is applied, outer shell 12 displaces radially outward relative to inner shell 20 (i.e., the radial distance between inner shell 20 and outer shell 12 increases). In this case, significant expansion occurs in elastomeric cord 30, and moderate expansion occurs in cord 31. As shown, nonelastomeric portions 31*b* are tightly drawn and elastomeric portions 31*a* are moderately expanded. Under maximal displacement of outer shell 12 relative to inner shell 20, cords 30 may be stretched close or up to their elastic limit. However, when this occurs, nonelastomeric portion 31*b* of cord 31 engages elastomeric portion 31*a* to mitigate the large force striking helmet 10 and to prevent any loss of elasticity in cord 30. By using cord 31 as a backup for blows struck with severe force, greater protection can be achieved even after cord 30 reaches its elastic limit and does not interfere with absorbing any rotational forces striking helmet 10. For this reason, cords 31 preserve the integrity of the cord system of helmet 10. In the expanded state, the distance between inner shell 20 and outer shell 12 and thus the length of cords 30 and 31 is length L4, which is greater than length L1.

Figure 5A:
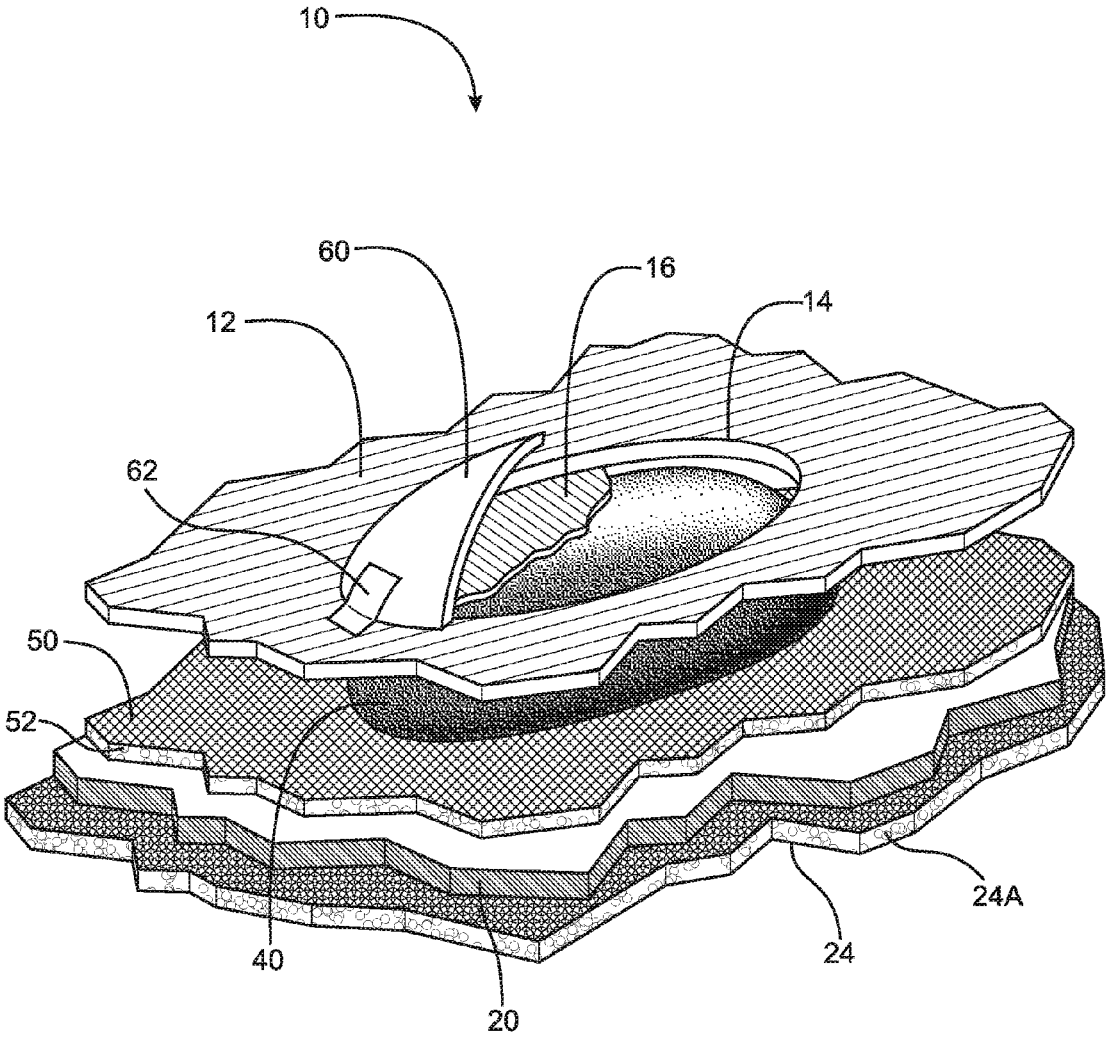
FIG. 5A is a top perspective view of a section of the outer shell of the helmet showing an alternate embodiment including a liftable lid that protect diaphragms covering apertures in the outer shell of the helmet.
Figure 5B:
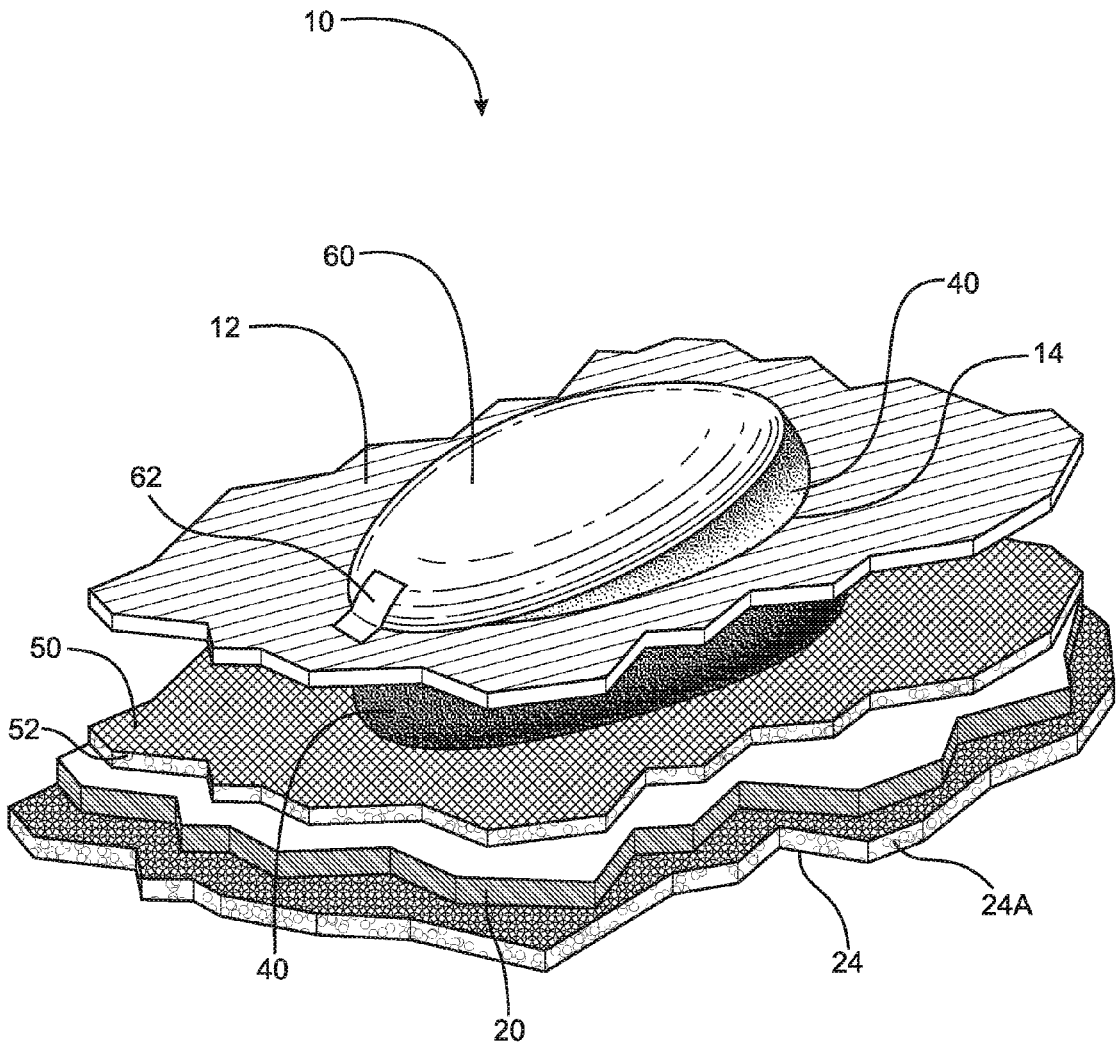
FIG. 5B is a top perspective view of a section of the outer shell of the helmet, as shown in FIG. 5A, depicting the liftable lid protecting the bulging fluid-filled bladder.

FIG. 5A is a top view of one section of outer shell 12 of helmet 10 showing an alternate embodiment in which liftable lids 60 (or lid 60) are used to cover aperture 14 to shield diaphragm 16 and/or bladder 40 from punctures, rips, or similar incidents that may destroy their integrity. Lids 60 are attached to outer shell 12 by lid connectors 62 (or connector 62). Lids 60 are operatively arranged to lift or raise up if a particular diaphragm 16 bulges outside of aperture 14 due to the expansion of one or more bladders 40. Because it is liftable, lid 60 allows diaphragm 16 to freely elastically bulge through aperture 14 above the surface of outer shell 12 (i.e., radially outward from outer shell 12) to absorb and redirect the force of a collision, and also protects diaphragm 16 from damage due to external forces. In an alternate embodiment, diaphragm 16 is not used and lid 60 directly shields and protects bladder 40. In an example embodiment, connectors 62 are hinges. In an example embodiment, connectors 62 are flexible plastic attachments. FIG. 5B depicts liftable lid 60 protecting bladder 40 as it bulges through aperture 14 and radially outward from outer shell 12.

Figure 6A:
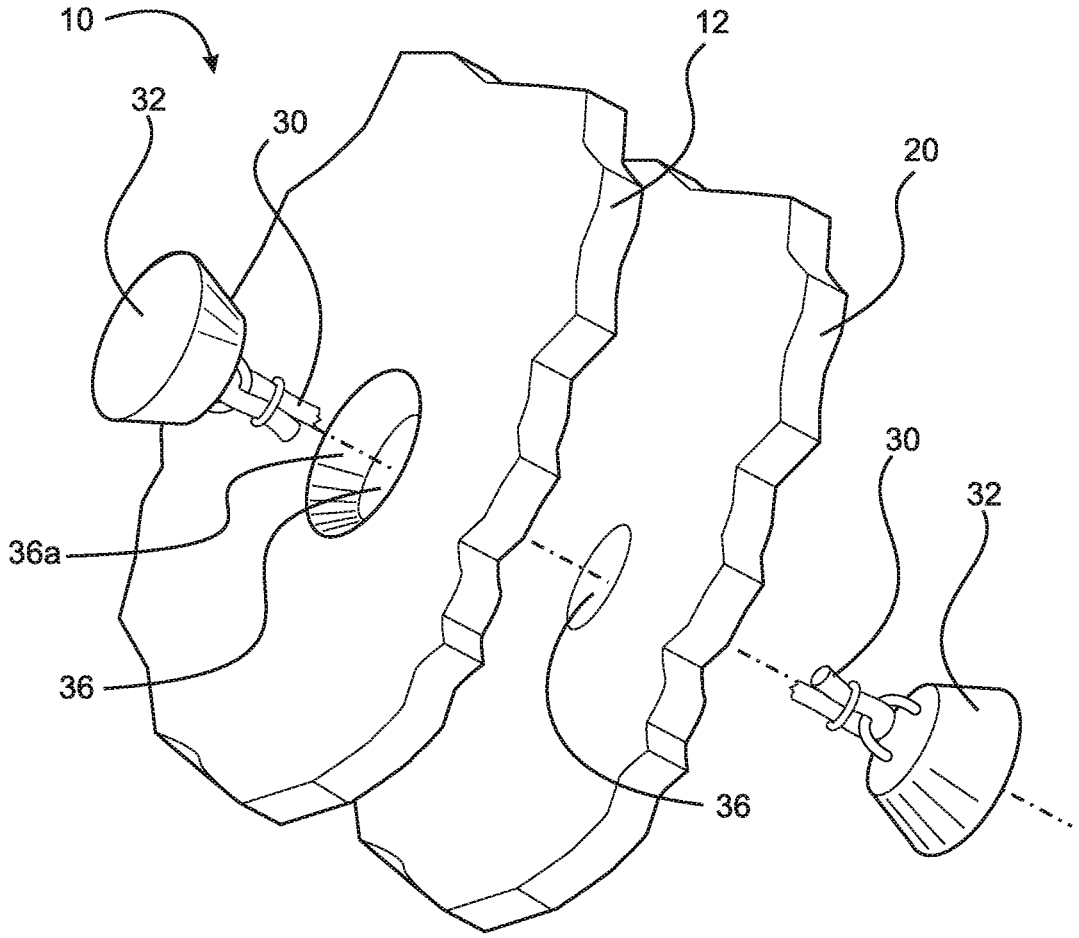
FIG. 6A is an exploded view showing the attachment of the cord to both the inner shell and outer shell to enable the outer shell to float around the inner shell.

FIG. 6A is an exploded view showing one method of attaching cord 30 to helmet 10, such that outer shell 12 floats over inner shell 20. Cavities 36 (or cavity 36), preferably comprising concave sides 36*a*, are drilled or otherwise arranged in outer shell 12 and inner shell 20 such that they are aligned. Each end of cord 30 is attached to plugs 32 which are arranged in the aligned cavities 36. In one embodiment, plugs 32 are secured in cavities 36 using a suitable adhesive known to those having ordinary skill in the art. In an alternate embodiment, plugs 32 are secured in cavities 36 with an interference fit (i.e., press fit or friction fit) or a snap fit.

Figure 6B:
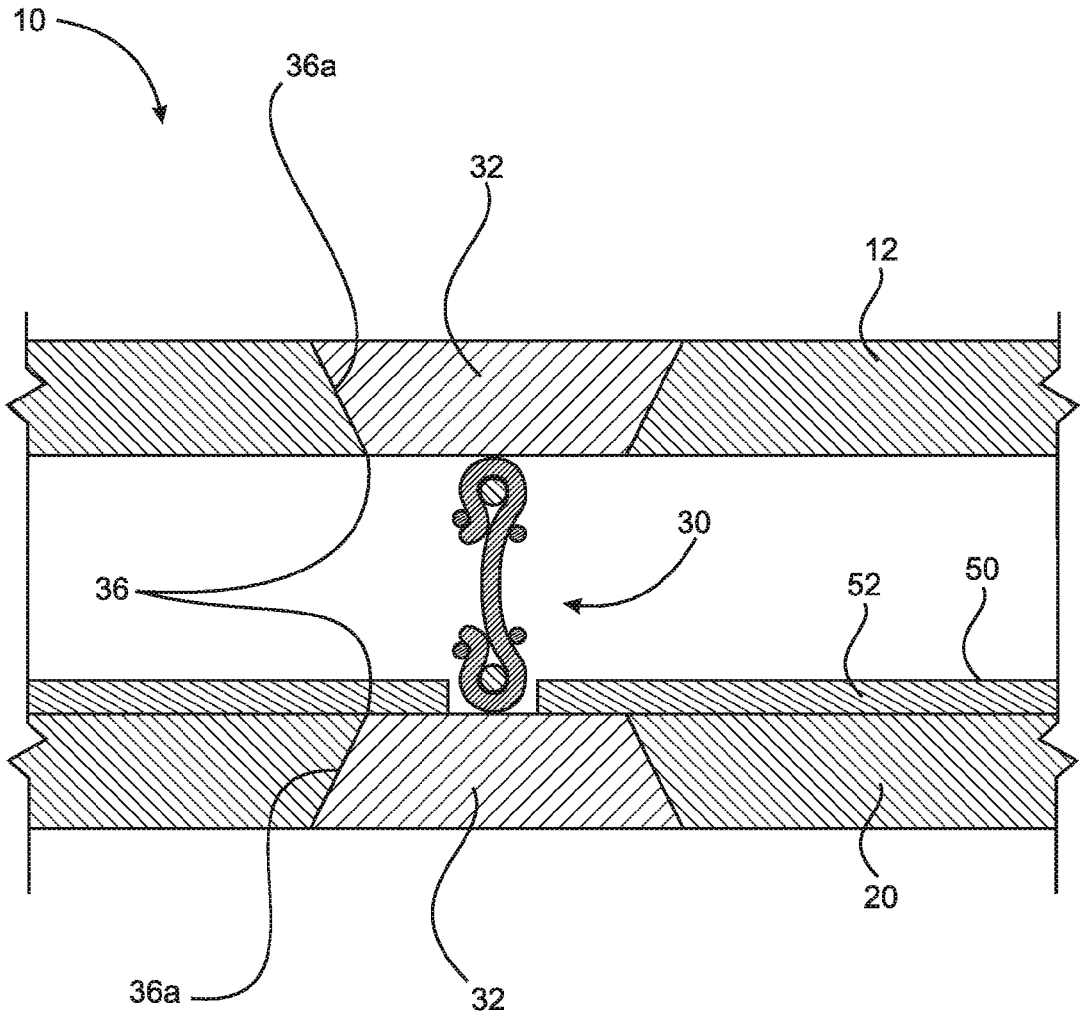
FIG. 6B is a cross-sectional view of the completed attachment fitting with the elastomeric cord attached to two plugs and extending between the outer shell and the inner shell of the helmet.

FIG. 6B is a cross-section of helmet 10 with plugs 32 secured in cavities 36. Cord 30 is attached to two plugs 32 at either end and extends between outer shell 12 and inner shell 20. Also shown is intermediate shell 50 enclosing filler 52. Not shown are bladders 40, which would be arranged between intermediate shell 50 and outer shell 12. Persons of ordinary skill in the art will recognize that cords 31 may be attached between outer shell 12 and inner shell 20 in a similar manner.

Figure 7:
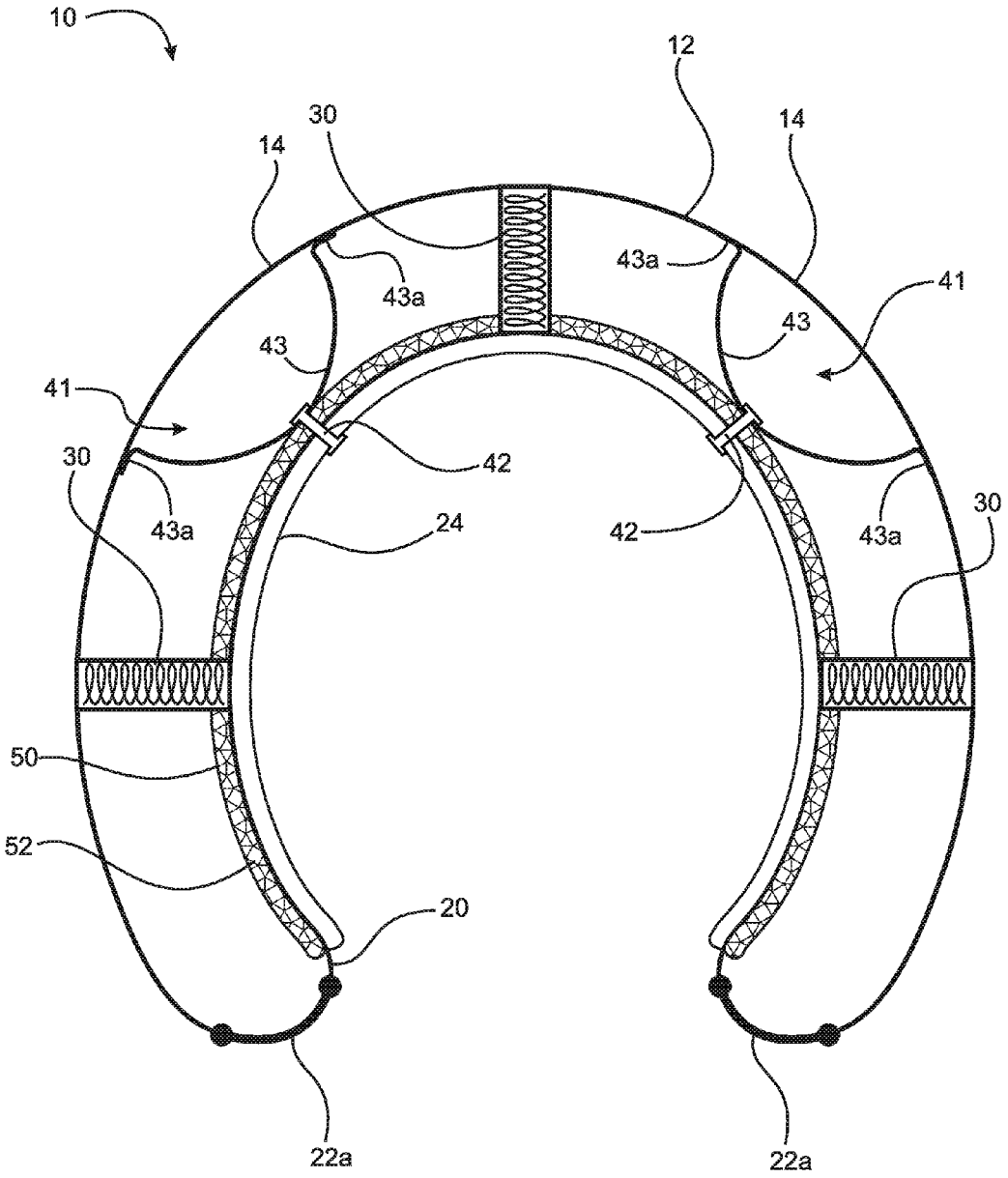
FIG. 7 is a cross-sectional view of an alternate embodiment of the helmet including parabolic leaf springs.
Figure 7A:
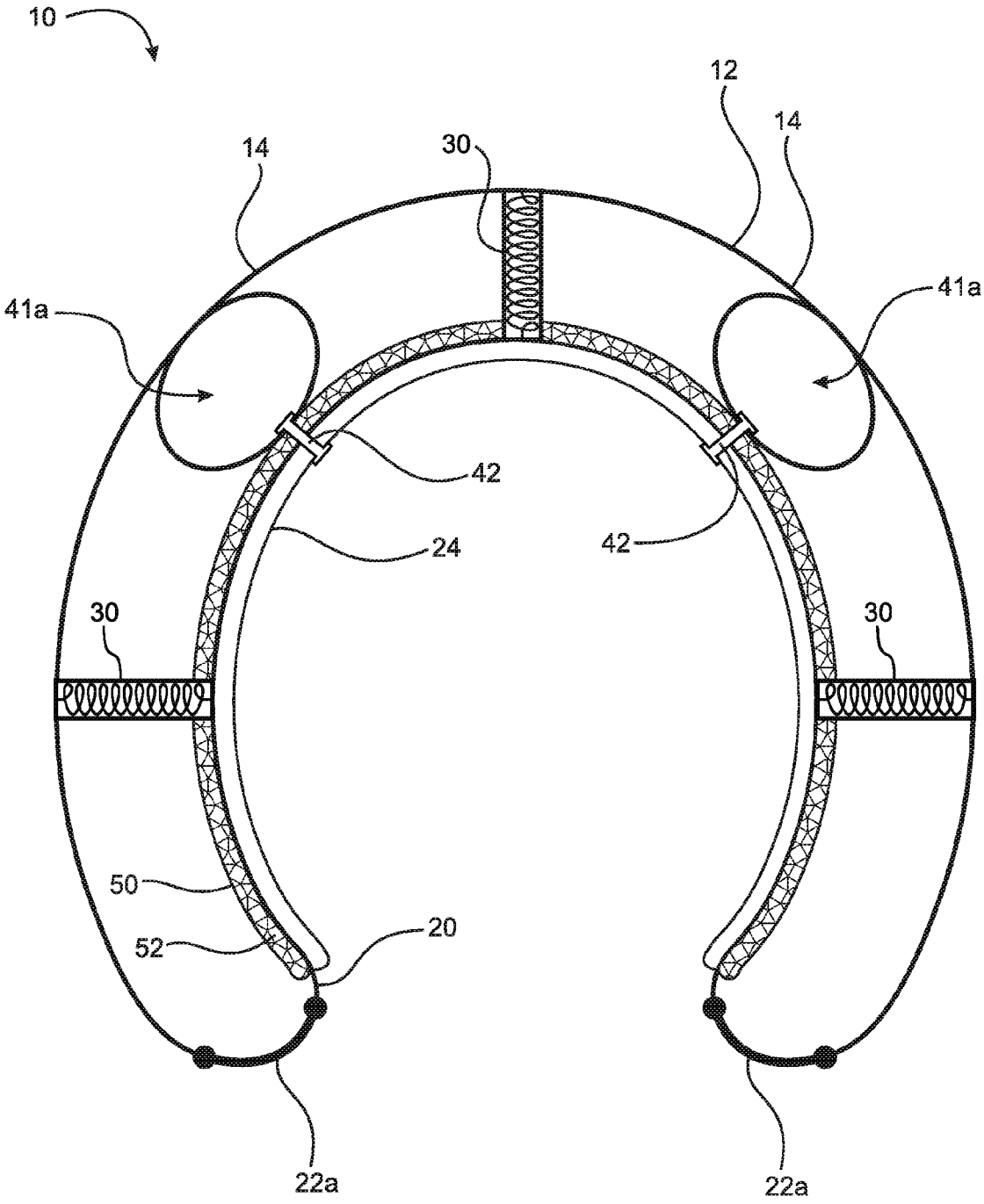
FIG. 7A is a cross-sectional view of an alternate embodiment of the helmet including elliptical leaf springs.

FIG. 7 is a cross-sectional view of an alternate embodiment of helmet 10 wherein bladders 40 are replaced with force absorbers/deflectors comprising parabolic leaf springs 41 (or springs 41). In the embodiment shown, springs 41 are fixedly secured to inner shell 20 at anchor points 42 (or anchor point 42). Each of springs 41 comprise at least one arm 43 (or arms 43) with two ends 43*a*, which are preferably curvedly shaped as shown. Arms 43 are preferably tapered having a thicker center portion near anchor point 42 and gradually thinning in width and/or thickness towards ends 43*a*. In addition, arms 43 may be laminated with gradually fewer applied elastic layers as distance from anchor point 42 increases. A plurality of arms 43 may be arrayed radially around, and attached to, a single anchor point 42. As shown in FIG. 7, arms 43 extend to crumple zone or intermediate shell 50, if present, and anchor points 42 extend through crumple zone 50. Leaf springs 41 may also be used in conjunction with elastomeric cords 30. FIG. 7A is an alternate embodiment comprising elliptical leaf springs 41*a* (or spring 41*a*) instead of parabolic leaf springs 41. Like springs 41, each of springs 41*a* is attached at single anchor points 42.

Figure 8:
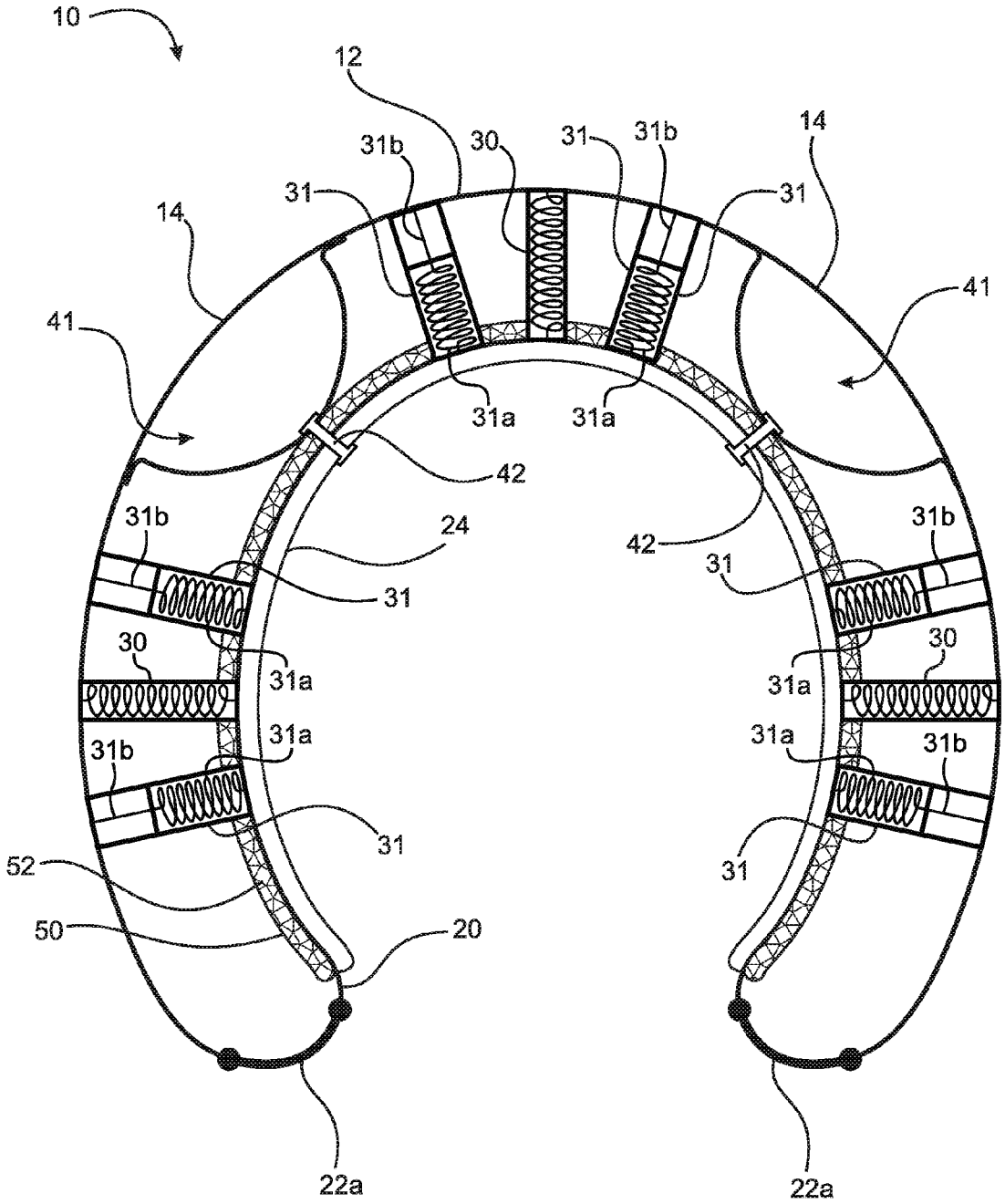
FIG. 8 is a cross-sectional view of the alternate embodiment of the protective helmet shown in FIG. 7 showing the leaf springs with elastomeric cords.

FIG. 8 is a cross-section of the embodiment of helmet 10 shown in FIG. 7, wherein leaf springs 41 are used in conjunction with both elastomeric cords 30 and cords 31. As described above, cords 31 act as a backup to prevent cords 30 from being stretched beyond their elastic limit. Elastomeric portions 31*a* of cords 31 comprise a diameter larger than the diameter of uniform elastomeric cords 30. As shown in FIG. 8, the thick portions may be attached to either outer shell 12 or inner shell 20.

Figure 9:
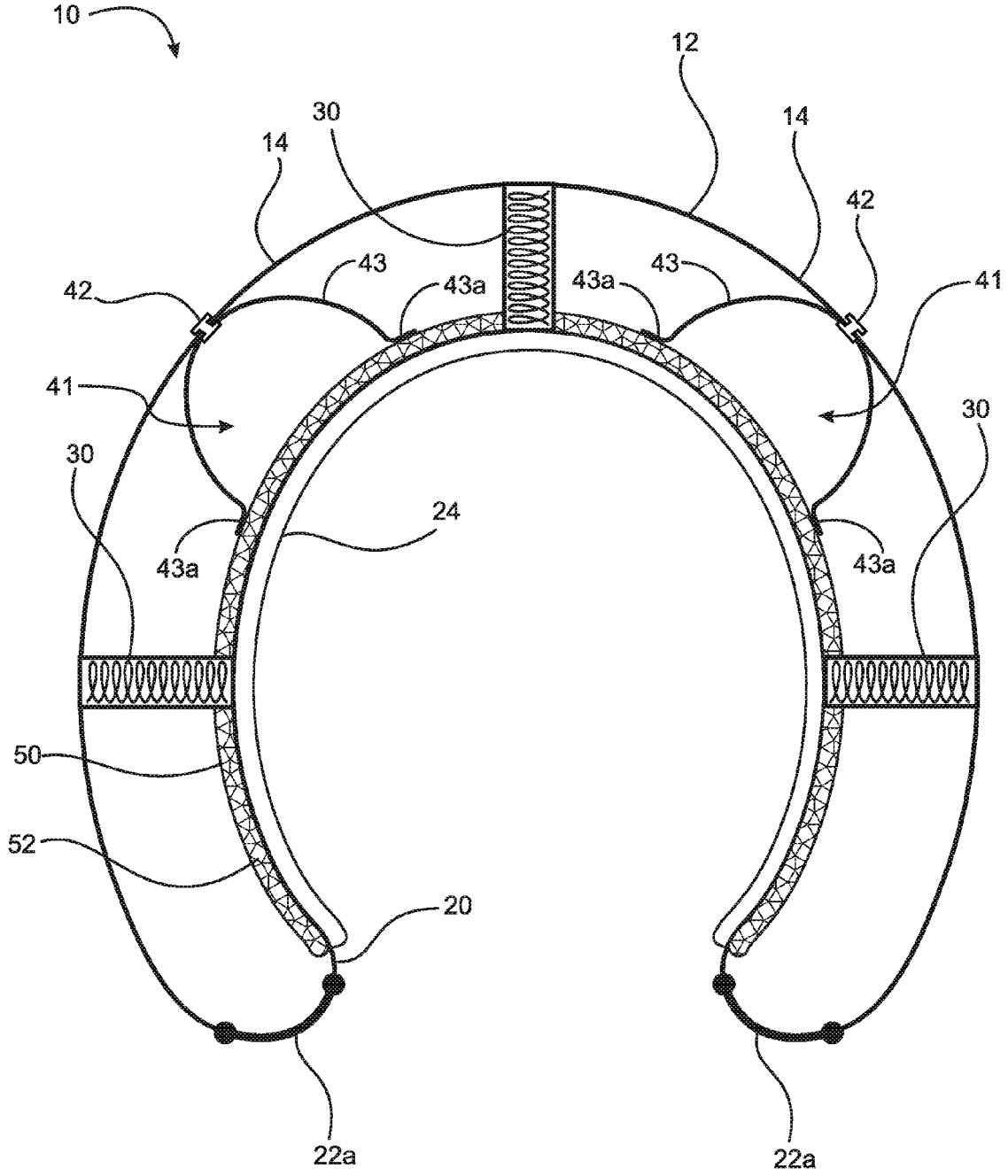
FIG. 9 is a cross-sectional view of the helmet illustrating leaf springs anchored on the outer shell of the helmet.

FIG. 9 is a cross-sectional view of helmet 10 comprising leaf springs 41, fixedly secured to outer shell 12, as well as cords 30. It should be appreciated that the embodiment of helmet 10 shown may further comprise cords 31.

Figure 10A:
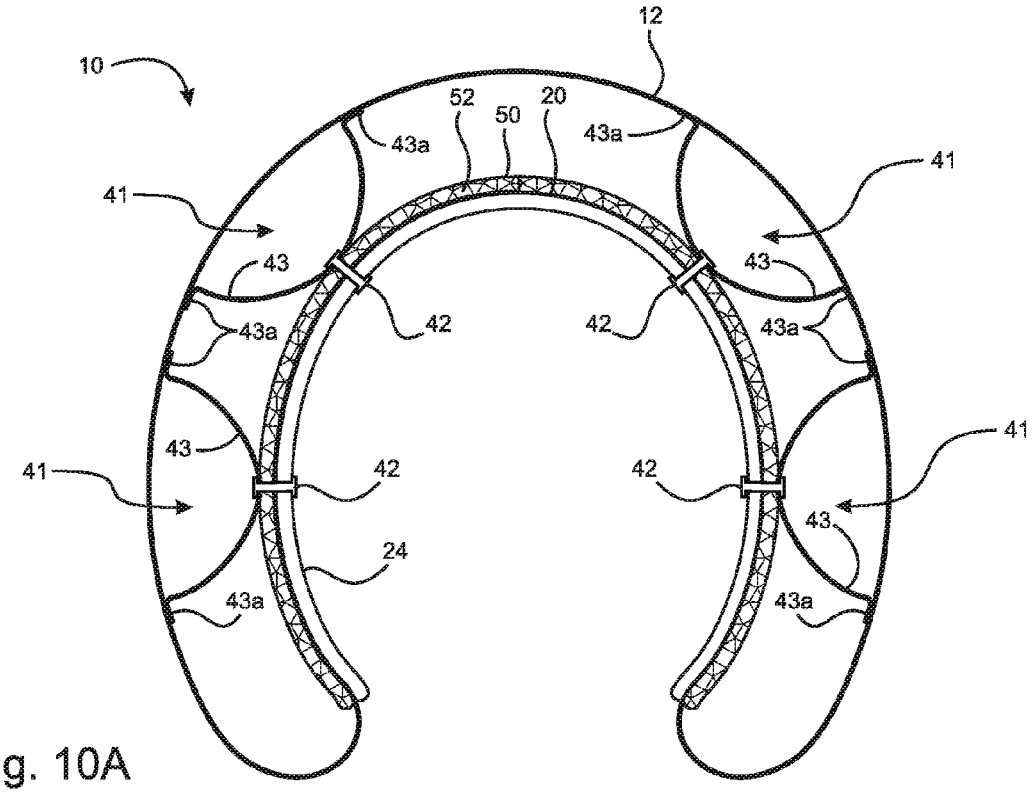
FIG. 10A depicts schematically the parabolic leaf springs when the helmet is in a neutral state before being struck by a force.
Figure 10B:
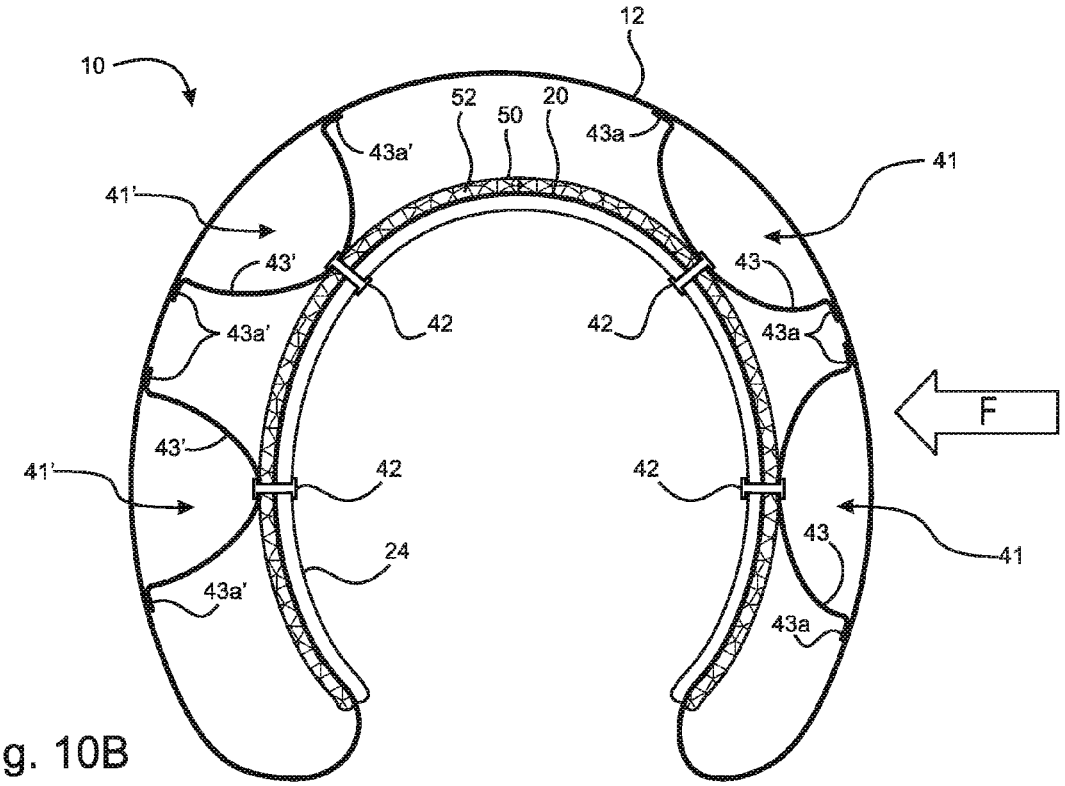
FIG. 10B depicts schematically how the parabolic leaf springs temporarily change their shape when absorbing a force striking the helmet.

FIGS. 10A and 10B schematically depict the action of leaf springs 41 when helmet 10 is struck by a force. In FIG. 10A, helmet 10 is in the neutral state. In the neutral state, springs 41 are under relatively slight tension on all circumferential locations about helmet 10. In FIG. 10B, force F strikes helmet 10, specifically outer shell 12, the right hand side (i.e., radially inward relative to helmet 10). Ends 43*a* are separated further from each other as arms 43 are pushed toward inner shell 20 (i.e., the radial distance between inner shell 20 and outer shell 12 decreases) to absorb the translational force vector created by force F. Simultaneously, ends 43*a*' of arms 43' of springs 41' located on the opposite side of helmet 10 move closer together as the tension on arms 43' is reduced (i.e., the radial distance between inner shell 20 and outer shell 12 increases). After force F is exhausted, the increased tension created on the arms 43 on the right hand or contact side of helmet 10 act to return outer shell 12 radially outward toward the neutral position. The relaxed tension of arms 43' on the noncontact side of helmet 10 allows outer shell 12 to move radially inward, closer to inner shell 20, toward the neutral position. Although not shown in FIGS. 10A and 10B, it will be understood that cords 30 and/or cords 31 will act to absorb any rotational or torsional forces generated on helmet 10 by force F.

Figure 11:
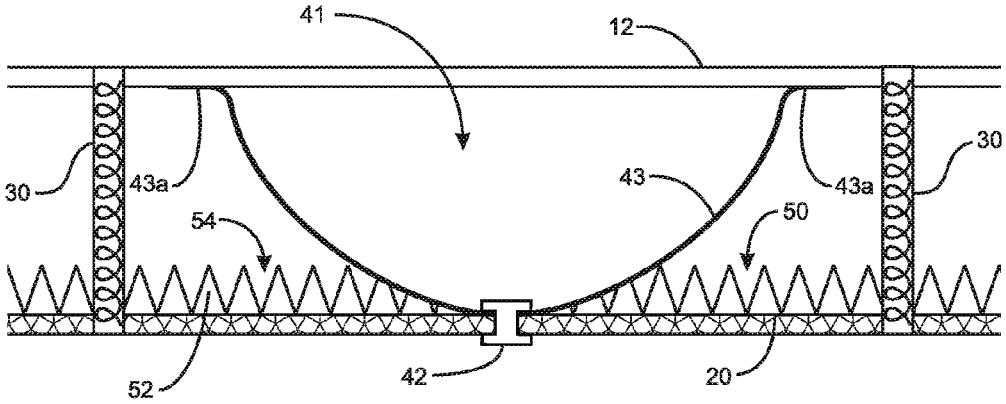
FIG. 11 is an enlarged schematic cross-sectional view of a crumple zone in a helmet in which a leaf spring is the force absorber/deflector.
Figure 12:
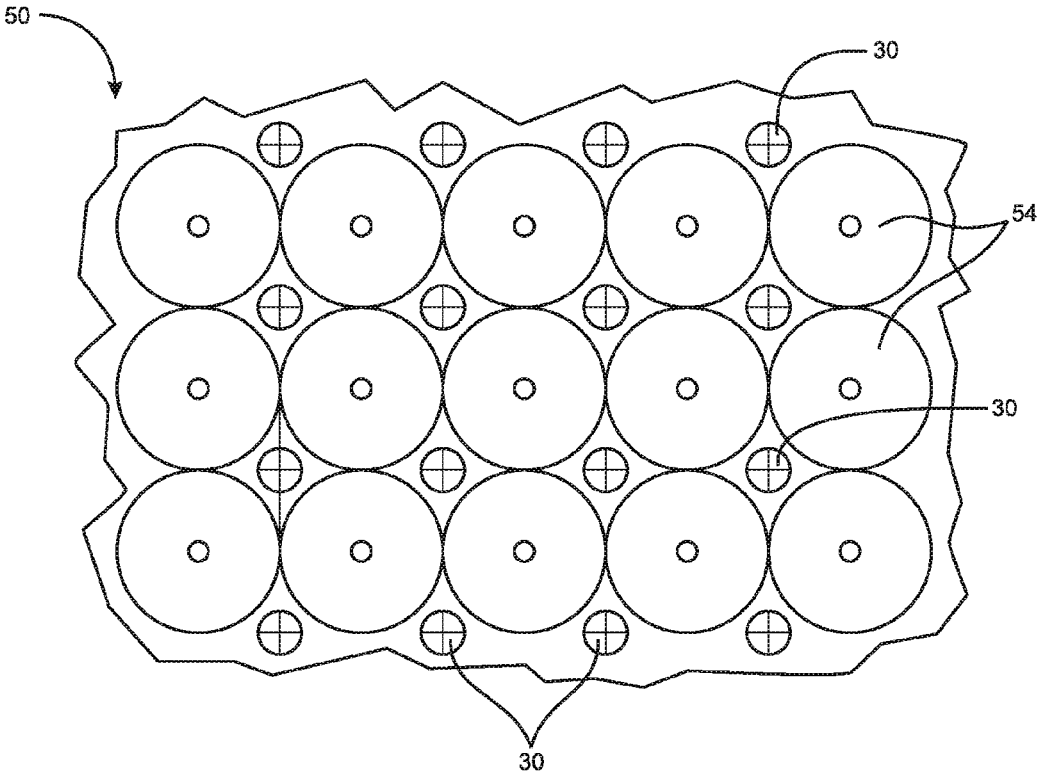
FIG. 12 is a top view of the crumple zone showing a plurality of elastomeric cords extending between the cones of a visco-elastic material.

FIG. 11 is an enlarged schematic cross section of crumple zone or intermediate zone 50 in helmet 10 wherein leaf spring 41 is the force absorber/deflector. Elastomeric cords 30 extend from inner shell 20 to outer shell 12. Crumple zone 50 is arranged circumferentially between cords 30 and comprises filler 52. In the embodiment shown, filler 52 material is in the shape of a plurality of cones 54. In an example embodiment, filler 52 comprises viscoelastic materials, such as, SORBOTHANE® material, or a combination of viscoelastic materials. Viscoelastic materials provide the advantage of behaving like a quasi-liquid, being readily deformed by an applied force and recovering slowly, although, in the absence of such a force, it takes up a defined shape and volume. An unusually high amount of the energy from an object dropped onto SORBOTHANE® material is absorbed. Leaf spring 41 pivotably connected to inner shell 20 by anchor point 42, extends up through crumple zone 50, and contacts outer shell 12. In this embodiment, cones 54 in crumple zone 50 act to absorb a blow having much greater than normal force so that springs 41 are deflected to such a degree that outer shell 12 reaches crumple zone 50. FIG. 12 is a top view of crumple zone 50 showing a plurality of cords 30 arranged between cones 54 comprising viscoelastic material. It should be appreciated that a helmet employing fluid-filled bladders may include a crumple zone having viscoelastic materials as a filler such as SORBOTHANE® material or STYROFOAM® peanuts.

Figure 13A:
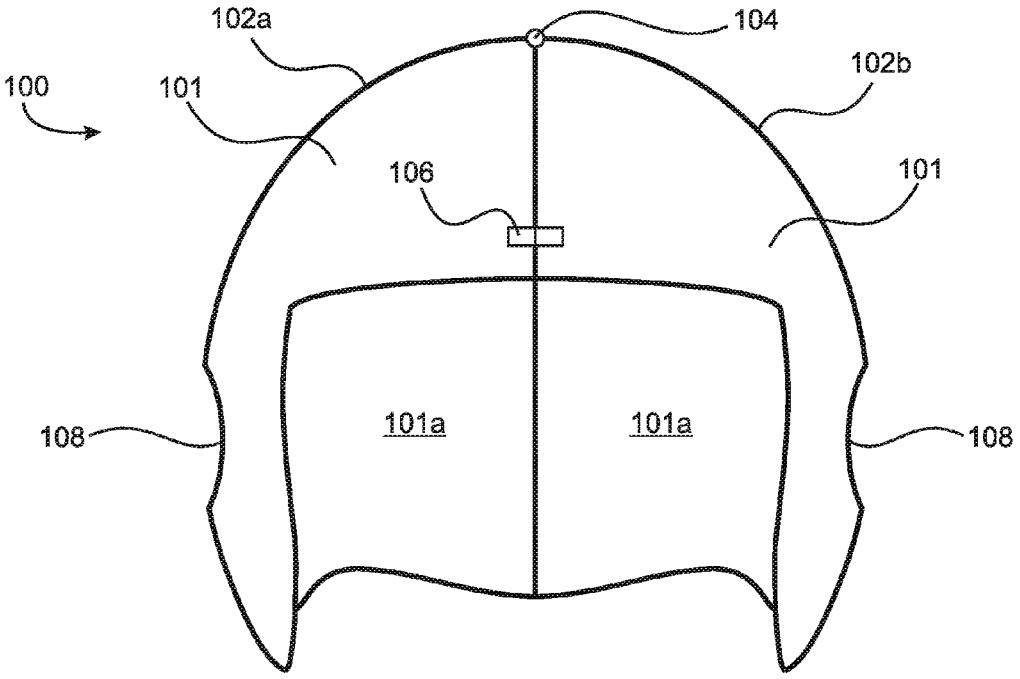
FIG. 13A is a front view of an articulating helmet, which is divided into at least two parts that are attached by an articulating means such as hinges or pivots.
Figure 13B:
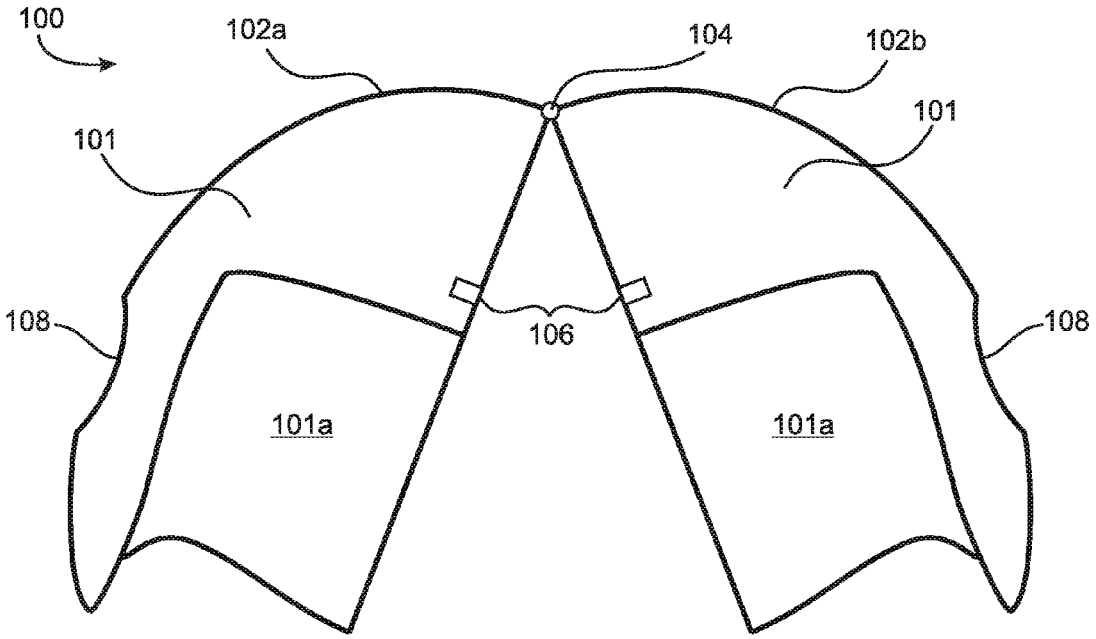
FIG. 13B is a front view of an articulating helmet, which is divided into two parts.

FIGS. 13A and 13B are front views of articulating helmet 100 ("helmet 100"), which is divided into at least two parts that are attached by an articulating means. By articulating, it is meant that the helmet comprises parts or sections joined by an articulating means such as hinge or pivot connections, swivels, or other devices that allow the separate parts of the helmet to be opened and closed together. Each section includes hard outer shell 101. FIG. 13A shows helmet 100 in the closed and locked orientation. Sections 102*a* and 102*b* are connected through articulating means 104. In this embodiment, articulating means 104 is a hinge. It should be appreciated that any number of articulating means 104 suitable to open and close helmet 100 may be used, and that the invention is not limited to the use of one articulating means. Preferably, helmet 100 comprises one or more locks 106 (or lock 106) to secure helmet 100 in the closed position. Helmet 100 further comprises ear apertures 108 and inner surface 101*a*. FIG. 13B shows helmet 100 in the open orientation. Lock 106 is disengaged allowing articulating means 104 to open and separate sections 102*a* and 102*b*.

Figure 14A:
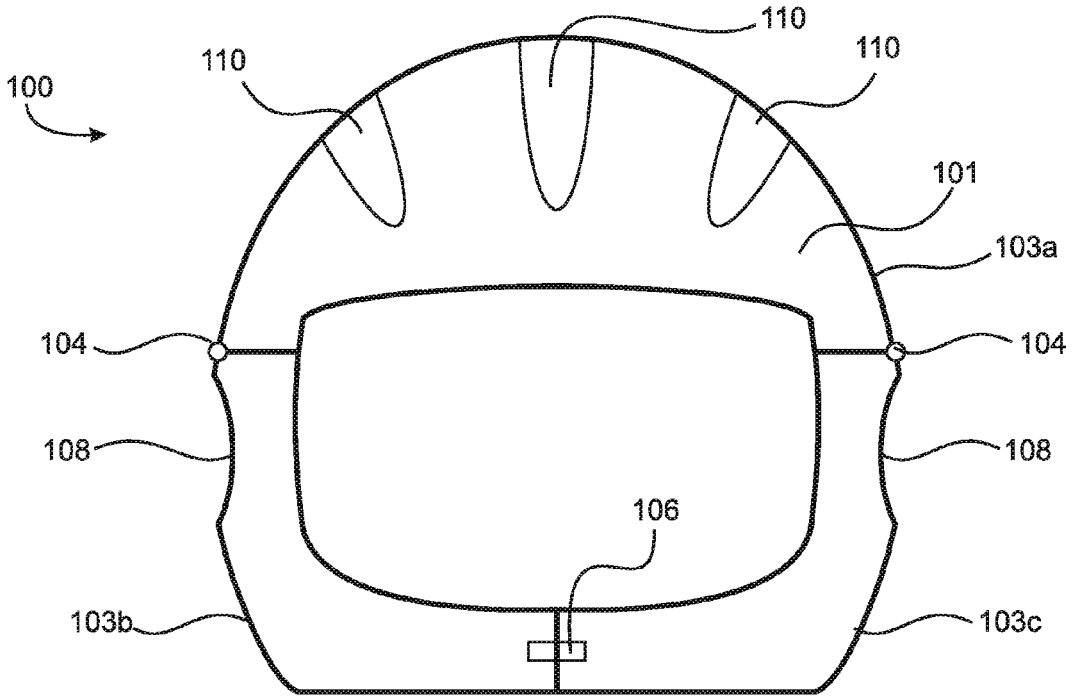
FIG. 14A is a front view of an alternate embodiment of the articulating helmet having three articulating sections.
Figure 14B:
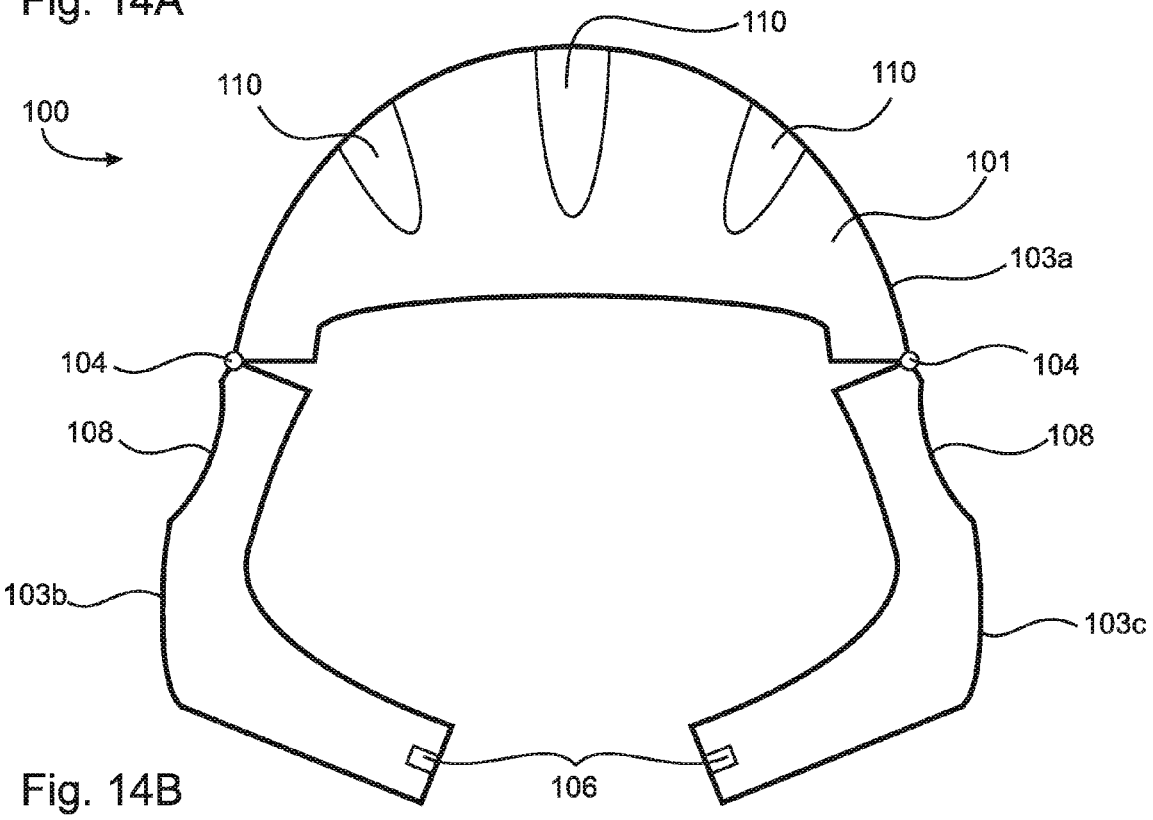
FIG. 14B is a front view of the articulating helmet of FIG. 14A.
Figure 15:
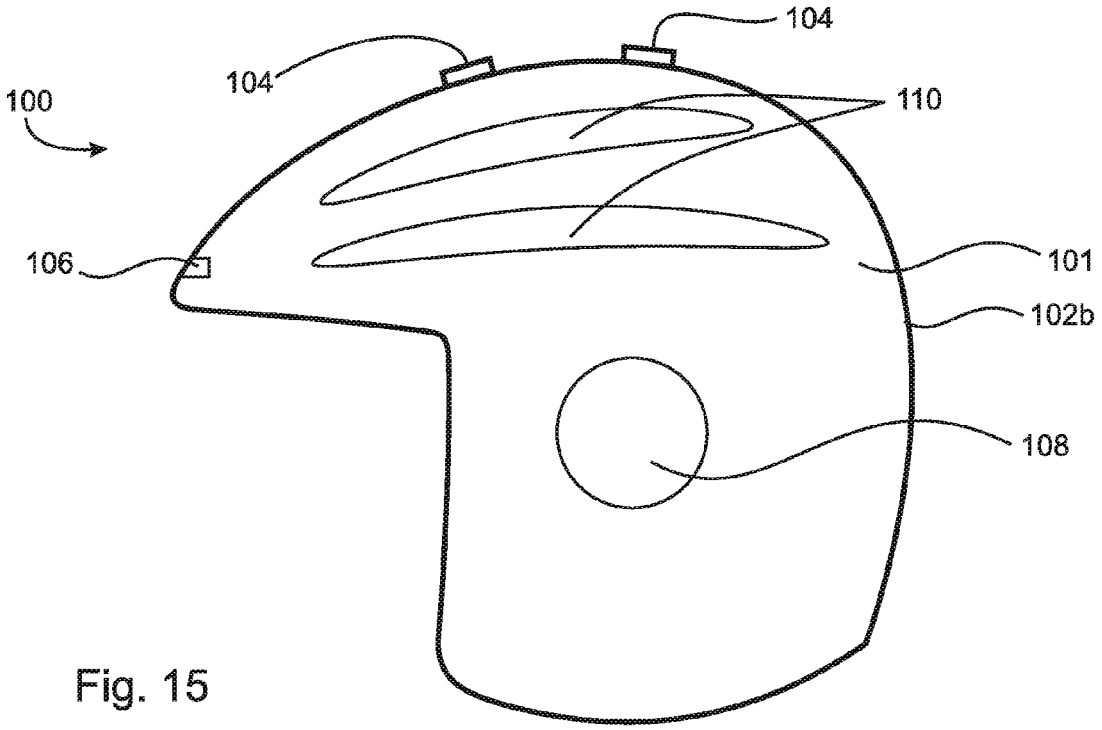
FIG. 15 is a side view of a two-section embodiment of an articulating helmet including air vents.
Figure 16:
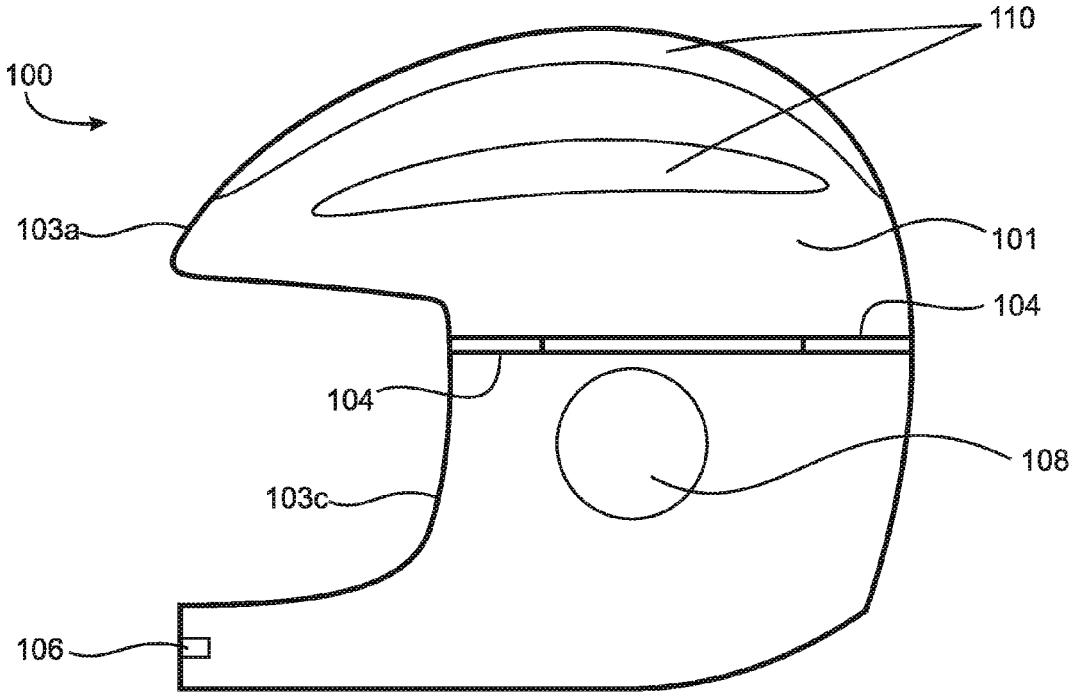
FIG. 16 is a side view of a three-section embodiment of an articulating helmet showing two hinges for the articulating means.

FIGS. 14A and 14B depict front views of an alternate embodiment of helmet 100 comprising sections 103*a*, 103*b*, and 103*c*. In this embodiment, helmet 100 includes air vents 110, which are openings defined by helmet 100 that extend from outer surface 101 through to inner surface 101*a*. Articulating means 104 allows sections 103*b* and 103*c* to pivot with respect to section 103*a*. One or more locks 106 hold sections 103*b* and 103*c* in the closed position. It should be appreciated that air vents 110 may be arranged in helmets having any number of sections, for example, a helmet having two sections (as shown in FIGS. 13A and 13B). FIG. 14B shows helmet 100 in the open position in which both articulating means 104 open to separate sections 103*b* and 103*c* from section 103*a*. FIG. 15 is a side view of the two-section embodiment of helmet 100, as shown in FIGS. 13A and 13B, further comprising air vents 110 and two articulating means 104. Similarly, FIG. 16 is a side view of the three-section embodiment of helmet 100, as shown in FIGS. 14A and 14B, showing two articulating means 104 for section 103*c*.

Figure 17:
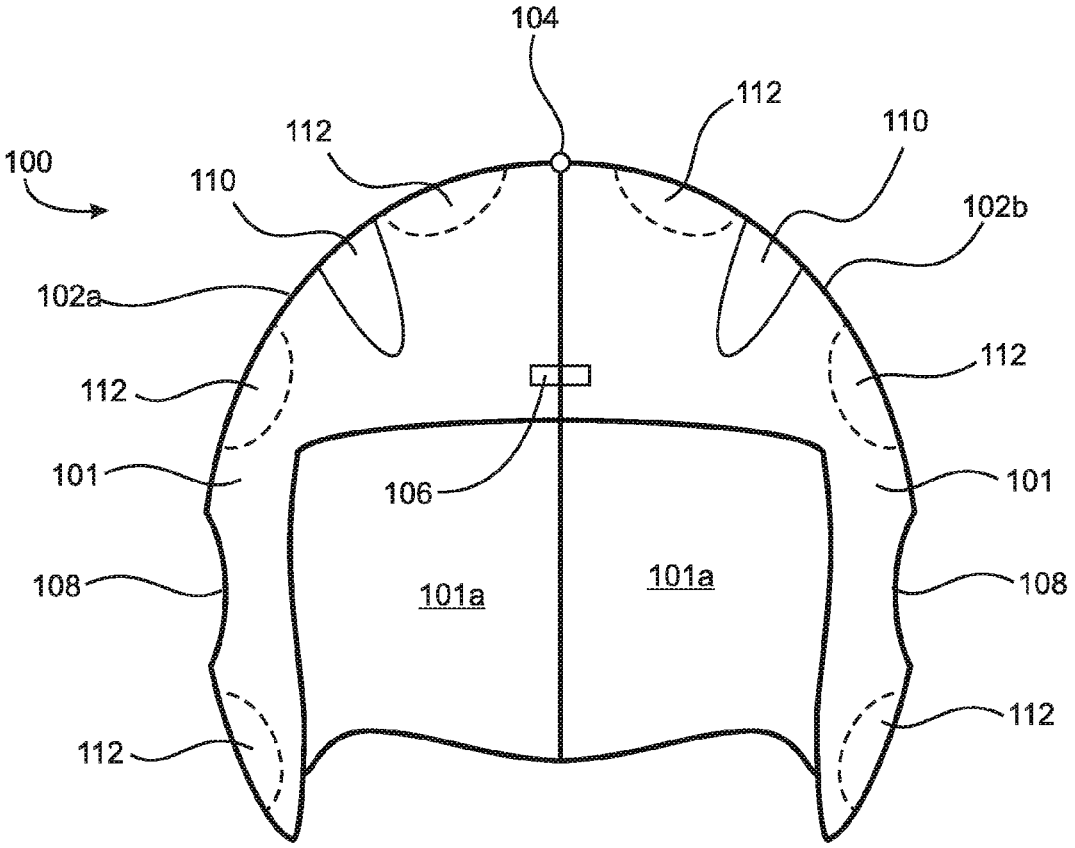
FIG. 17 is a front view of an additional alternate embodiment of an articulating helmet including pads or cushions attached to the inner surface of the helmet.

FIG. 17 is a front view of another alternate embodiment of articulating helmet 100 wherein pads or cushions 112 are attached to inner surface 101*a* of helmet 100. Pads 112 may be permanently attached to inner surface 101*a* with suitable attachment devices such as rivets, screws, or adhesives. Alternatively, pads 112 may be releasably attached to inner surface 101*a* using attachment devices such as VELCRO® hook and loop material, suction cups, snap buttons, or other releasable coupling device. Releasably attached pads 112 provides the advantage of allowing a user to customize helmet 100 with cushions 112 of various sizes, materials, and arrangements that provide a snug fit when helmet 110 is worn. Pads 112 comprise any suitable foam materials known to those having ordinary skill in the art. In both embodiments, pads 112 are attached to inner surface 101*a* between vents 110 to ensure maximum air flow to the user.

Figure 17A:
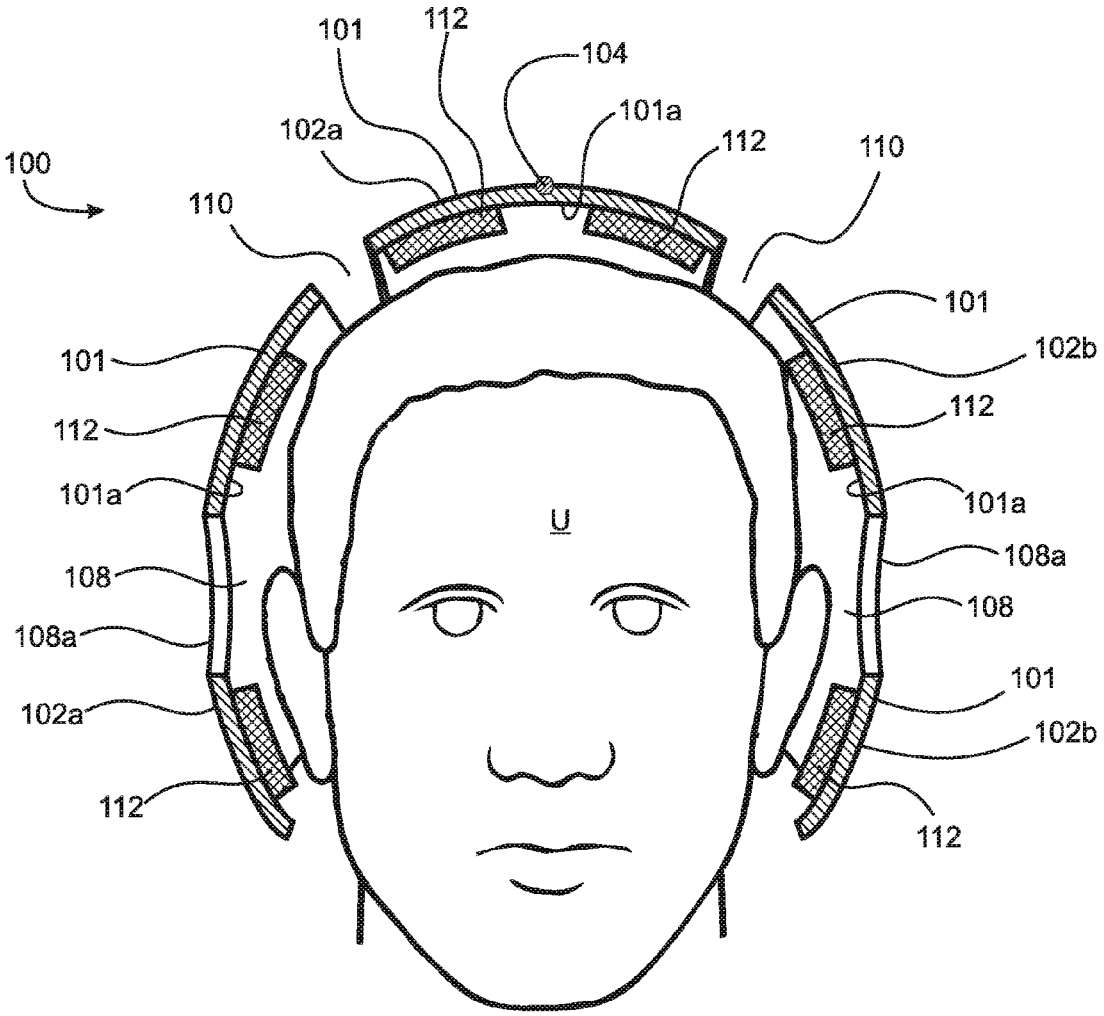
FIG. 17A is a front view of a user wearing an articulating helmet in a cross-sectional view demonstrating the fit of the helmet on the user.

FIG. 17A is a front view of a user showing a cross-section of articulating helmet 100 as worn by user U, with outer shell 120 removed. When helmet 100 is worn, pads 112 contact the top of the head of user U to provide a snug fit. It should be appreciated that pads 112 are arranged on inner surface 101*a* such that air vents 110 are unimpeded and provide air flow to user U. In this embodiment, ear apertures 108 are covered with a membrane or diaphragm 108*a*. In one embodiment, diaphragm 108*a* is fabricated from KEVLAR® fabric.

Figure 18:
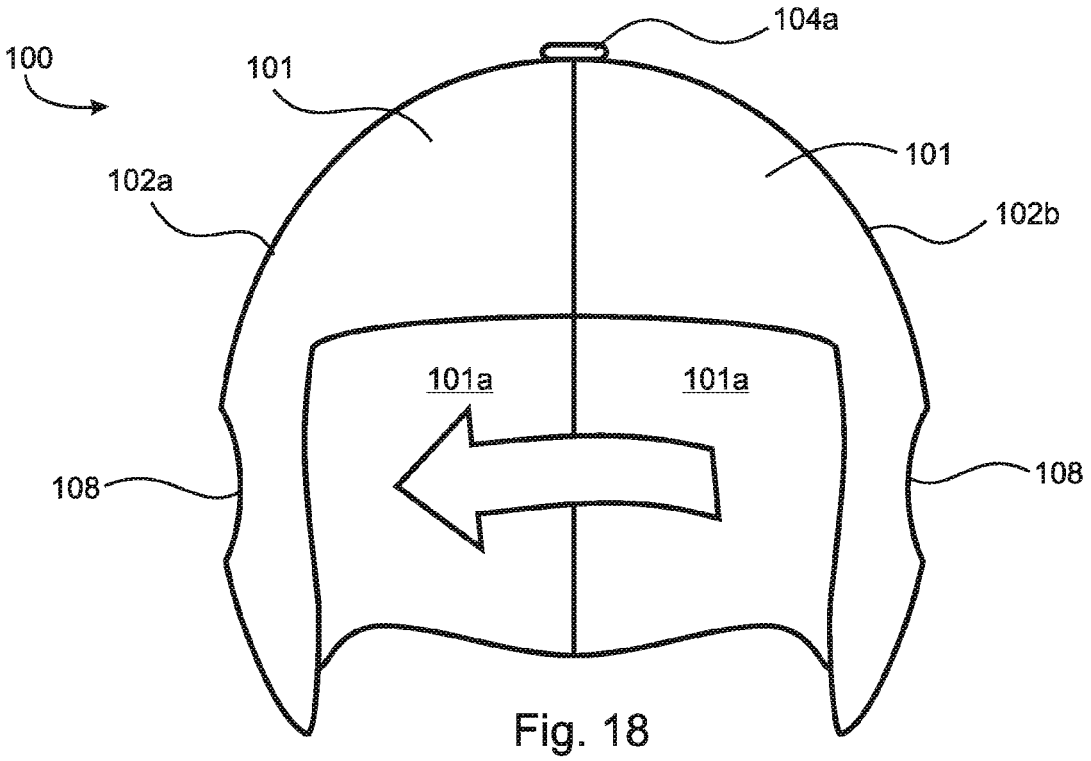
FIG. 18 is a front view of an articulating helmet.
Figure 18A:
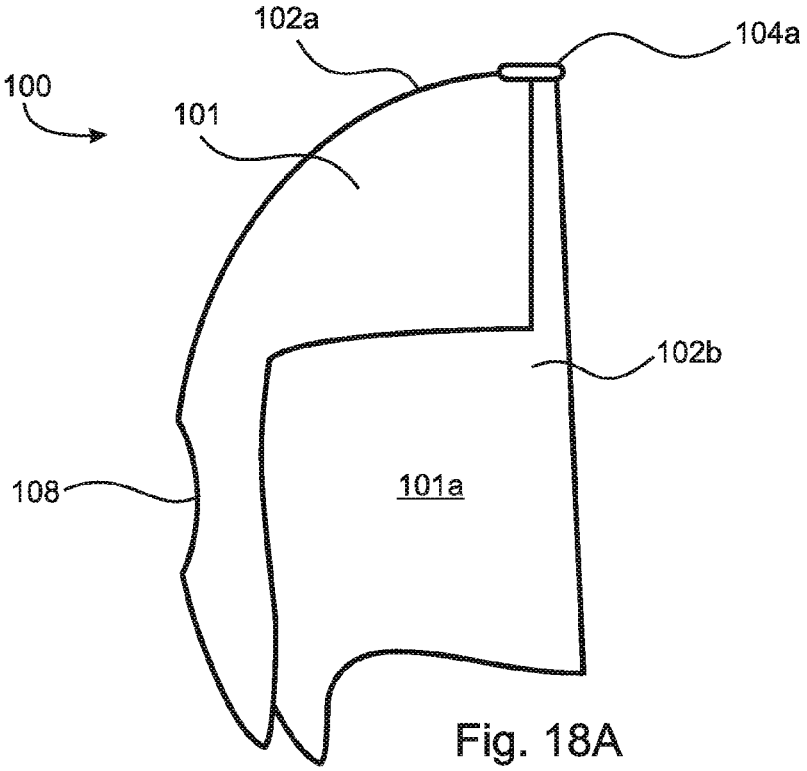
FIG. 18A is a front view of the articulating helmet of FIG. 18.

FIGS. 18 and 18A are front views of articulating helmet 100 showing an embodiment wherein one section of helmet 100 may nest inside the other. In FIG. 18A, section 102*b* is nested inside section 102*a* and helmet 100 is in the open position. Articulating means 104*a* is a swivel operatively arranged to hold sections 102*a* and 102*b* together and allow sections 102*a* and 102*b* to open and turn relative to each other such that outer surface 101 of one section radially faces inner surface 101*a* of the other section. For example, section 102*b* is rotated 90 degrees radially inside of section 102*a*, or vice versa. This embodiment decreases the overall volume of helmet 100 in the open position making it easier to store.

Figure 19A:
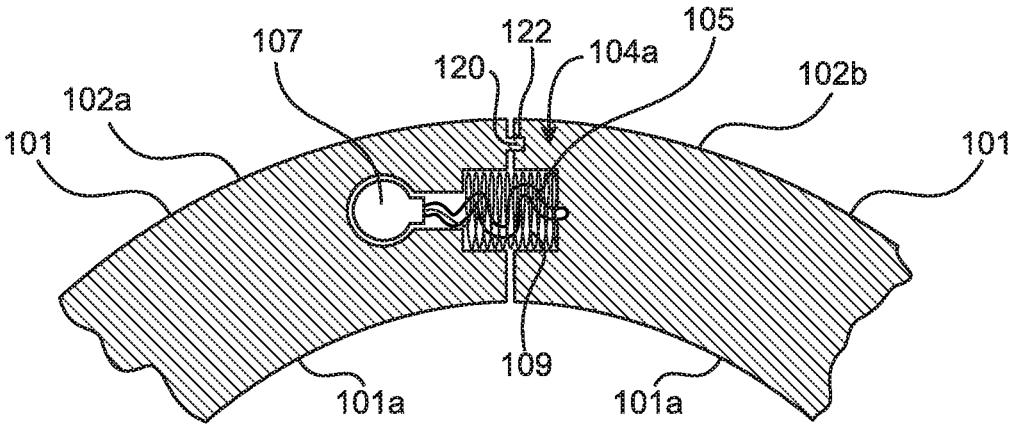
FIG. 19A depicts an enlarged cross-sectional view of a swivel that enables two articulating sections of an articulating helmet to nest within one another.
Figure 19B:
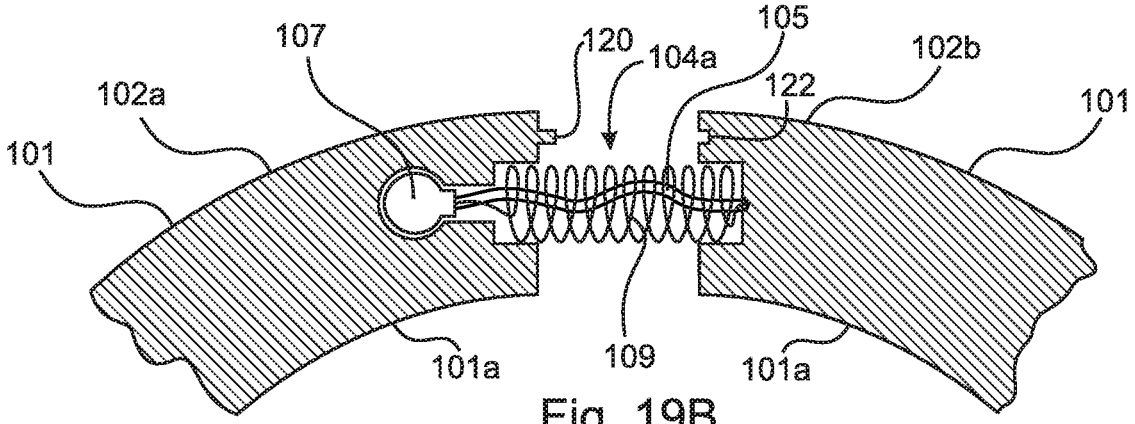
FIG. 19B depicts an enlarged cross-sectional view showing two articulating sections of an articulating helmet pulled apart prior to being placed into a nesting position.
Figure 19C:
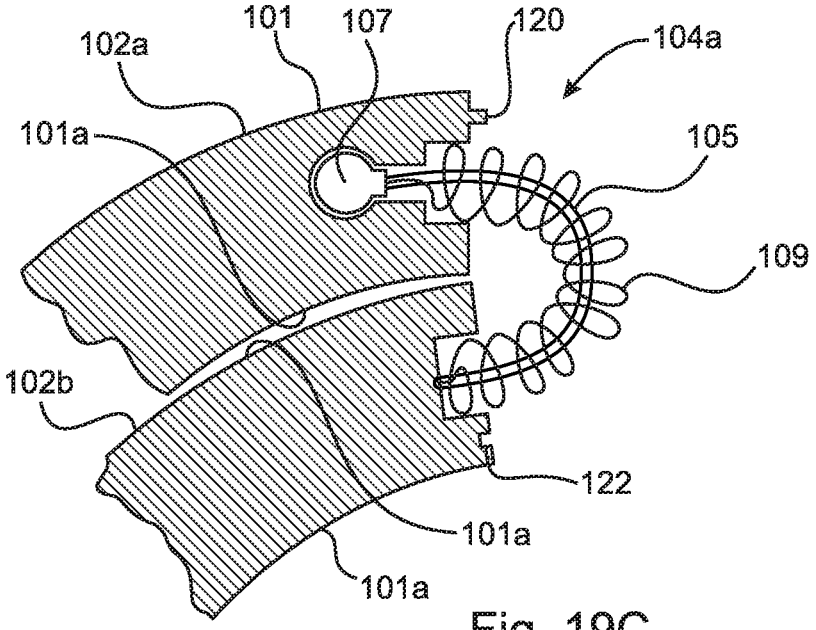
FIG. 19C depicts an enlarged cross-sectional view of two articulating sections in a nested position.

FIG. 19A depicts an enlarged cross-sectional view of one embodiment of swivel means 104*a* that enables sections 102*a* and 102*b* to turn and nest within one another. Cable 105 is attached to section 102*b* at one end and universal joint 107 at another end. Spring 109 is connected to universal joint 107 at a first end and section 102*b* at a second end. Universal joint 107 is rotatably connected to section 102*a* (e.g., embedded therein) such that cable 105 and section 102*b* are rotatabeable relative to section 102*a*, and vice versa. Spring 109 pulls attached section 102*b* (and cable 105) toward section 102*a*. FIG. 19B shows sections 102*a* and 102*b* pulled apart with stretched spring 105 holding the two sections together. In addition, male prongs or tubes 120 can be arranged on section 102*a* which slide into ports 122 arranged on section 102*b* to stabilize the helmet when sections 102*a* and 102*b* are joined together. Alternatively, male prongs or tubes 120 can be arranged on section 102*b* and ports 122 can be arranged on section 102*a* (this embodiment is not shown). As shown in FIG. 19C, universal joint 107 enables section 102*b* to rotate relative to section 102*a* after which section 102*b* is pulled back toward section 102*a*. Because section 102*b* has been rotated, outer surface 101 of section 102*b* nests against inner surface 101*a* of section 102*a*.

Figure 20:
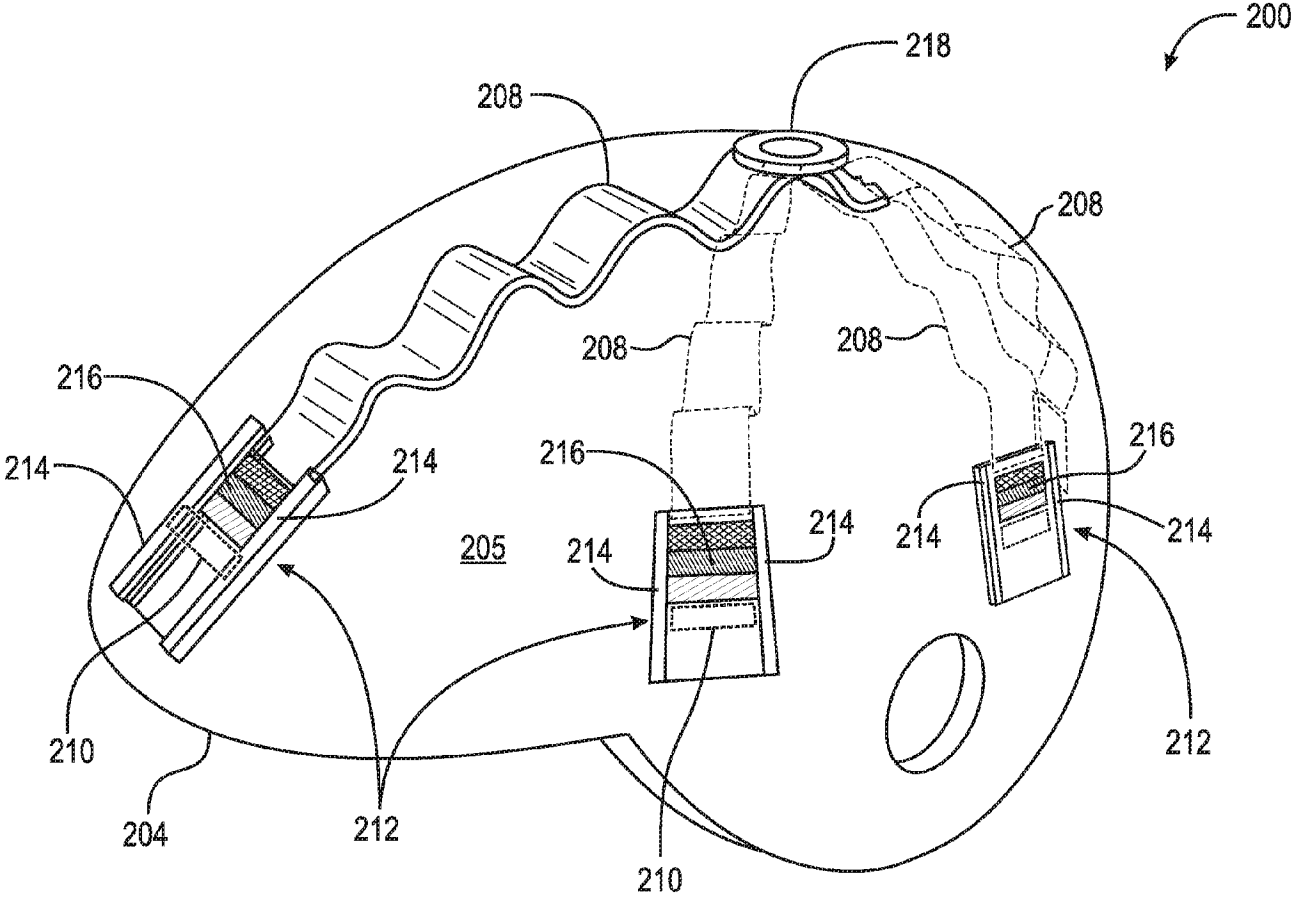
FIG. 20 is a side perspective view of an additional embodiment of a protective helmet.

FIG. 20 is a side perspective view of a further additional embodiment of the helmet with outer shell 202 removed. Helmet 200 includes an integral or continuous outer shell 202 (not shown in FIG. 20) and inner shell 204 functionally connected. By integral or continuous is meant that shell 202 is formed as a single unit. By functionally connected, it is meant that outer shell 202 and inner shell 204 are connected such that outer shell 202 may move, such as rotate, relative to inner shell 204 such as, for example, the sliding connection 22 discussed above. Elastomeric zone 203 ("zone 203") lies between outer shell 202 and inner shell 204. At least one sinusoidal spring 208 (spring(s) 208") is positioned in zone 203. FIG. 20 depicts a preferred embodiment in which a plurality of springs 208 are positioned in zone 203. In a more preferred embodiment shown here, springs 208 are sinusoidal springs 208 having a shape similar to or identical with a series of sine waves and can be manufactured as described in U.S. Patent Application Publication No. 2012/00773884 and U.S. Pat. No. 4,708,757 both to Guthrie, which patent publications are hereby incorporated by reference in their entireties.

Although not necessary for the protective function of helmet 200, in a further embodiment, the distal end of at least one of springs 208 is in operative contact with force indicator tab 216 ("tab 216"). By "operative contact" it is meant that a component or device contacts but is not connected to a second component and causes that second component to function. For example, as described below, the operative contact end of spring 208 contacts the proximal edge of tab 216 so that when spring 208 is extended, it pushes tab 216 to an outer position toward the outer perimeter of helmet 200. When spring 208 retracts, tab 216 remains in its displaced position. Tab 216 preferably is a multi-color panel as represented by the different cross hatching patterns on the surface of tab 216, shown in FIG. 20.

Tab 216 is positioned within channel 212, which is positioned on outer surface 205 of inner shell 204. Channel 212 includes parallel rails 214 with tab 216 positioned between rails 214. In this way, tab 216 is always pushed in the same direction when spring 208 is extended. Outer shell 202 defines at least one window 210, shown in shadow, positioned so that tab 216 can be viewed through window 210 if spring 208 is extended sufficiently to push tab 216 into channel 212. In the embodiment shown, rivet 218 forms the attachment of the plurality of springs 208 to outer shell 202 to form a radial or "spider-like" array of springs 208. In the preferred embodiment, outer shell 202 is functionally connected to inner shell 204 such that window 210 remains at a constant location relative to inner shell 204. The disclosure described herein refers to this embodiment. It should be appreciated that outer shell 202 is functionally attached to inner shell 204 such that movement of outer shell 202 relative to inner shell 204 does not affect the location of tab 216 (i.e., outer shell 202 does not contact tab 216). In another embodiment (not shown), outer shell 202 is functionally attached to inner shell 204 such that window 210 varies in location. For example, in a resting or neutral position, window 210 is arranged on outer shell 202 and located in a first location relative to inner shell 204. During (or just after) impact, when outer shell 202 moves relative to inner shell 204, window 210 can be located in a second location, different than the first location. However, outer shell 202 is arranged to always return to its resting or neutral position at a period of time after impact. Thus, window 210 will always return to the first location. Readings of tab 216 should always be conducted when outer shell 202 is in the resting or neutral position and window 210 is located in the first location.

Figure 20A:
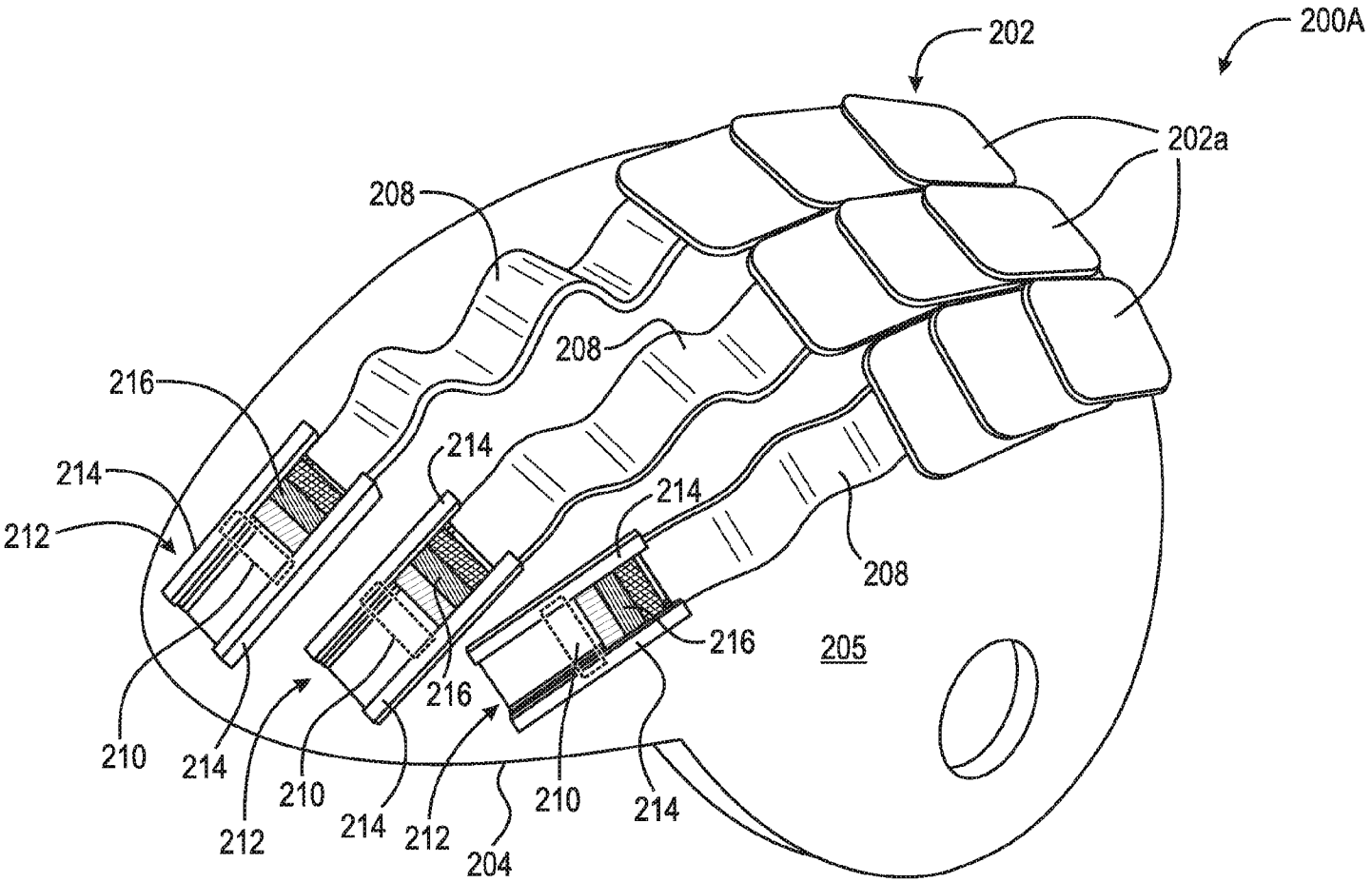
FIG. 20A depicts an alternate embodiment of the helmet shown in FIG. 20 in which the outer surface comprises overlapping plates that extend over the helmet, the plate being situated or apposed to an adjacent sinusoidal spring.

FIG. 20A depicts an alternate embodiment of the helmet labeled helmet 200A in which outer shell 202 comprises overlapping plates 202*a* ("plates 202*a*") which extend over helmet 200A and forms the outer wall or cover of elastomeric zone 203. Plates 202*a* may be arranged in rows. FIG. 20A also depicts a preferred arrangement of sinusoidal springs 208 in which three springs 208 extend along inner shell 204 with the at least one end of at least one of springs 208 in operative contact with tabs 216. As shown, springs 208 may be arranged separately under rows of plates 202*a*. Although not shown in FIG. 20A, the opposing ends of each of springs 208 may also be in operative contact with tab 216. Also shown in FIG. 20A, tab 216 is positioned within rails 214 of channel 212. Outer shell 202 defines at least one window 210 in one of plates 202*a* positioned so that tab 216 can be viewed through window 210 if spring 208 is extended sufficiently through channel 212.

Figure 21:
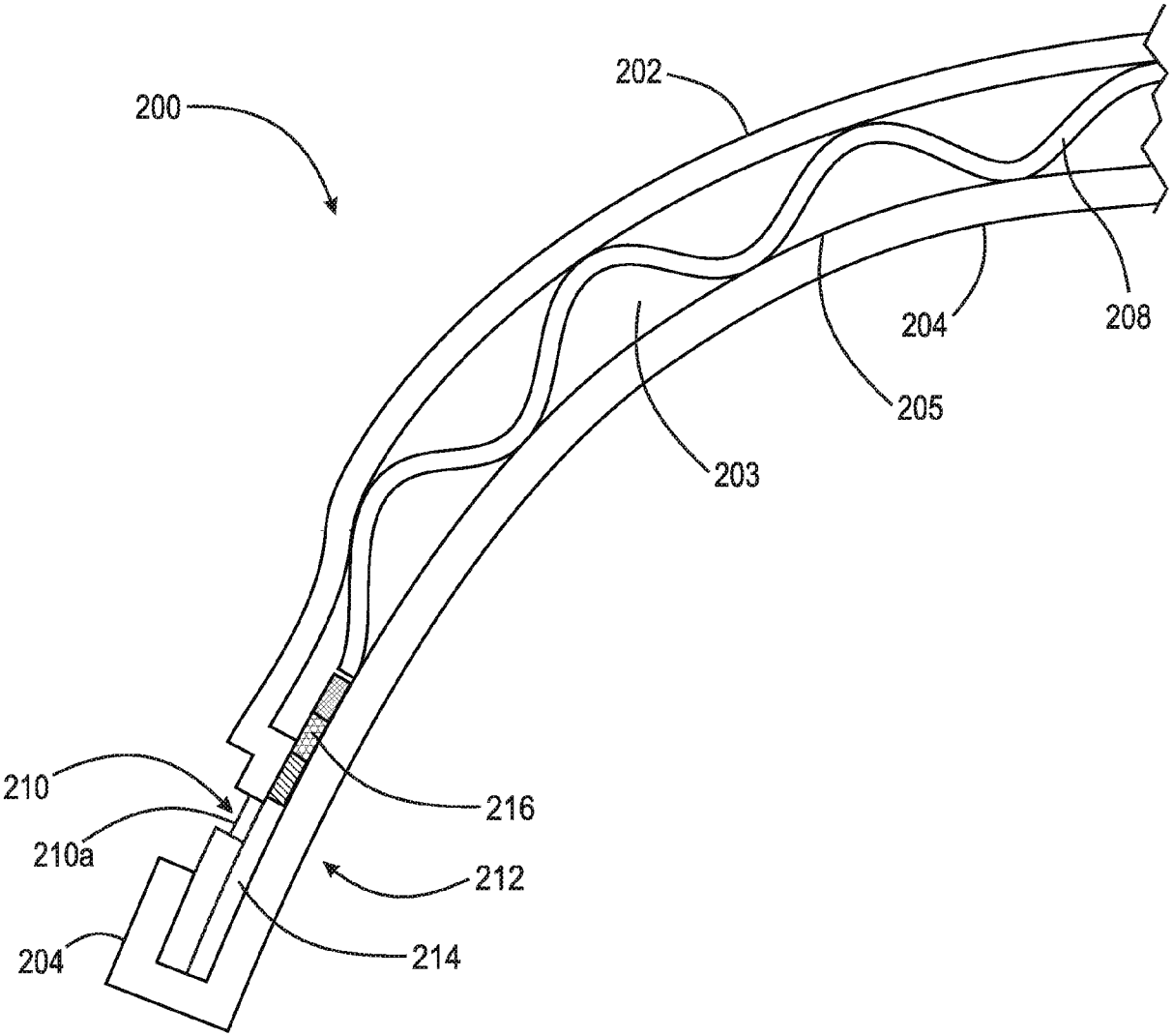
FIG. 21 is a cross-sectional view of a sinusoidal spring of the helmet shown in FIG. 20.

FIG. 21 is a cross-sectional view of helmet 200 through a sinusoidal spring 208. Spring 208 is positioned in elastomeric zone 203 resting on outer surface 205. One end of spring 208 is either close to or in contact with tab 216, which is positioned between rails 214. In the resting or neutral position shown, tab 216 is arranged under outer shell 202 and not exposed in window 210. Spring(s) 208 may be attached to outer shell 202, inner shell 204, or both outer shell 202 and inner shell 204. Helmet 200 may also comprise substrate 210*a* arranged over window 210.

Figure 22:
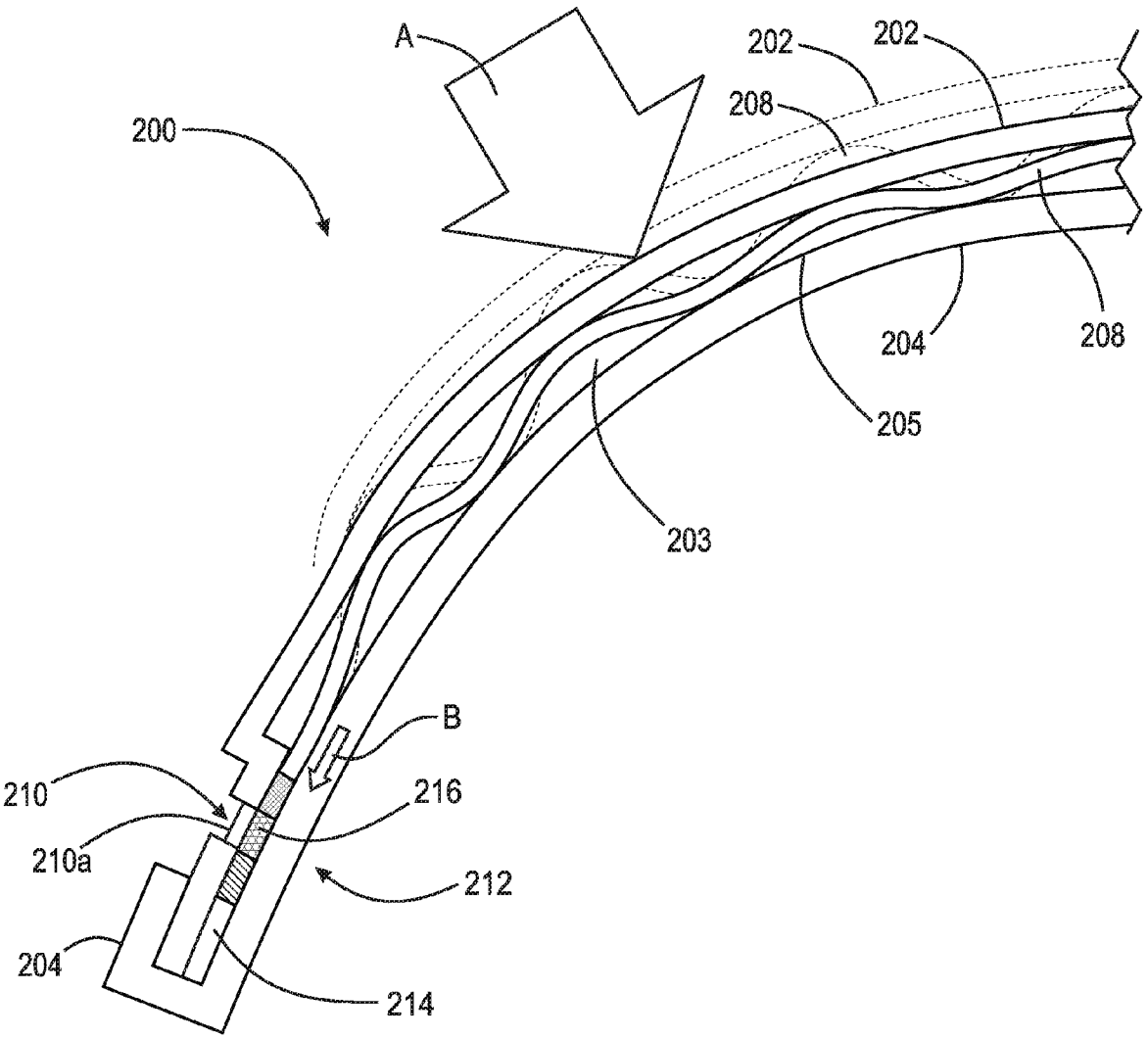
FIG. 22 shows the same view as the view shown in FIG. 21 showing force, such as from a blow or hit, being applied to the helmet.

FIG. 22 shows the same view of helmet 200 as shown in FIG. 21 in which force A, represented by arrow A, is applied to helmet 200. The force may be a blow impacting helmet 200. The dotted lines of outer shell 202 and spring 208 show those components in the neutral state. The solid lines show outer shell 202 pressed into elastomeric zone 203 by force A. When force A strikes outer shell 202, one or more of springs 208 are pushed into a compressed mode as shown by the reduced amplitude of the sine wave formed in sinusoidal spring 208 as well as the expanded length of spring 208. As spring 208 lengthens, as represented by arrow B, it pushes tab 216 toward and/or into window 210. Persons of ordinary skill in the art will recognize that the increase in the length of spring 208 is a function of the amount of force striking helmet 200. Thus, the amount of exposure of tab 216 in window 210 depends on the amount of force striking helmet 200. Preferably, tab 216 includes different colors, such as green, yellow, and red, or other indicators, each of which may appear in window 210 depending on the force of the blow. It will be recognized that more than one spring 208 may be extended when helmet 200 is struck.

Figure 23:
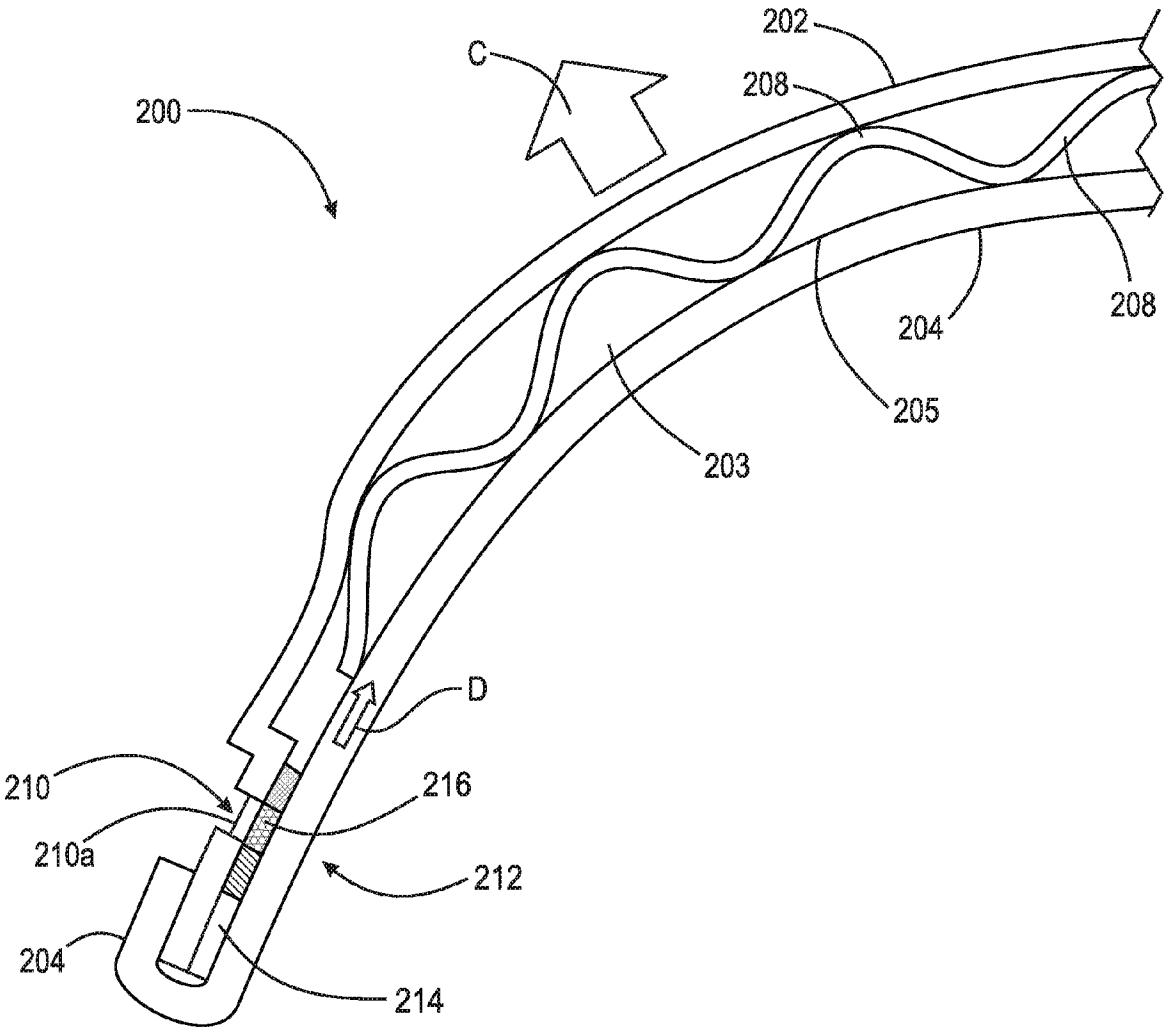
FIG. 23 depicts the same view shown in FIGS. 21 and 22 after the outer shell and sinusoidal spring have returned to the neutral position.

FIG. 23 depicts the same view shown in FIGS. 21 and 22 after outer shell 202 and sinusoidal spring 208 have returned to the neutral position. The return movement of outer shell 202 is shown by arrow C while the return of spring 208 is shown by arrow D. Tab 216 remains under window 210 after spring 208 retracts back to its normal state.

Figure 24:
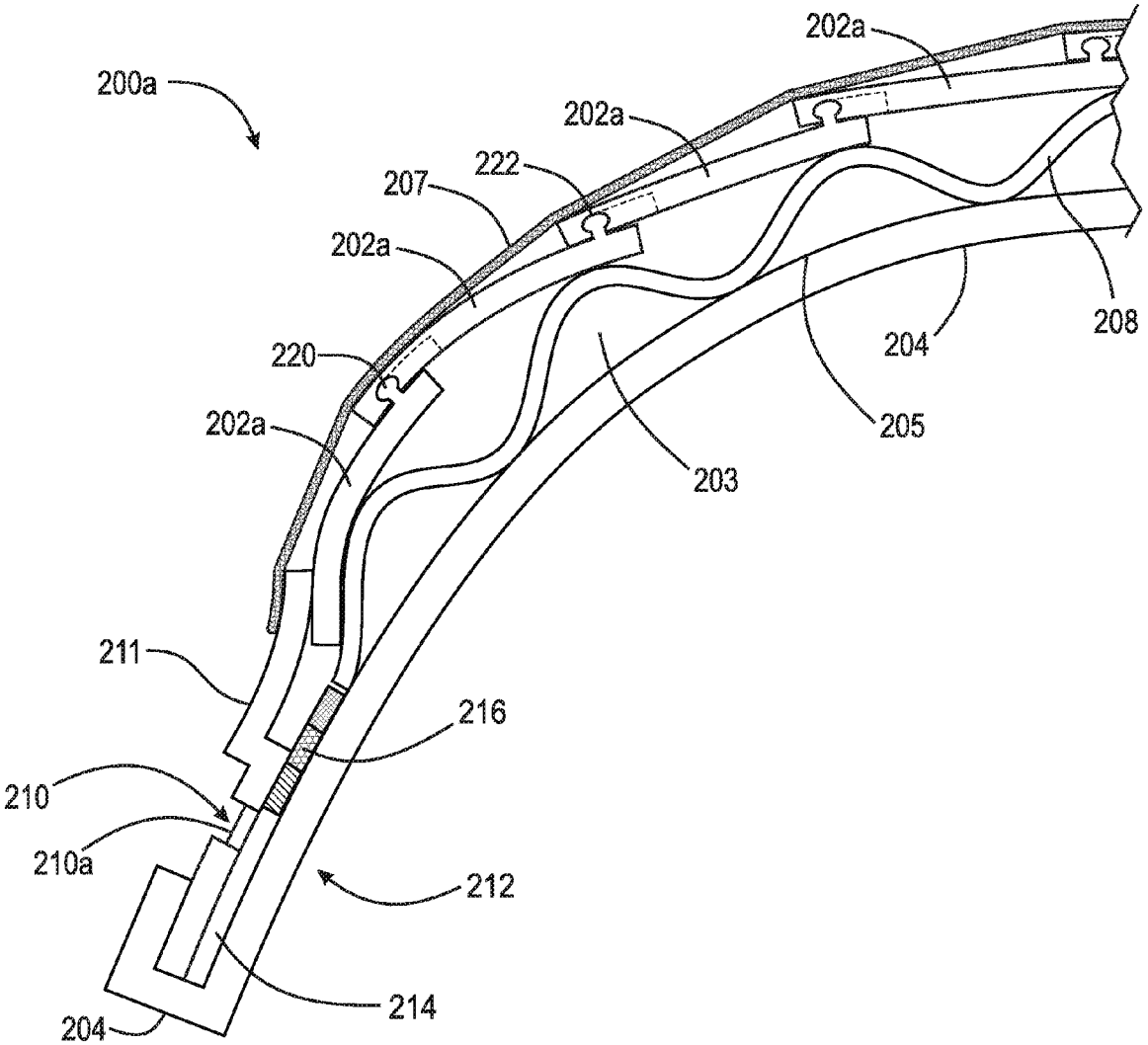
FIG. 24 is a cross-sectional view of the alternate embodiment of the helmet shown in FIG. 20A depicting how the overlapping plates are connected to each other and retain the ability to move in response to forces applied to the helmet.

FIG. 24 is a cross-section of helmet 200*a* shown in FIG. 20A depicting how overlapping plates 202*a* are connected to each other and still retain the ability to move in response to forces applied to helmet 200*a*. Sinusoidal spring 208 is confined between plates 202*a* and outer surface 205 of inner shell 204. Also shown is the distal end of spring 216 in operative contact with force indicator tab 216. Window 210 is defined by an edge portion 211 of helmet 200*a*. It may also be defined by one of plates 202*a*. In one embodiment, articulating plates 202*a* are attached using a male-female connection in which a round pin 220 is inserted into round socket 222. This connection enables the individual plates to pivot on pin 220 transversely or side-to-side and up and down to deflect some of the force away from the user's head while still preserving the integrity of the entire outer shell. Also shown is cover 207 which may overlay articulating plates 202*a*. Preferably, cover 207 is made from KEVLAR® fabric that provides an integral cover over the individual plates 202*a* but allows movement of individual plates. It should be appreciated that those having ordinary skill in the art will recognize that articulating plates 202*a* can be replaced by an integral hard outer shell 202, as shown in FIG. 20 above.

Figure 25:
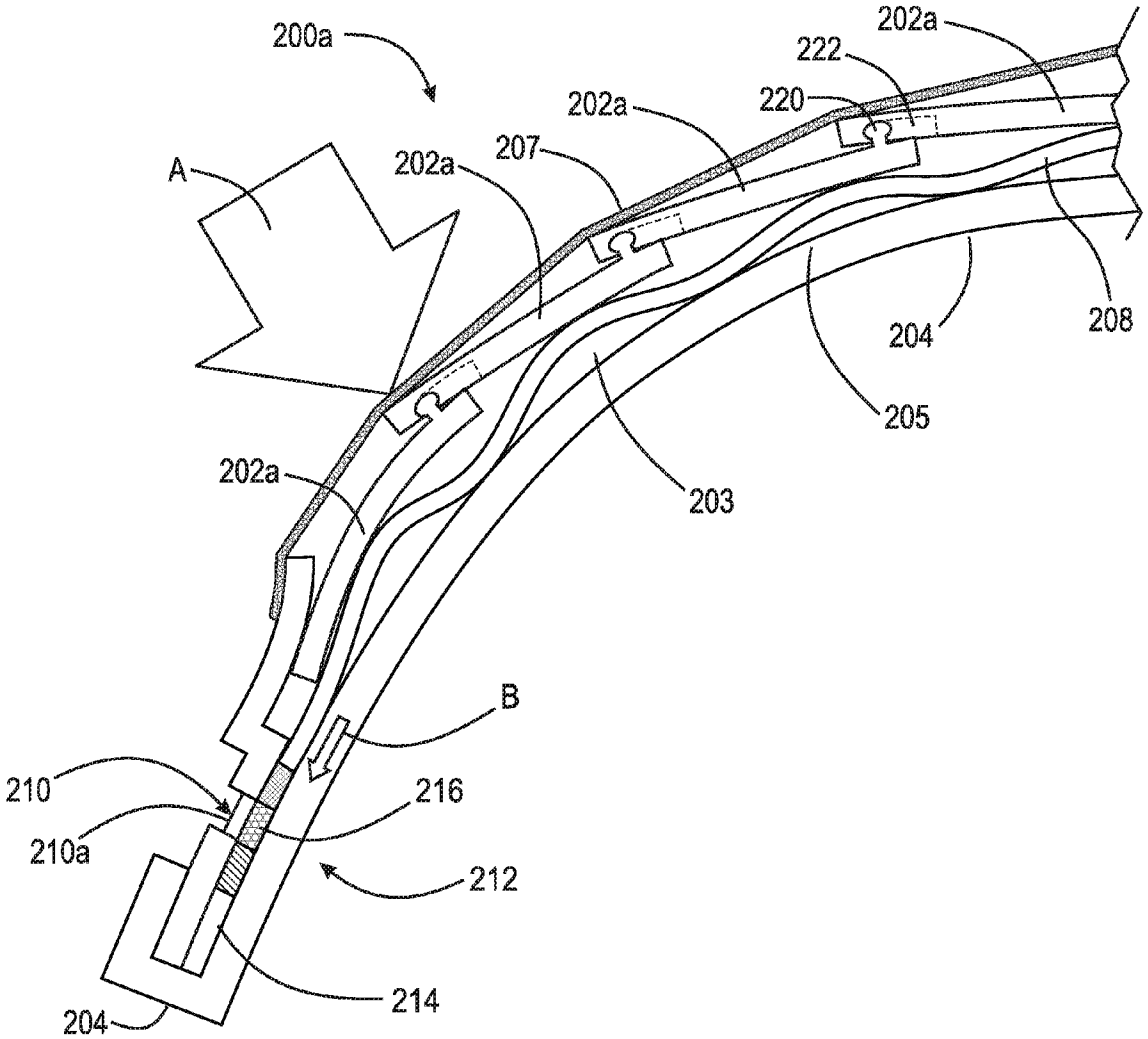
FIG. 25 shows the same view of the helmet as shown in FIG. 24 showing force, such as from a blow or hit, being applied to the helmet.
Figure 26:
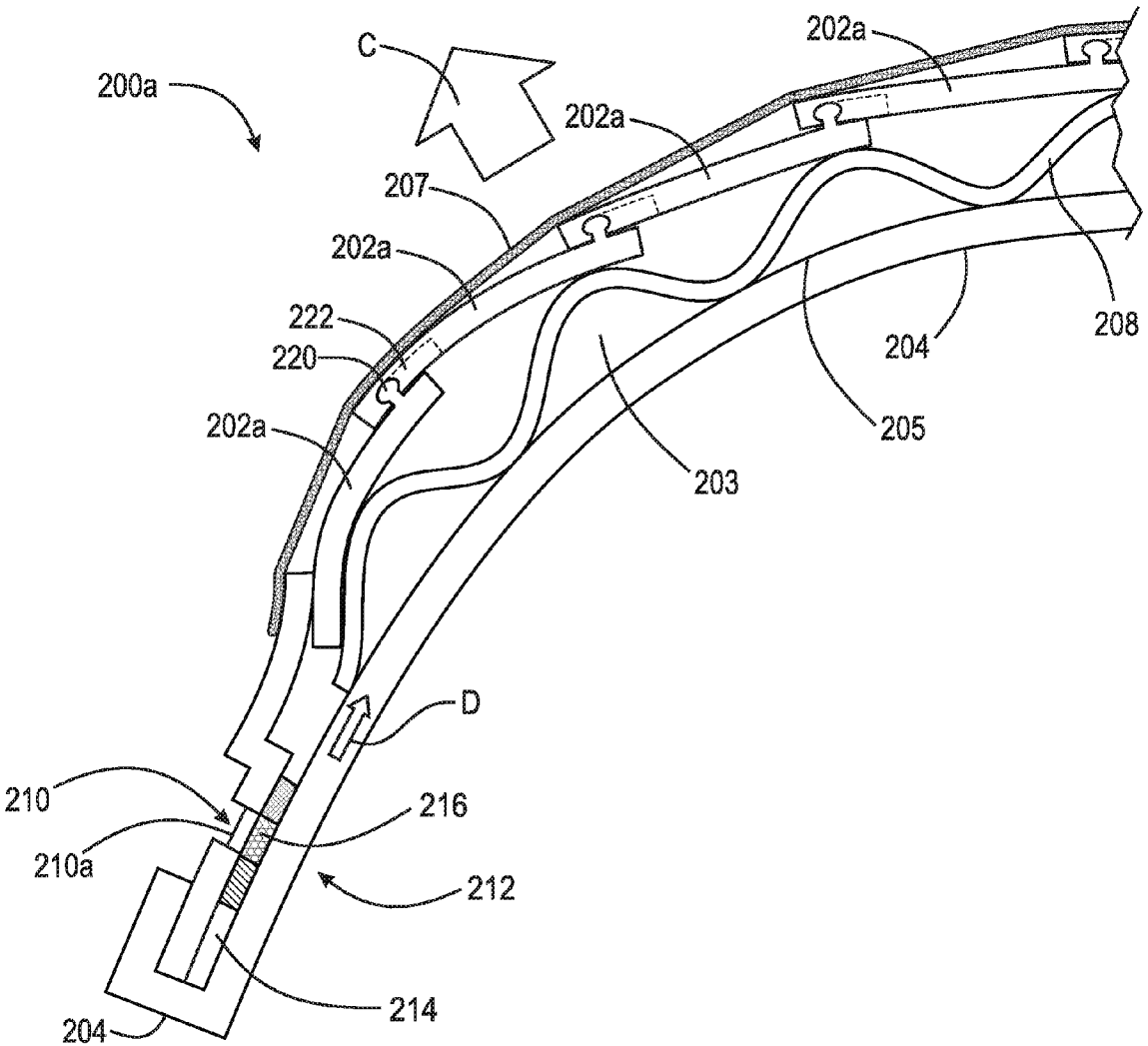
FIG. 26 depicts the same view shown in FIGS. 24 and 25 after the outer shell and sinusoidal spring have returned to the neutral position.

FIGS. 25 and 26 are similar to FIGS. 22 and 23, respectively, in showing outer shell 202*a* compressed by force A and returning to the neutral state as represented by arrow C. As with helmet 200 discussed above, tab 216 remains displayed in window 210 indicating at least semi-quantitatively, the amount of force that struck helmet 202*a*, after spring 208 retracts (arrow D). By semi-quantitatively, it is meant that the degree of exposure of tab 216 under window 210 indicates if a first impact hits helmet 200 with greater force than a second impact, the measurement recorded is the more severe of the two impacts.

The indicator(s) on tab 216 displayed in window 210 can be used to show how far spring 208 has moved and thus indicates the amount of force that has struck helmets 200 and 200*a*. Springs 208 may be fabricated with suitable calibrated or measured tension using known methods to extend to appropriate lengths depending on the force of the impact to indicate, in at least a semi-quantitative manner, the amount of force striking helmet 200 (or helmet 200*a*) and thus possibly affecting the user. Tab 216 may be returned to its neutral position using a screwdriver or other instrument to move it back into operative contact with spring 208. In some embodiments, a minimum or sufficient amount of force may be necessary to move tab 216 into window 210. If the striking force is below this minimum, spring 208 will not lengthen sufficiently to move tab 216 into window 210 indicating the striking force was insufficient to cause injury to the user.

Figure 27:
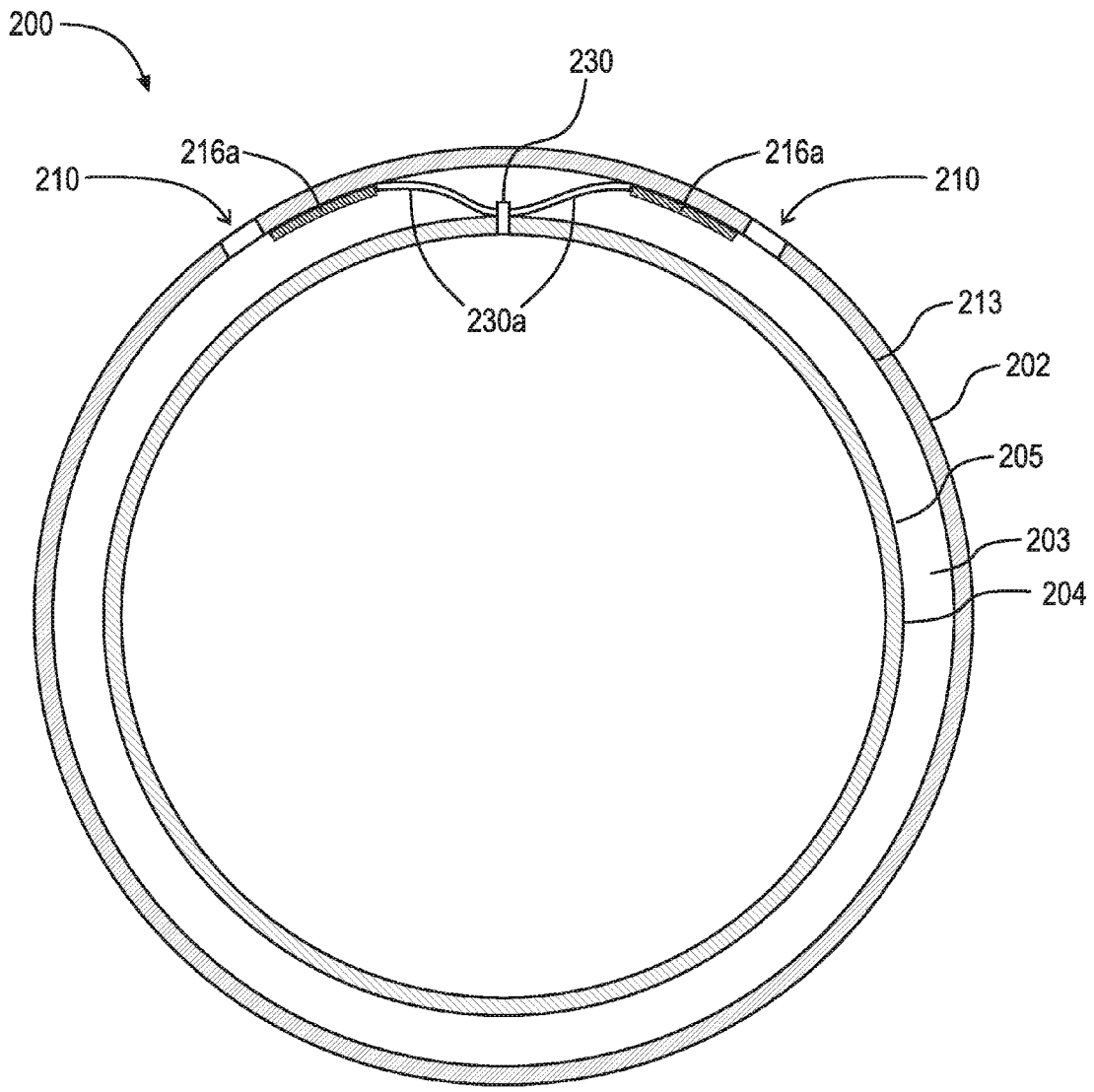
FIG. 27 is a transverse cross-sectional view illustrating another alternate embodiment of helmet including a tab indicator to measure at least semi-quantitatively rotational force striking the helmet.

FIG. 27 is a transverse cross-sectional view illustrating another alternate embodiment of helmet 200 to include a tab indicator to measure, at least semi-quantitatively, rotational force striking helmet 200. In this view, sinusoidal springs 208 are removed for clarity, but persons of ordinary skill in the art will recognize that at least one spring 208 may be used in helmets 200 and 200*a* with this embodiment. Support 230 is fixedly attached to inner shell 204 on outer surface 205. Support 230 extends across zone 203 and contacts inner surface 213 of outer shell 202. Arms 230*a* extend from support 230 generally transversely along inner surface 213 of outer shell 202. Arms 230*a* are in operative contact with tab indicators 216*a*, which are positioned in rails 214 (not shown).

Figure 28:
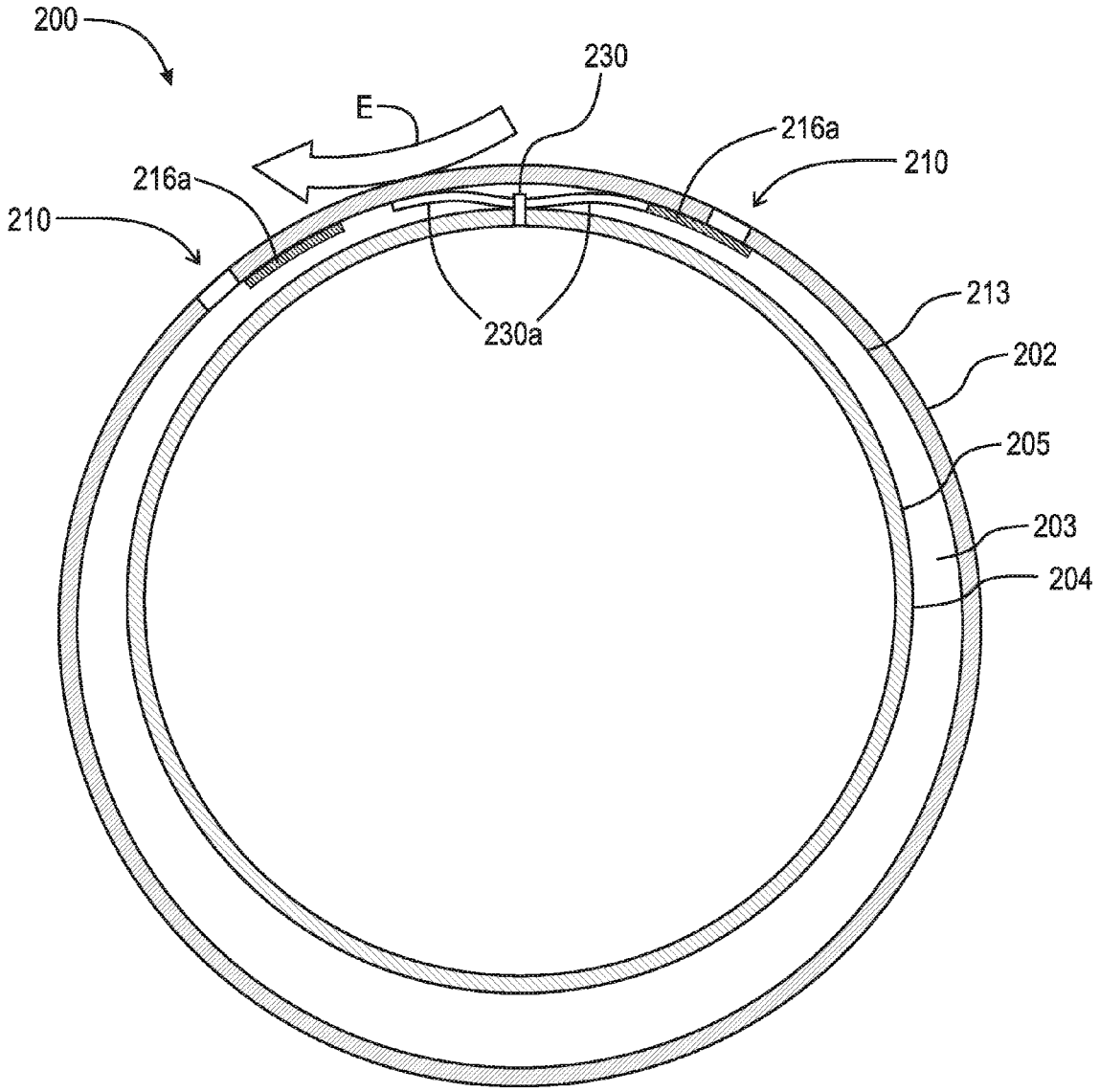
FIG. 28 is a transverse cross-sectional view of the helmet depicting movement of the outer shell when struck by rotational force represented by the arrow, i.e., force striking from an angle relative to the helmet.
Figure 29:
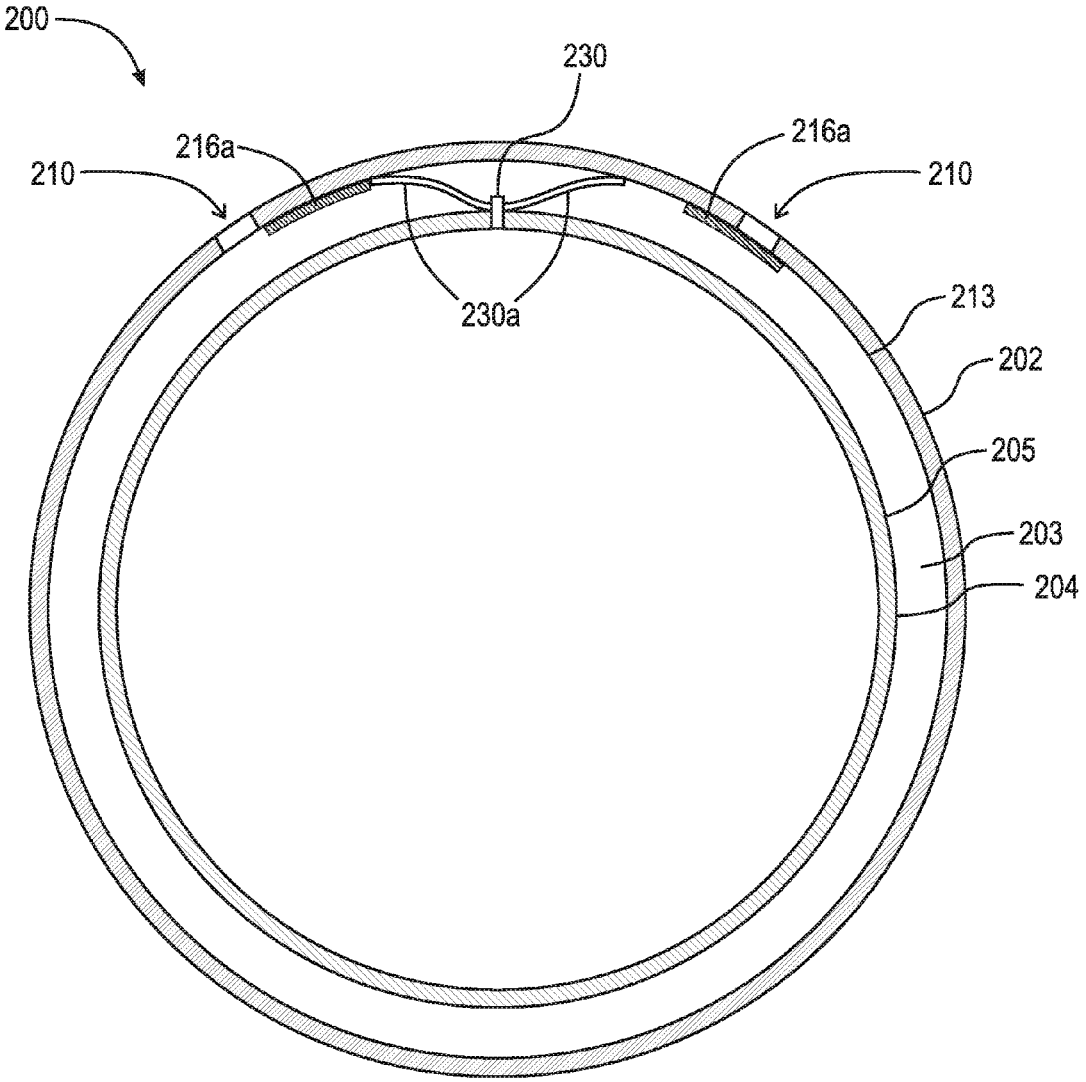
FIG. 29 is a transverse cross-sectional view of the helmet representing the outer shell after it is returned to the neutral position after being struck by a rotational force with a tab indicator displayed in a window.

In FIG. 28, arrow E represents rotational force, e.g., force striking from an angle relative to helmet 200 (or helmet 200*a*). Because inner shell 204 is stationary relative to the rotational motion of outer shell 202, which is suspended on inner shell 204 by springs 208, support 230 and attached arms 230*a* remain stationary relative to outer shell 202. Tab indicators 216*a* rotate with outer shell 202 against stationary arms 230*a*, which forces them to move along rails 214. As shown in FIG. 29, when outer shell 202 returns to the neutral position after the hit, tab indicator 216*a* remains in rails 214 where they have been pushed. If the rotational force is sufficient, tab indicators 216*a* will be displayed in window 210 indicating helmet 200 was hit with sufficient rotational force to display indicator 216*a*, thus indicating a possible injury to the user.

Figure 30:
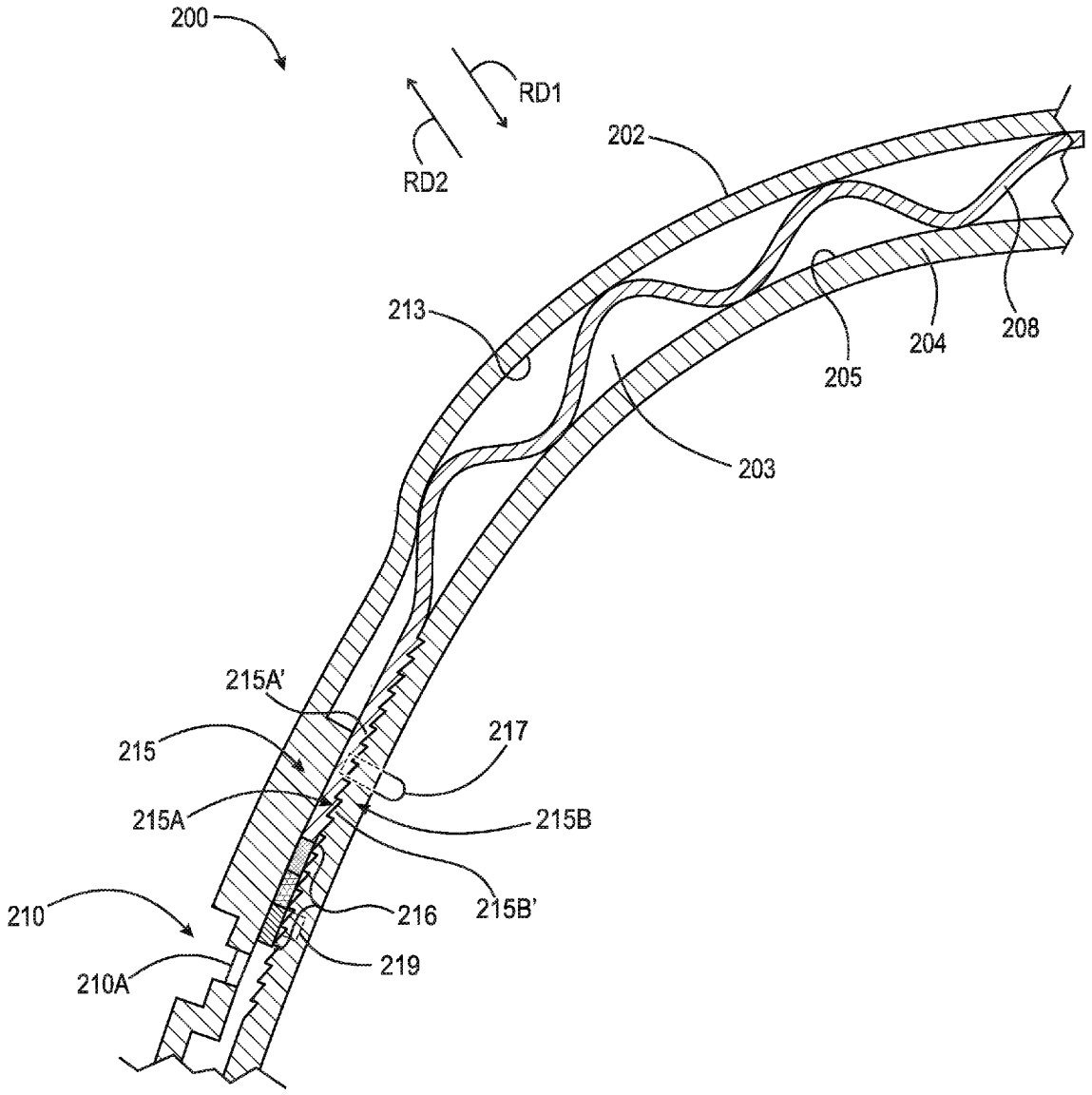
FIG. 30 is a cross-sectional view of an alternative embodiment of the helmet shown in FIG. 20.

FIG. 30 is a cross-sectional view of an alternative embodiment of the helmet shown in FIG. 20. In the alternative embodiment shown, helmet 200 further comprises energy dissipation device 215 arranged radially between outer shell 202 and inner shell 204. Energy dissipation device 215 comprises first portion 215A and second portion 215B, which are arranged to engage, and lock, with each other. In this exemplary embodiment, first portion 215A is connected to spring 208 and comprises plurality of teeth 215A' facing radially inward in direction RIM. Second portion 215B is connected to inner shell 204 and comprises plurality of teeth 215B' facing radially outward in direction RD2. Energy dissipation device 215 further comprises release 217 for disengaging first portion 215A and second portion 215B. For example, pressing release 217 displaces first portion 215A radially outward in direction RD2 and disengages teeth 215A' of first portion 215A from teeth 215B' of second portion 215B. Indicator tab 216 comprises return tab 219 connected thereto. Return tab 219 is arranged radially inward of indicator tab 216 such that the user can return indicator tab 216 to the position shown in FIG. 30. Helmet 200 may also comprise substrate 210*a* arranged over window 210 such that indicator tab 216 can only be accessed using return tab 219 inside helmet 200 (i.e., indicator tab 216 cannot be accessed through window 210).

Figure 31:
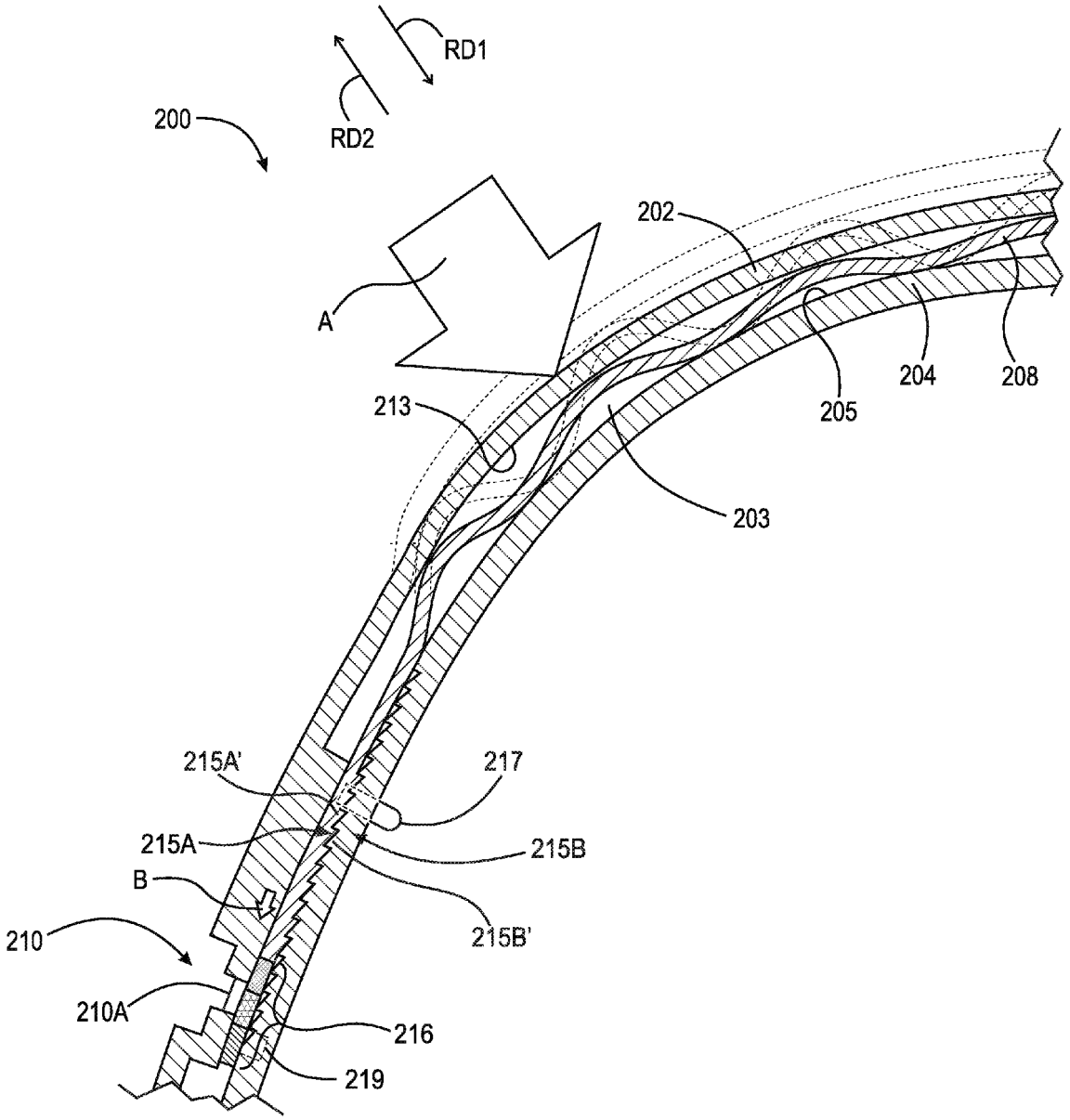
FIG. 31 shows the same view as the view shown in FIG. 30 showing force, such as from a blow or hit, being applied to the helmet.

FIG. 31 shows the same view of helmet 200 as shown in FIG. 30 in which force A, represented by arrow A, is applied to helmet 200. The effect of the force is the same as that shown and described with respect to FIG. 22 above. However, as spring 208 extends in direction B, first portion 215A displaces in direction B relative to second portion 215B, which displaces indicator tab 216. First portion 215A engages with second portion 215B, for example, via teeth 215A' and 215B'. In this exemplary embodiment, outer shell 202 is functionally connected to inner shell 204 such that window 210 remains in a constant location and does not vary in size (i.e., outer shell 202 does not displace circumferentially relative to inner shell 204 at or around the location of window 210).

Figure 32:
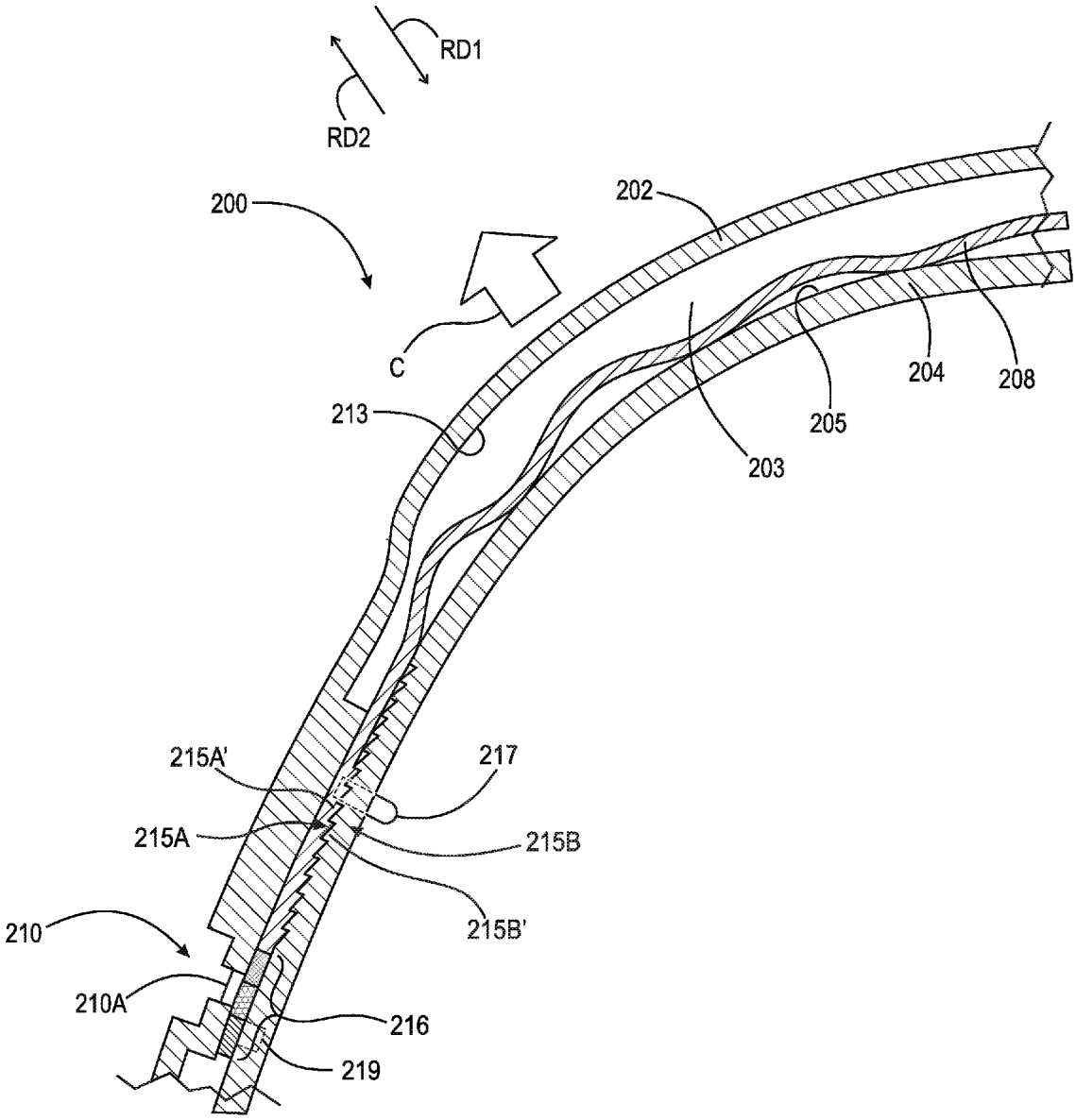
FIG. 32 depicts the same view shown in FIGS. 30 and 31 after the outer shell has returned to the neutral position.
Figure 33:
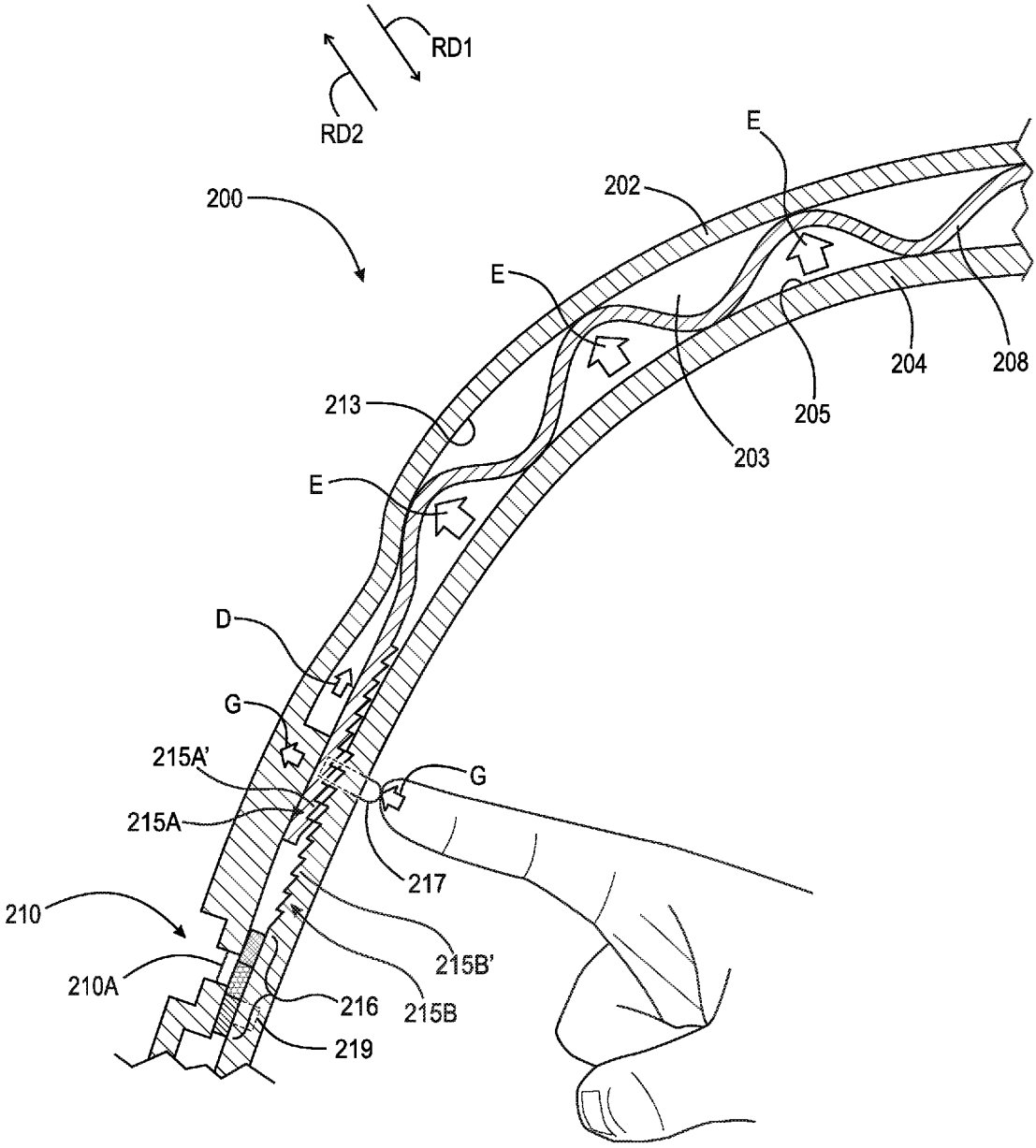
FIG. 33 shows the disengagement of an energy dissipation device and the return of the sinusoidal spring to the neutral position.
Figure 34:
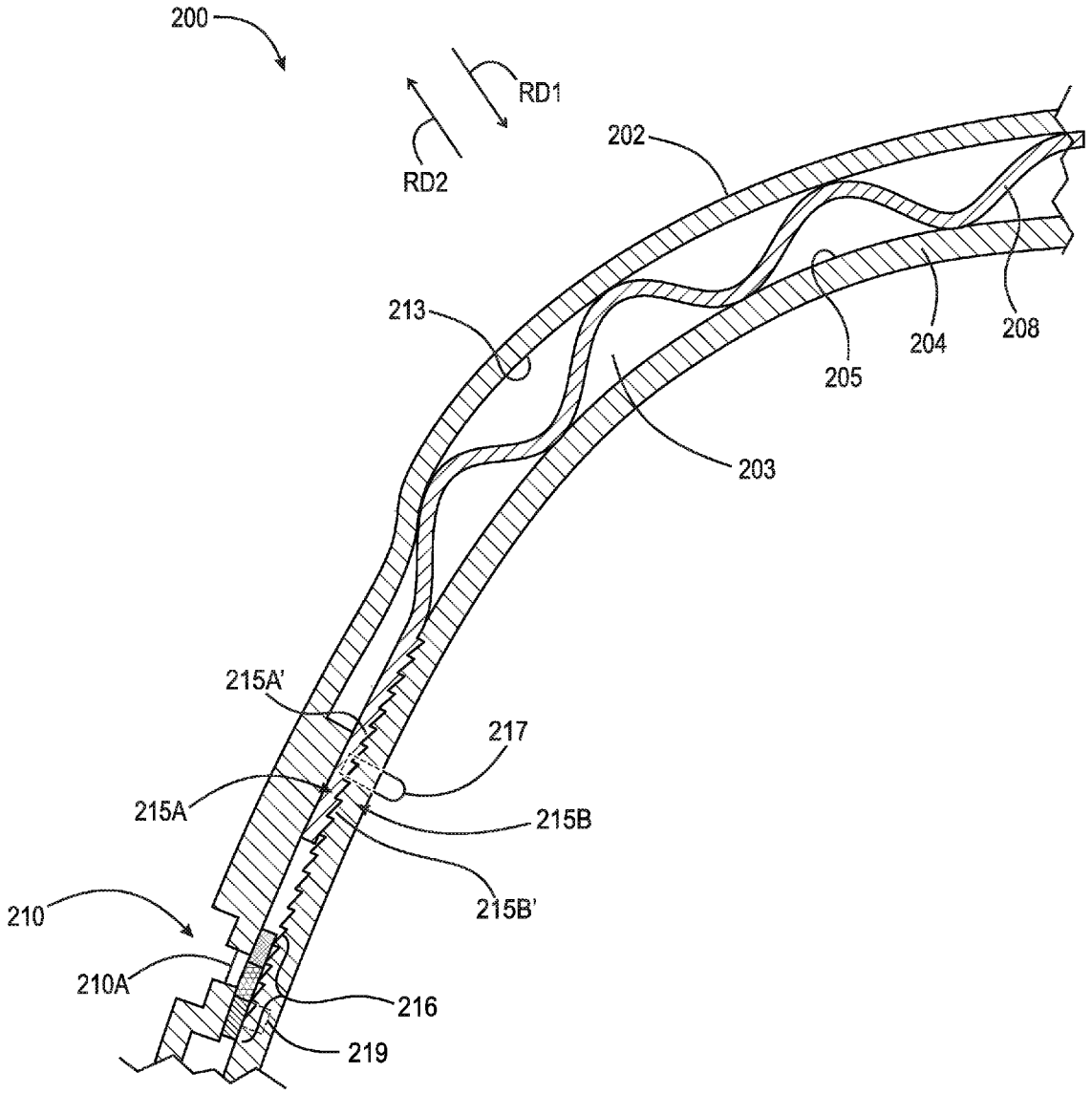
FIG. 34 shows the helmet as shown in FIGS. 31-33 after the energy dissipation device has been completely disengaged.

FIG. 32 depicts the same view shown in FIGS. 30 and 31 after outer shell 202 has returned to the neutral position. The return movement of outer shell 202 is shown by arrow C. Unlike the embodiment shown in FIG. 23, however, spring 208 does not return to its neutral position because of energy dissipation device 215. First portion 215A is still engaged, and thus locked, with second portion 215B. FIG. 33 shows the disengagement of energy dissipation device 215, wherein release 217 is activated. In an example embodiment, release 217 is connected to first portion 215A and is displaced in direction G to disengage energy dissipation device 215. For example, pressing release 217 displaces first portion 215A radially outward in direction RD2 (or G) and disengages teeth 215A' from teeth 215B'. The return of first portion 215A is shown by arrow D while the return of spring 208 is shown by arrows D and E. In another example embodiment, Bluetooth® technology or radio communication can be used to send a signal indicating when tab 216 is displaced into window 210, so that another party (e.g., coach, doctor, medical professional, etc.) is aware that a significant impact has occurred from a remote location (i.e., without having to be within viewing distance of window 210). In addition, Bluetooth® technology or radio communication can be used to send a signal indicating the position of tab 216 in window 210, so that the party is aware of the magnitude of impact that occurred from the remote location. The Bluetooth® technology or radio communication used to send the signal as discussed above is embodied as radio communication device 250. FIG. 34 shows helmet 200 after energy dissipation device 215 has been completely disengaged. The position of tab 216 remains in window 210 after spring 208 retracts back to its normal state.

Figure 35:
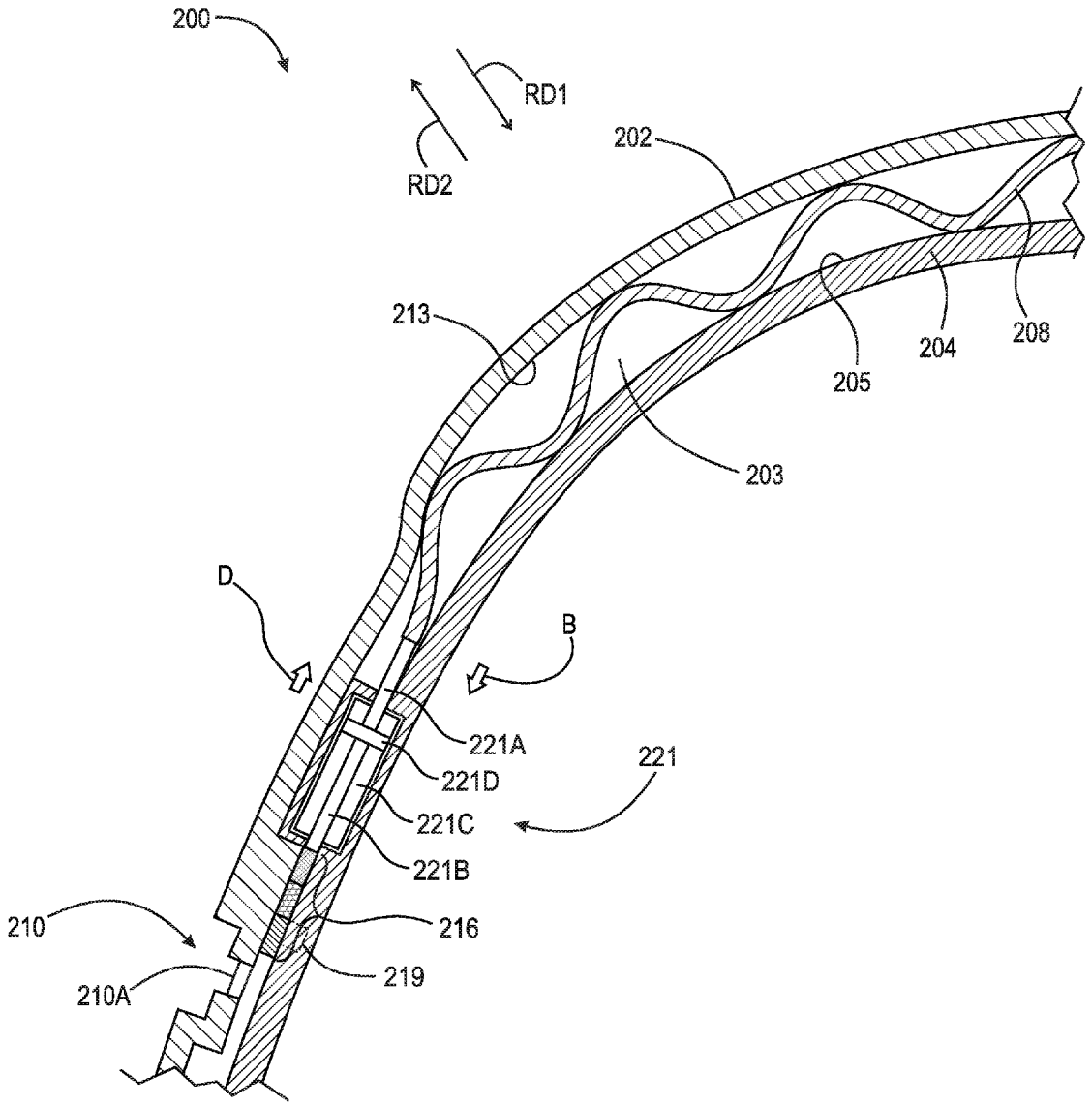
FIG. 35 is a cross-sectional view of an alternative embodiment of the helmet shown in FIG. 20.

FIG. 35 is a cross-sectional view of an alternative embodiment of the helmet shown in FIG. 20. In the alternative embodiment shown, helmet 200 further comprises piston device 221 arranged in inner shell 204. In another embodiment, piston device 221 is arranged at any suitable location radially between inner shell 204 and outer shell 205. Piston device 221 is an energy dissipation device comprising first rod 221*a*, second rod 221*b*, cylinder 221*c*, and flange 221*d*. First rod 221*a* is connected to spring 208 at a first end and flange 221*d* at a second end. Second rod 221*b* is connected to flange 221*d* at a first end and abuts against indicator tab 216 at a second end. Flange 221*d* is arranged in cylinder 221*c*. In an example embodiment, piston device 221 acts similar to a dashpot or any other suitable device such that displacement of spring 208 in direction B is not inhibited and the return of spring 208 in direction D occurs at a controlled rate, preferably slowly. In this embodiment, there is no need for a release because spring 208 always returns to its neutral position. Piston device 221 can be a hydraulic piston, a pneumatic piston, or any other suitable device capable of performing the above-identified function.

Figure 36:
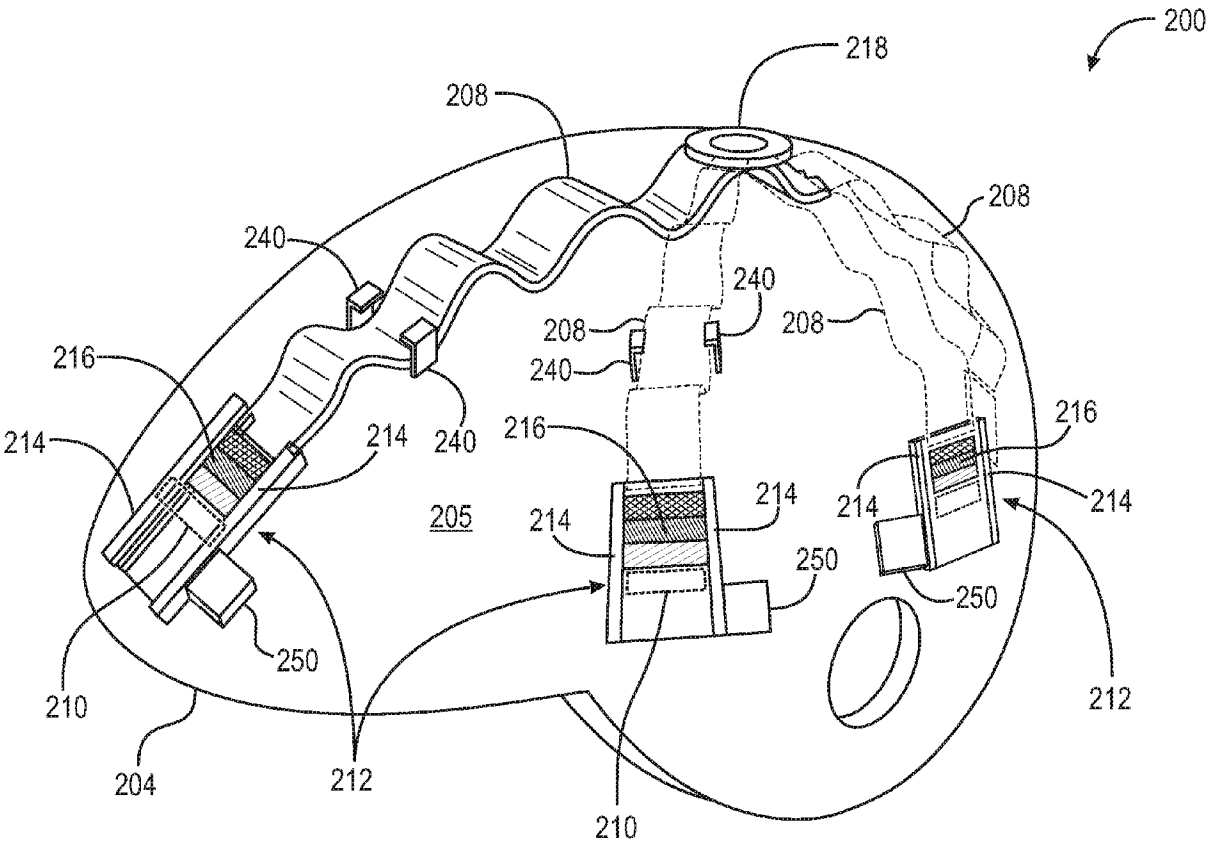
FIG. 36 is a top perspective view of the alternative embodiment of the helmet shown in FIG. 35.

FIG. 36 is a top perspective view of an alternative embodiment of the helmet shown in FIG. 20. In this embodiment, helmet 200 comprises a plurality of brackets 240. Brackets 240 are connected to inner shell 204 and arranged adjacent to springs 208. Brackets 240 prevent and/or limit springs 208 from moving laterally. This system provides torsional damping as well as linear damping. Brackets 240 allow spring 208 to function as a torsion bar thereby mitigating rotational or angular force applied to helmet 200.

Figure 37:
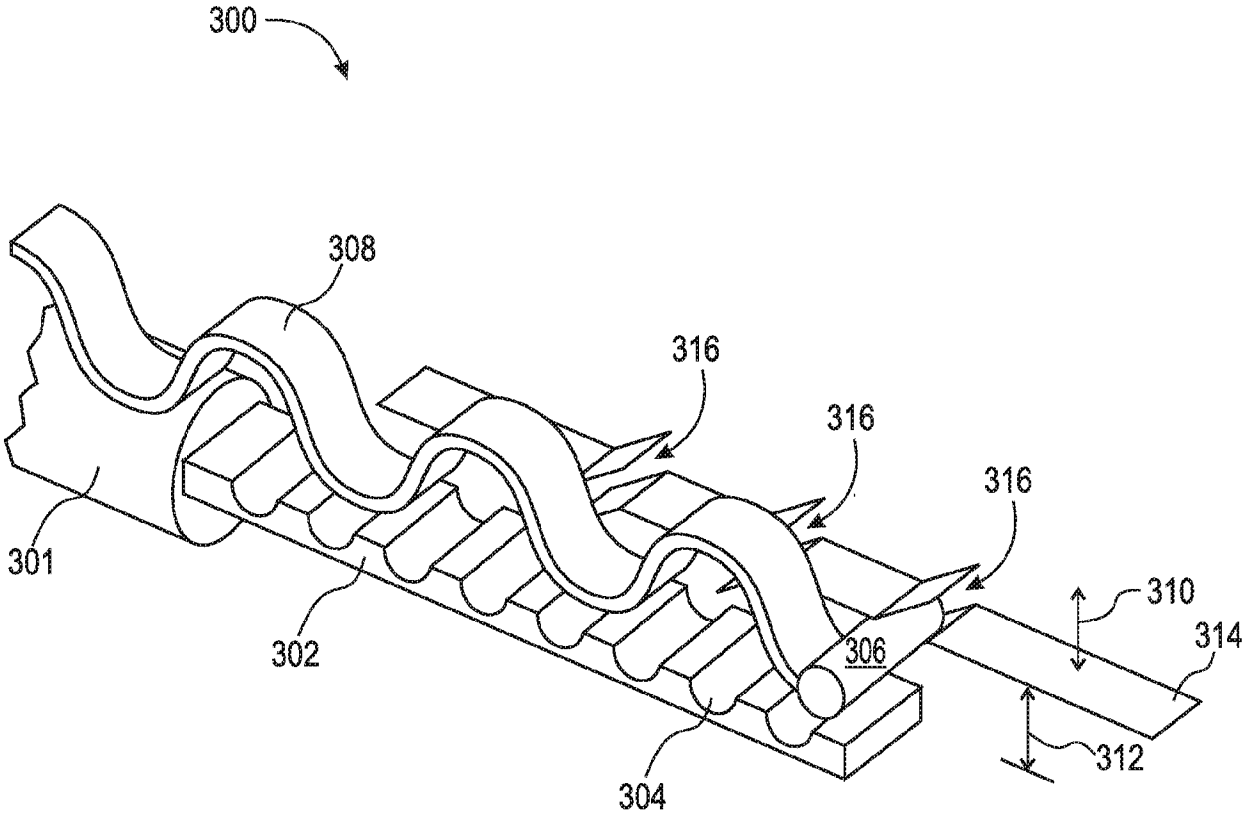
FIG. 37 is a top perspective view of the alternative embodiment of an energy dissipation device used in the helmet shown in FIG. 35.

FIG. 37 is a top perspective view of an alternative embodiment of energy dissipation device 300 used in helmet 200 shown in FIG. 20. Energy dissipation device 300 comprises dashpot 301, arm 302, cylinder 306, and barrier 314. Dashpot 301 is a linear mechanical device, a damper which resists motion via viscous friction. Arm 302 comprises a plurality of notches and is slidingly engaged within dashpot 301. Cylinder 306 is connected to sinusoidal spring 308 and is arranged to slide in levels 310 and 312. Levels 310 and 312 are separated by barrier 314. Barrier 314 comprises a plurality of doors 316, which are operatively arranged to allow cylinder 306 to pass from level 310 to level 312. Barrier 314 also comprises door 318, which is operatively arranged to allow cylinder 306 to pass from level 312 to level 310.

Figure 38:
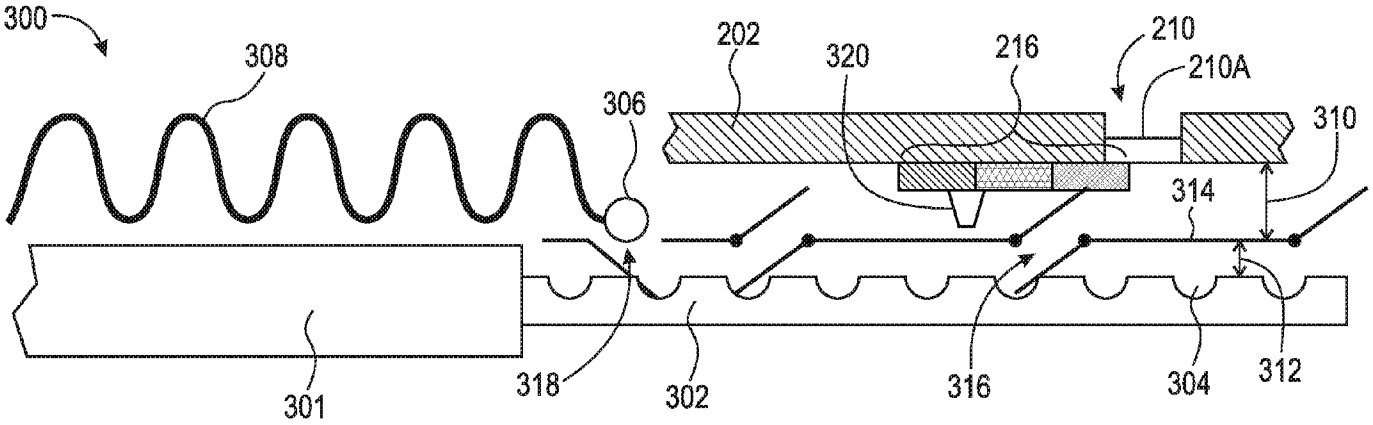
FIG. 38 is a cross-sectional view of the energy dissipation device shown in FIG. 37.
Figure 39:
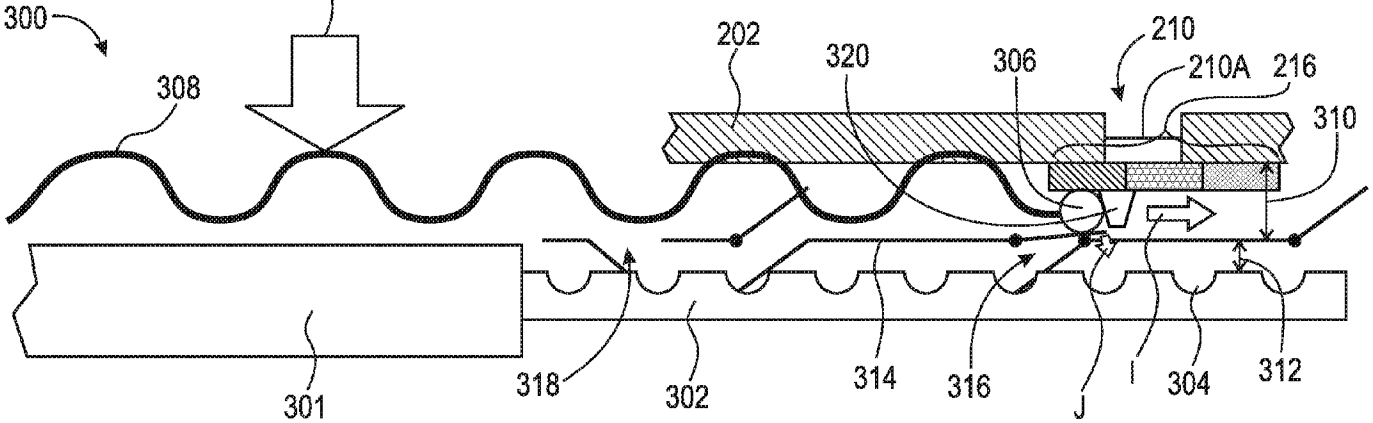
FIG. 39 is a cross-sectional view of the energy dissipation device shown in FIG. 37.
Figure 40:
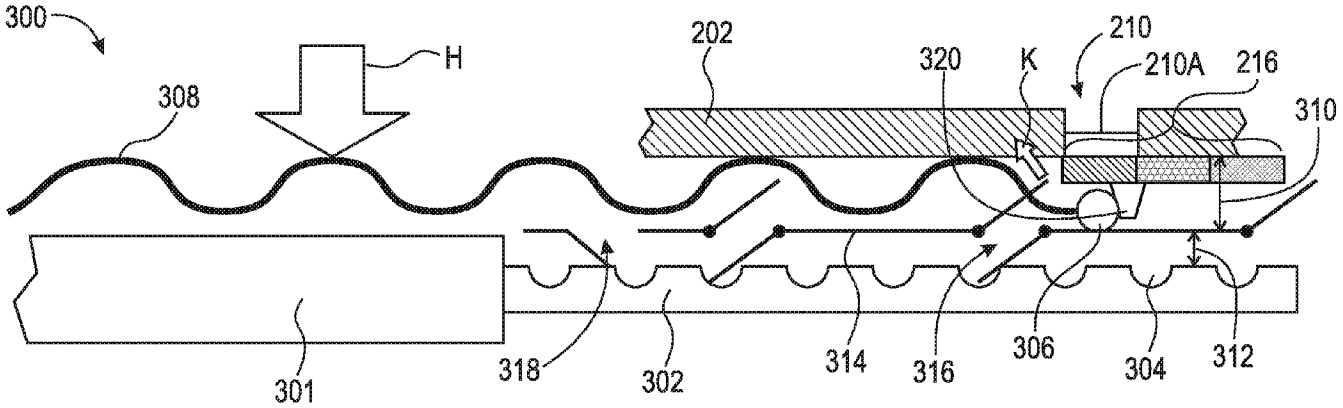
FIG. 40 is a cross-sectional view of the energy dissipation device shown in FIG. 37.
Figure 41:
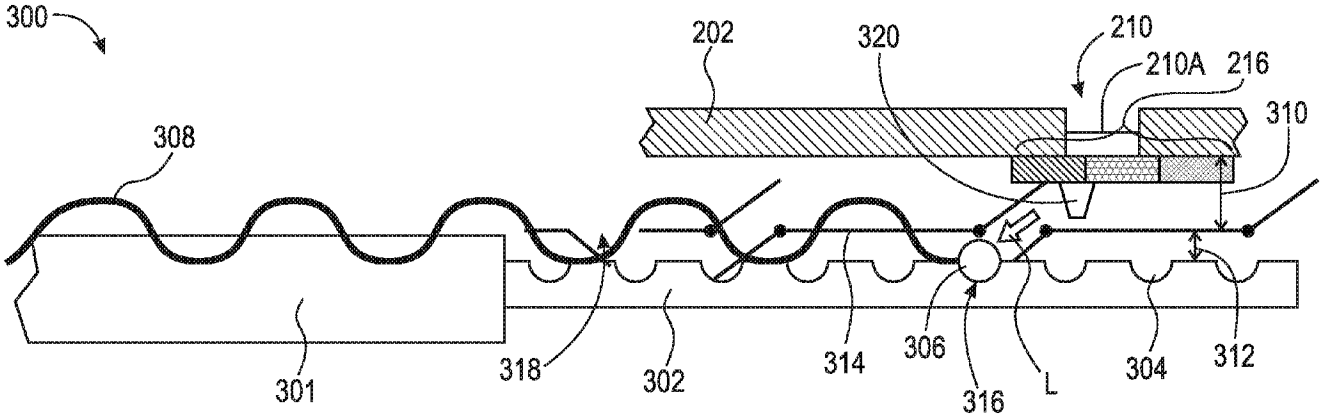
FIG. 41 is a cross-sectional view of the energy dissipation device shown in FIG. 37.
Figure 42:
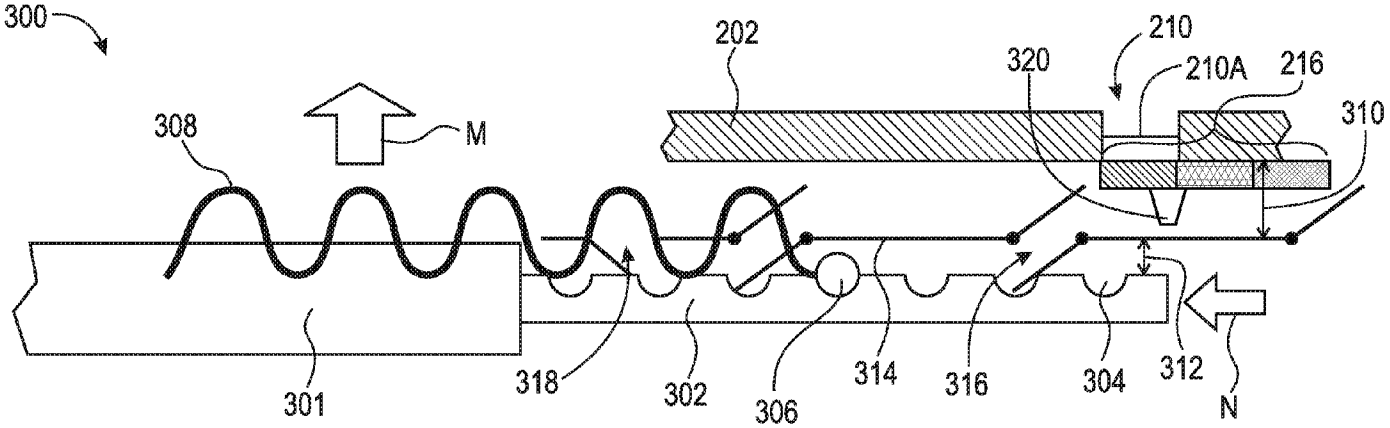
FIG. 42 is a cross-sectional view of the energy dissipation device shown in FIG. 37; and, FIG. 43 is a cross-sectional view of the energy dissipation device shown in FIG. 37.
Figure 43:
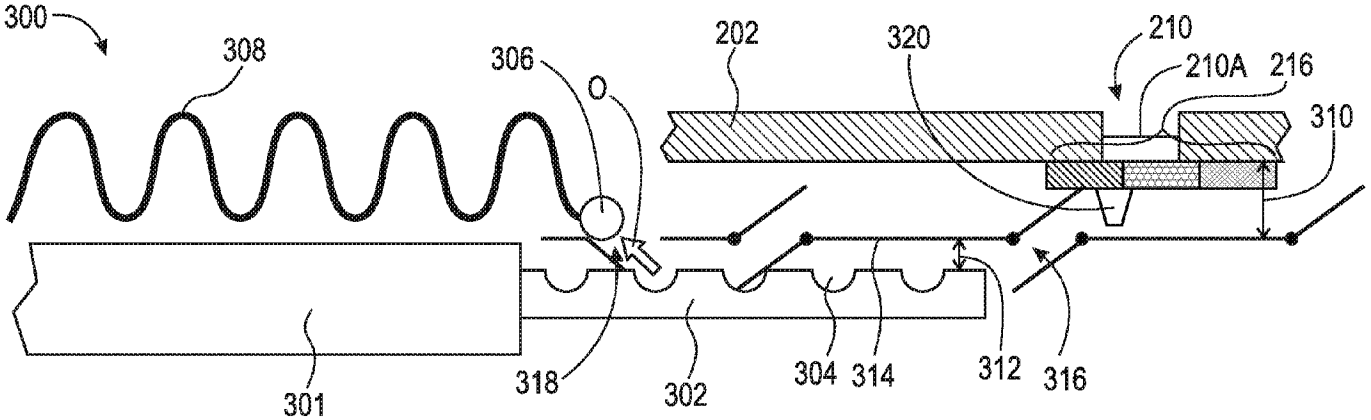

FIGS. 38-43 are cross-sectional views of energy dissipation device 300 shown in FIG. 37. FIG. 38 shows energy dissipation device 300 in a neutral position. Cylinder 306 is arranged in level 310 and arm 302 is fully extended from dashpot 301. FIG. 39 shows energy dissipation device 300 during an impact in direction H. Sinusoidal spring 308, and thus cylinder 306, extends along level 310 in direction I. Cylinder 306 displaces extension 320 and moves force indicator tab 216 into window 210. Cylinder 306 also forces door 316 in direction J. FIG. 40 shows energy dissipation device 300 during an impact in direction H. Sinusoidal spring 308 has extended such that cylinder 306 passes over door 316 in level 310. Door 316 moves in direction K to return to its neutral position. FIG. 41 shows energy dissipation device 300 after an impact. Cylinder 306 slips from level 310 to level 312 through door 316 in direction L. Cylinder 306 then engages one of notches 304 in arm 302. FIG. 42 shows energy dissipation device 300 after an impact. Cylinder 306, now arranged in level 312, engages one of notches 304. Sinusoidal spring 308 returns to its neutral position in direction M, which pulls cylinder 306, and thus arm 302, in direction N. FIG. 43 shows energy dissipation device 300 after an impact. Cylinder 306 slips from level 312 to level 310 through door 318 in direction O. Sinusoidal spring 308 has returned to the neutral position. Arm 302 returns to its fully extended position relative dashpot 301. It should be appreciated that force indicator tab 216 can be manually returned to a neutral position.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 Multiple Protective Zone Helmet
12 Outer shell
14 Apertures
16 Diaphragm
18 Face Protection Device Attachments
18*a* Face Protection Device Attachment
18*b* Face Protection Device Attachment
20 Inner Shell
22 Sliding Connection
22*a* U-Shaped Elastomeric Connector
24 Padding
24*a* Loose Cushioning Pieces
30 Elastomeric Springs or Cords
31 Elastomeric Cords
31*a* Elastomeric Portion
31*b* Nonelastomeric Portion
32 Plugs
36 Cavities
36*a* Concave Sides
40 Bladders
40*a* Compartments
41 Leaf Springs
41' Springs
41*a* Elliptical Leaf Spring
42 Anchor Point
43 Arm
43*a* Ends
43' Arms
43*a'* Ends
44 Bladder Wall
46 Valves
50 Intermediate Shell/Crumple Zone
52 Filler
54 Cones
60 Liftable Lids
62 Hinges
100 Articulating Helmet
101 Outer Surface
101*a* Inner Surface
102*a* Section
102*b* Section
103*a* Section
103*b* Section
103*c* Section
104 Articulating Means
104*a* Swivel means
105 Cable
106 Lock
107 Universal Joint
108 Ear Apertures
108*a* Membrane or Diaphragm
109 Spring
110 Air Vents
112 Pads or Cushions
120 Prongs or Tubes
122 Ports
200 Helmet
200A Helmet
202 Outer Shell
202*a* Overlapping Plates
203 Elastomeric Zone
204 Inner Shell
205 Outer Surface
207 Cover
208 Sinusoidal Spring (Springs)
210 Window
210*a* Substrate
211 Edge portion
212 Channel
213 Inner surface
214 Rails
215 Energy Dissipation Device
215A First Portion
215B Second Portion
215A' Teeth

215B' Teeth
216 Force Indicator Tab(s)
216*a* Tab Indicators
217 Release
218 Rivet
219 Return Tab
220 Pin
221 Piston Device
221*a* First Rod
221*b* Second Rod
221*c* Cylinder
221*d* Flange
222 Socket
230 Support
230*a* Arms
240 Brackets
250 Radio communication device
300 Energy Dissipation Device
301 Dashpot
302 Arm
304 Notches
306 Cylinder
308 Sinusoidal Spring
310 Level
312 Level
314 Barrier
316 Doors
318 Door
320 Extension
A Force (Force Arrow)
B Direction
C Direction
D Direction
E Direction
F Force
G Direction
H Direction
I Direction
J Direction
K Direction
L Direction
M Direction
N Direction
O Direction
U Top Head of User
L1 Length
L2 Length
L3 Length
L4 Length
RD1 Radial Direction
RD2 Radial Direction

What is claimed is:

1. A protective helmet having multiple protective zones, comprising:

an inner shell having a first inner surface and a first outer surface;

an outer shell having a second inner surface, a second outer surface, and at least one window defined by said outer shell, said outer shell functionally attached to said inner shell;

an elastomeric zone between said first outer surface and said second inner surface;

a plurality of sinusoidal springs positioned in said elastomeric zone, each of the plurality of sinusoidal springs comprising:

a first end; and, a second end;

a plurality of piston devices arranged between the inner and outer shells, wherein each of said plurality of piston devices comprises:

a first component connected to the second end; and, a second component; and, a force indicator tab in operative contact with said second end of at least one of said plurality of sinusoidal springs, wherein said force indicator tab is moved to said at least one window by said second end when said helmet is impacted with sufficient force.

2. The protective helmet as recited in claim 1, wherein said first end of at least one of said plurality of sinusoidal springs is attached to said first outer surface.

3. The protective helmet as recited in claim 1, wherein each one of said plurality of sinusoidal springs is attached at a common point on said inner shell.

4. The protective helmet as recited in claim 1, further comprising a plurality of brackets connected to said first outer surface, said second inner surface, or both said first outer surface and said second inner surface, wherein said plurality of brackets are operatively arranged adjacent to said plurality of sinusoidal springs to limit with a lateral and torsional movement of said plurality of sinusoidal springs.

5. The protective helmet as recited in claim 1, wherein said at least one window extends in a generally sagittal direction.

6. The protective helmet as recited in claim 1, wherein said force indicator tab is positioned in a slot or between two rails.

7. The protective helmet as recited in claim 6, wherein said force indicator tab comprises a return tab.

8. The protective helmet as recited in claim 1, wherein the second component comprises:

a dashpot;

an arm including a plurality of notches, the arm slidingly engaged with the dashpot; and, a barrier including a plurality of doors.

9. The protective helmet as recited in claim 8, wherein the first component is a cylinder and is operatively arranged to:

move axially along the barrier;

pass through the plurality of doors; and, engage the plurality of notches.

10. A protective helmet having multiple protective zones, comprising:

an inner shell having a first inner surface and a first outer surface;

an outer shell having a second inner surface and a second outer surface, said outer shell functionally attached to said inner shell;

an elastomeric zone between said first outer surface and said second inner surface;

a plurality of sinusoidal springs positioned in said elastomeric zone, each of the plurality of sinusoidal springs comprising:

a first end; and, a second end;

a plurality of piston devices arranged between the inner and outer shells, wherein each of said plurality of piston devices comprises:

a first component connected to the second end; and, a second component; and, a plurality of brackets connected to said first outer surface, said second inner surface, or both said first outer surface and said second inner surface, wherein said plurality of brackets are operatively arranged adjacent to said plurality of sinusoidal springs to limit a lateral and torsional movement of said plurality of sinusoidal springs.

* * * * *